US006203972B1

(12) United States Patent
Katoh et al.

(10) Patent No.: US 6,203,972 B1
(45) **Date of Patent: *Mar. 20, 2001**

(54) PHOTOTHERMOGRAPHIC MATERIAL

(75) Inventors: Kazunobu Katoh; Minoru Sakai; Tsutomu Arai; Kiyokazu Hashimoto, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/845,370

(22) Filed: Apr. 24, 1997

(30) Foreign Application Priority Data

| | | |
|---|---|---|
| Apr. 26, 1996 | (JP) | 8-130848 |
| Apr. 30, 1996 | (JP) | 8-132834 |
| Apr. 30, 1996 | (JP) | 8-132836 |
| Apr. 30, 1996 | (JP) | 8-132840 |
| Apr. 30, 1996 | (JP) | 8-132841 |
| Oct. 30, 1996 | (JP) | 8-304011 |
| Dec. 28, 1996 | (JP) | 8-358412 |

(51) Int. Cl.[7] ..... G03C 1/498

(52) U.S. Cl. ..... 430/619; 430/264; 430/523; 430/527; 430/530; 430/531

(58) Field of Search ..... 430/523, 530, 430/527, 619, 264, 531

(56) References Cited

U.S. PATENT DOCUMENTS

| | | | | |
|---|---|---|---|---|
| 4,814,254 | * | 3/1989 | Naito et al. | 430/203 |
| 5,382,496 | * | 1/1995 | Sakai et al. | 430/264 |
| 5,464,738 | | 11/1995 | Lynch et al. . | |
| 5,468,603 | * | 11/1995 | Kub | 430/619 |
| 5,496,695 | | 3/1996 | Simpson et al. . | |
| 5,620,839 | * | 4/1997 | Kawamoto et al. | 430/523 |
| 5,677,121 | | 10/1997 | Tsuzuki . | |

FOREIGN PATENT DOCUMENTS

| | | |
|---|---|---|
| 0762196 | 3/1997 | (EP) . |
| 8211547 | 8/1996 | (JP) . |

* cited by examiner

*Primary Examiner*—Thorl Chea

(57) ABSTRACT

A photothermographic material has a support bearing a photosensitive layer containing an organic silver salt, a photosensitive silver halide, a reducing agent, and a ultra-high contrast promoting agent. The support is a plastic film having a Tg of at least 90° C. Better results are obtained when the support experiences a dimensional change of up to 0.04% when heated at 115° C. for 30 seconds. Preferably, a conductive polymer layer is provided typically as an outermost layer, and an outermost layer has a Bekk smoothness of up to 4,000 seconds, typically a back layer has a Bekk smoothness of up to 4,000 seconds. The photothermographic material has improved dimensional stability and produces ultrahigh contrast images with high Dmax.

27 Claims, No Drawings

PHOTOTHERMOGRAPHIC MATERIAL

BACKGROUND OF THE INVENTION

1. Field of the Invention

This invention relates to a photothermographic material, especially suited for the manufacture of printing plates.

2. Prior Art

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969. The silver system of this type is generally known as a dry silver system.

These photothermographic materials generally contain a reducible silver source (e.g., organic silver salt), a catalytic amount of a photocatalyst (e.g., silver halide), a toner for controlling the tonality of silver, and a reducing agent, typically dispersed in a binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

Such photothermographic materials have been used as microphotographic and radiographic photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices. Also a need for easy and dry processing is increasing.

U.S. Pat. No. 5,464,738 describes that high contrast images are obtainable using sulfonyl hydrazide as a reducing agent for dry silver. However, development does not take place unless the developing temperature is raised as high as 136° C. to 142° C.

U.S. Pat. No. 5,496,695 describes that high contrast images are obtainable using hindered phenol and formylhydrazine or tritylhydrazine as a reducing agent for dry silver. Such a combination of reducing agents still requires as high a temperature as 121 to 138° C. (250 to 280° F.) in order to produce high contrast images.

In the prior art photothermographic recording materials, polyethylene terephthalate (PET) film is commonly used as a support. The PET film is characterized by toughness, low moisture absorption and transparency. When heat development is carried out on a photothermographic recording material having a PET film support at a temperature of about 120° C., the PET film undergoes shrinkage at a factor of more than about 0.1% although the exact shrinkage factor depends on manufacturing conditions of the PET film. Shrinkage of this order gives rise to no problem in prior art photothermographic recording materials because images produced therein are of low contrast.

One of technical problems encountered in the dry processing of a printing plate manufacturing system is to enhance the contrast of images. One solution to this problem is proposed in the above-referred U.S. Pat. No. 5,496,695. Since sharp dot images with a high black density were obtained due to achievement of super-high contrast, a possibility to use the photothermographic material as an intermediate material for the production of printed matter of quality was expected. In particular, the photothermographic material was desired to comply with a new printing plate technique of fabricating a high precision, high density screen. However, a serious problem was found. A false setting of color registration in color printing which remained less prominent in prior art photothermographic materials became so prominent that the printed matter appeared unacceptable. Thermal shrinkage largely differs between longitudinal and transverse directions of film and depending on the thermal hysteresis after manufacture, that is, thermal shrinkage is not constant. If four plates of Y, M, C and B are fabricated from sharp dot, super-high contrast photothermographic material, then a visually perceivable false setting of color registration can occur with conventional PET film.

A new support substitute for the conventional PET film support is thus desired for super-high contrast photothermographic material.

The above-mentioned image forming processes are characterized by heat development at a high temperature of 120° C. or higher and suffer from several problems associated with formation of high contrast images. A first problem is noise known as pepper fog occurring when hydrazines are used. While black pepper is a phenomenon well known for conventional wet development using hydrazines, pepper fog occurring in a dry photothermographic system is considerably different from the black pepper of the wet development system in that the occurrence of pepper fog largely depends on heat development temperature and becomes more frequent at higher temperature. A second problem is a development variation. Particularly when a dot image is produced, the percent dot area irregularly varies within a single sheet of film. A third problem is that heat development causes a plastic film support to irregularly deform, losing flatness. These problems are serious as an intermediate material for the manufacture of printing plates. It is desired to solve these problems.

It is also desired to improve the storage stability and feed of such photothermographic material.

As a photosensitive material having high sensitivity, Dmax and contrast, we invented a photothermographic material comprising an organic silver salt, silver halide, developing agent and hydrazine derivative as claimed in Japanese Patent Application No. 228627/1995. This material has high sensitivity, Dmax and contrast enough to apply to printing photosensitive material. However, when it is desired to output images of more than 175 lines/inch so as to comply with the high precision printing technique which is increasingly demanded in the recent years, the support undergoes shrinkage or expansion by the heat during heat development, resulting in a false setting of color registration. Then the material can not be used in color printing application.

A system containing an organic silver salt, silver halide and developing agent, but free of hydrazine does not find use in high precision color printing application because of poor dot quality. The shrinkage of the support by heat development has never been considered a problem.

As compared with wet photosensitive material, photothermographic material using an organic solvent is extremely weak to external forces as by scratching because the adhesion between a coating and a support is poor. By selecting a binder or adding an adhesion modifier, the adhesion can be improved, but to a less extent. No effective measure for improving such adhesion is available.

In the printing field, ultrahigh photographic properties are desired. For example, U.S. Pat. No. 5,496,695 proposes to use hydrazine derivatives to accomplish ultrahigh properties. The use of hydrazine derivatives, however, gives rise to an image enlargement phenomenon that images are thickened due to infectious development, adversely affecting image reproducibility. An improvement in this regard is desired.

SUMMARY OF THE INVENTION

A primary object of the present invention is to provide a photothermographic material featuring super-high contrast, high Dmax, and sufficiently high dimensional stability to avoid a false setting of color registration.

Another object of the present invention is to provide a photothermographic material capable of forming ultrahigh contrast images having high Dmax and uniformity without pepper fog and thus suitable for use in the manufacture of printing plates.

A further object of the present invention is to provide a photothermographic material having improved shelf stability and ease of feed and capable of forming a ultrahigh contrast image with high Dmax and high contrast of toe gradation.

A still further object of the invention is to provide a photothermographic material having a support which experiences minimal shrinkage or expansion upon heat development and firmly adheres to an overlying layer and producing images with high contrast of toe gradation and high Dmax.

A still further object of the invention is to provide a printing photosensitive material having mar resistance and producing images of quality without a false setting of color registration.

A still further object of the invention is to provide a fully dry processable printing photosensitive material which can comply with color printing and high precision printing.

A still further object of the invention is to provide a photothermographic material featuring ultrahigh contrast and image reproducibility and suitable for use in the manufacture of printing plates.

According to the present invention, there is provided a photothermographic material comprising a support and a photosensitive layer disposed on the support and containing an organic silver salt, a photosensitive silver halide, a reducing agent, and a ultrahigh contrast promoting agent. The support is a plastic film having a glass transition temperature of at least 90° C.

The photothermographic material may further include a polymer layer containing at least one of a conductive metal oxide and a conductive high molecular weight compound. Preferably the polymer layer is disposed on the same surface of the support as the photosensitive layer or on the opposite surface of the support to the photosensitive layer. Also preferably, the polymer layer is an outermost layer on at least one surface of the support.

The photothermographic material may further include an outermost layer on either surface of the support, at least one of the outermost layers having a Bekk smoothness of up to 4,000 seconds.

The photothermographic material may further include a back layer on the opposite surface of the support to the photosensitive layer, the back layer on its outer surface having a Bekk smoothness of up to 4,000 seconds.

In a further preferred embodiment, the support experiences a dimensional change of up to 0.04% when heated at 115° C. for 30 seconds. To meet this requirement, the support has been heat treated at a temperature in the range of 80 to 200° C. The heat treatment is done while the support is fed under a tension of up to 13 kg/cm$^2$. In this embodiment, the photosensitive layer is coated directly on the support.

The photothermographic material may further contain a nucleation promoter. The nucleation promoter is preferably of the general formula (A-1), (A-2), (A-3) or (A-4) which will be shown later.

DETAILED DESCRIPTION OF THE INVENTION

The present invention is directed to a photothermographic material having a photosensitive layer disposed on a support. The photosensitive layer contains an organic silver salt, a photosensitive silver halide, a reducing agent, and a ultrahigh contrast promoting agent.

The ultrahigh contrast promoting agent used herein is described in detail. The ultrahigh contrast promoting agent is an agent which does not function as a developing agent when used alone, but cooperates with a reducing agent as a developing agent to form a ultrahigh contrast image. Therefore, the concept, function and result of a ultrahigh contrast promoting agent are different from a mere combination of reducing agents.

Often the ultrahigh contrast promoting agent is selected from hydrazine derivatives and compounds containing a quaternary nitrogen atom. When two or more compounds are used, they are used in admixture.

Hydrazine derivatives useful as the ultrahigh contrast promoting agent are of the following general formula (I).

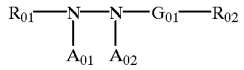

(I)

In formula (I), $R_{01}$ is an aliphatic, aromatic or heterocyclic group. $R_{02}$ is a hydrogen atom, alkyl, aryl, unsaturated heterocyclic, alkoxy, aryloxy, amino or hydrazino group. $G_{01}$ is a group represented by:

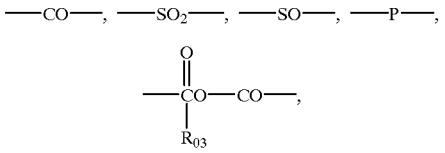

or a thiocarbonyl or iminomethylene group. $A_{01}$ and $A_{02}$ are both hydrogen atoms, or one of $A_{01}$ and $A_{02}$ is a hydrogen atom and the other is a substituted or unsubstituted alkylsulfonyl group, substituted or unsubstituted arylsulfonyl group or substituted or unsubstituted acyl group. $R_{03}$ is a group selected from the same range as defined for $R_{02}$ and may be identical with or different from $R_{02}$.

In formula (I), the aliphatic groups represented by $R_{01}$ are preferably those having 1 to 30 carbon atoms, especially normal, branched or cyclic alkyl groups having 1 to 20 carbon atoms. The branched alkyl group may be cyclized so as to form a saturated heterocyclic containing one or more hetero atoms. The alkyl group may have a substituent.

In formula (I), the aromatic groups represented by $R_{01}$ are preferably monocyclic or dicyclic aryl groups. The heterocyclic group represented by $R_{01}$ may be fused to a monocyclic or dicyclic aryl group to form a heteroaryl group. Exemplary are monovalent groups derived from benzene, naphthalene, pyridine, pyrimidine, imidazole, pyrazole, quinoline, isoquinoline, benzimidazole, thiazole, and benzothiazole rings. Groups containing a benzene ring are preferred. Aryl is the most preferred group of $R_{01}$.

The aliphatic, aromatic or heterocyclic group represented by $R_{01}$ may have a substituent. Exemplary substituents include an alkyl group, alkenyl group, alkynyl group, aryl group, heterocyclic-containing group, pyridinium group, hydroxy group, alkoxy group, aryloxy group, acyloxy group, alkyl or arylsulfonyloxy group, amino group, carbonamide group, sulfonamide group, ureido group, thioureido group, semicarbazide group, thiosemicarbazide group, urethane group, hydrazide structure-bearing group, quaternary ammonium structure-bearing group, alkyl or arylthio group, alkyl or arylsulfonyl group, alkyl or arylsulfinyl group, carboxyl group, sulfo group, acyl group, alkoxy or aryloxycarbonyl group, carbamoyl group, sulfamoyl group, halogen atom, cyano group, nitro group, nitrosyl group, phosphoric acid amide group, diacylamino group, imide group, acyl urea structure-bearing group, selenium or tellurium atom-containing group, and tertiary or quaternary sulfonium structure-bearing group. Desired among these groups are normal, branched or cyclic alkyl groups preferably having 1 to 20 carbon atoms, aralkyl groups, especially monocyclic or dicyclic aralkyl groups whose alkyl moiety has 1 to 3 carbon atoms, alkoxy groups preferably having 1 to 20 carbon atoms, substituted amino groups, especially amino groups having an alkyl substituent of 1 to 20 carbon atoms, acylamino groups preferably having 2 to 30 carbon atoms, sulfonamide groups preferably having 1 to 30 carbon atoms, ureido groups preferably having 1 to 30 carbon atoms, and phosphoric acid amide groups preferably having 1 to 30 carbon atoms.

In formula (I), the alkyl groups represented by $R_{02}$ are preferably those having 1 to 4 carbon atoms, and the aryl groups are preferably monocyclic or dicyclic aryl groups, for example, a benzene ring-containing group.

The heterocyclic groups represented by $R_{02}$ are preferably 5 or 6-membered rings containing at least one of nitrogen, oxygen and sulfur atoms, for example, imidazolyl, pyrazolyl, triazolyl, tetrazolyl, pyridyl, pyridinium, quinolinium, and quinolinyl groups, with the pyridyl and pyridinium groups being especially preferred.

The alkoxy groups represented by $R_{02}$ are preferably those having 1 to 8 carbon atoms, the aryloxy groups are preferably monocyclic, the amino groups are preferably unsubstituted amino, alkylamino groups having 1 to 10 carbon atoms, and arylamino groups having up to 10 carbon atoms.

The groups represented by $R_{02}$ may be substituted ones while preferred substituents are as exemplified for the substituent on $R_{01}$.

Where $G_{01}$ is a —CO— group, the preferred groups represented by $R_{02}$ are a hydrogen atom, alkyl groups (e.g., methyl, trifluoromethyl, 3-hydroxypropyl, 3-methanesulfonamidopropyl, and phenylsulfonylmethyl), aralkyl groups (e.g., o-hydroxybenzyl), aryl groups (e.g., phenyl, 3,5-dichlorophenyl, o-methanesulfonamidophenyl, 4-methanesulfonylphenyl, and 2-hydroxymethylphenyl), and $—C_2F_4COOM$ wherein M is a hydrogen atom or alkali metal atom.

Where $G_{01}$ is a $—SO_2—$ group, the preferred groups represented by $R_{02}$ are alkyl groups (e.g., methyl), aralkyl groups (e.g., o-hydroxybenzyl), aryl groups (e.g., phenyl), and substituted amino groups (e.g., dimethylamino).

Where $G_{01}$ is a —COCO— group, the preferred groups represented by $R_{02}$ are alkoxy, aryloxy, and amino groups.

In formula (I), $G_{01}$ is preferably a —CO— or —COCO— group, most preferably a —CO— group.

$R_{02}$ may be such a group as to induce cyclization reaction to cleave a $G_{01}$-$R_{02}$ moiety from the remaining molecule to generate a cyclic structure containing the atoms of the $—G_{01}—R_{02}$ moiety. Such examples are described in JP-A 29751/1988, for example.

Hydrazine derivatives having at least one nitro or nitrosyl group in $R_{01}$ or $R_{02}$ are preferred. Hydrazine derivatives having at least one nitro or nitrosyl group in $R_{01}$ are especially preferred.

In formula (I), each of $A_{01}$ and $A_{02}$ is a hydrogen atom, or a substituted or unsubstituted alkyl or arylsulfonyl group having up to 20 carbon atoms (preferably a phenylsulfonyl group or a phenylsulfonyl group substituted such that the sum of Hammette's substituent constants may be −0.5 or more), or substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxyl group and sulfonate group).

Most preferably, both $A_{01}$ and $A_{02}$ are hydrogen atoms.

The substituent on $R_{01}$ and $R_{02}$ may be further substituted, with preferred examples of the further substituent being those groups exemplified as the substituent on $R_{01}$. The further substituent, in turn, may be further substituted, the still further substituent, in turn, may be further substituted, and so on. In this way, multiple substitution is acceptable while preferred substituents are those groups exemplified as the substituent on $R_{01}$.

$R_{01}$ and $R_{02}$ in formula (I) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R_{01}$ and $R_{02}$ in formula (I) may have incorporated therein a group for enhancing adsorption to the surface of silver halide grains. Such adsorptive groups include alkylthio, arylthio, thiourea, heterocyclic thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988.

Among the hydrazine derivatives represented by the general formula (I), compounds of the following general formulae (II), (III), (IV), and (V) are preferred.

general formula (II)

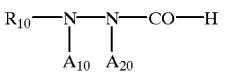

-continued general formula (III)

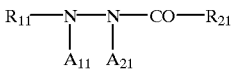

general formula (IV)

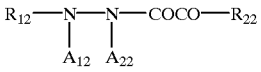

general formula (V)

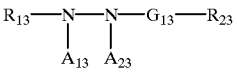

In these formulae, $R_{10}$, $R_{11}$, $R_{12}$, $R_{13}$ each are an aromatic group or heterocyclic group; and $A_{10}$, $A_{20}$, $A_{11}$, $A_{21}$, $A_{12}$, $A_{22}$, $A_{13}$, and $A_{23}$ are as defined for $A_{01}$ and $A_{02}$ in formula (I).

In formula (III), $R_{21}$ is an alkyl group having at least one electron attractive substituent, an aryl group having at least one electron attractive substituent, or a heterocyclic, amino, alkylamino, arylamino, heterocyclic amino, hydrazino, alkoxy or aryloxy group.

In formula (IV), $R_{22}$ is an amino, alkylamino, arylamino, heterocyclic amino, hydrazino, alkoxy, aryloxy, alkyl or aryl group.

In formula (V), $G_{13}$ is a group: —$SO_2$—, —SO— or —P(=O)(—$R_{30}$)— wherein $R_{30}$ is as defined for $R_{03}$ in formula (I), thiocarbonyl or iminomethylene group; and $R_{23}$ is an alkyl, aryl, alkoxy, aryloxy, amino, alkylamino, arylamino, heterocyclic amino or hydrazino group.

Further preferred among the compounds of the general formula (II) are those of the following general formula (II-1).

general formula (II-1)

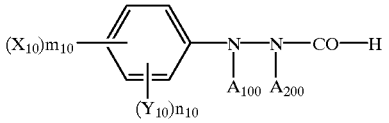

In formula (II-1), $X_{10}$ is a sulfonamide, ureido, thioureido, oxycarbonyl, sulfonamide, phosphonamide, alkylamino, halogen atom, cyano, alkoxy having at least 2 carbon atoms in total, aryloxy, alkylthio, arylthio, heterocyclic thio, acylamino having at least 3 carbon atoms in total, carbamoyl, sulfamoyl or alkyl or arylsulfonyl group; $m_{10}$ is an integer of 0 to 5; $Y_{10}$ is a group as defined for $X_{10}$ or a nitro, methoxy, alkyl or acetamide group; $n_{10}$ is an integer of 0 to 4; with the proviso that the sum of $m_{10}$ and $n_{10}$ does not exceed 5, and either one of $A_{100}$ and $A_{200}$ is not hydrogen where $m_{10}$ is equal to 0. $A_{100}$ and $A_{200}$ are as defined for $A_{01}$ and $A_{02}$ in formula (I). Preferably $m_{10}$ is 1 or 2 and $n_{10}$ is 0 or 1. Most preferably $m_{10}$ is 1 and $n_{10}$ is 0.

In formula (III), $R_{21}$ is preferably an alkyl group having at least one electron attractive substituent or an aryl group having at least one electron attractive substituent. The electron attractive group designates a substituent having a positive value of Hammette's substituent constant $\sigma_m$, for example, halogen atoms, nitro, cyano, acyl, oxycarbonyl, sulfonamide, sulfamoyl, carbamoyl, acyloxy, alkyl or arylsulfonyl, alkoxy, aryloxy, alkyl or arylthio, and imide groups. More preferably $R_{21}$ is an alkyl group having at least one electron attractive substituent, which is desirably a fluorine atom, alkoxy or aryloxy group.

In formula (IV), $R_{22}$ is preferably an amino, alkylamino, arylamino, heterocyclic amino or alkoxy group.

In formula (V), $G_{13}$ is preferably —$SO_2$—, —P(=O)(—$R_{30}$)— wherein $R_{30}$ is as defined for $R_{03}$ in formula (I) or thiocarbonyl. $R_{23}$ is preferably alkyl or aryl where $G_{13}$ is —$SO_2$—; alkoxy, aryloxy, alkyl or arylamino where $G_{13}$ is —P(=O)(—$R_{30}$)—; and alkylamino, arylamino or hydrazino group where $G_{13}$ is thiocarbonyl.

Among these, the compounds of the general formula (III) are especially preferred.

Illustrative, non-limiting, examples of the hydrazine compound are given below.

I-1

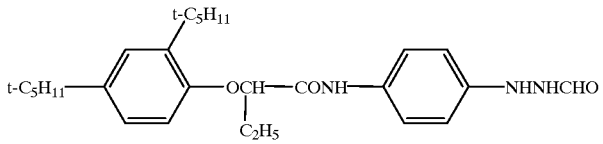

I-2

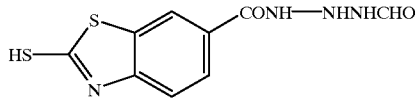

I-3

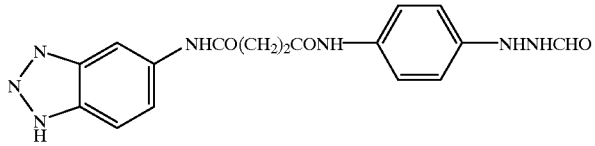

-continued
I-4
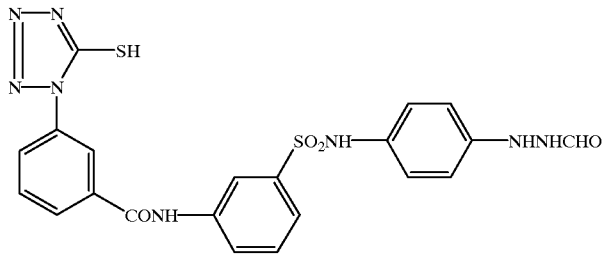
I-5
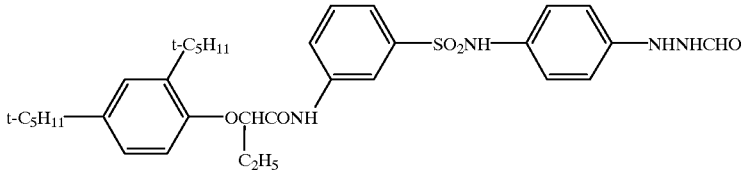
I-6
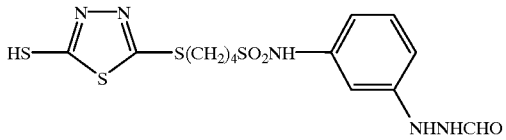
I-7
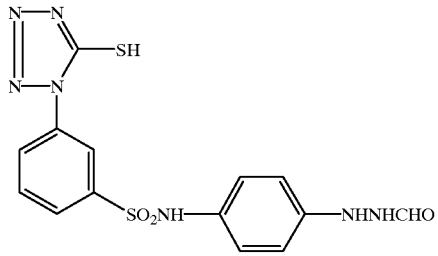
I-8
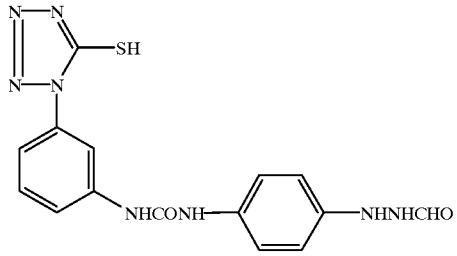
I-9
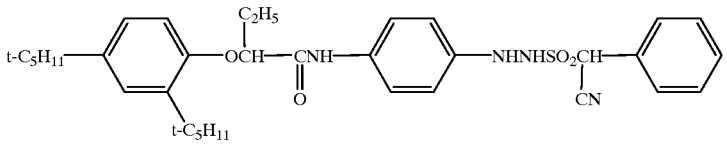
I-10
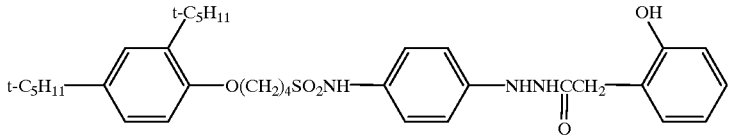

-continued
I-11
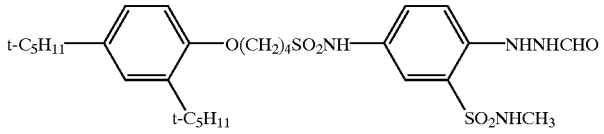
I-12
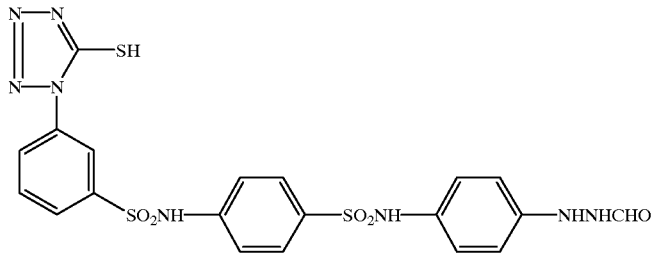
I-13
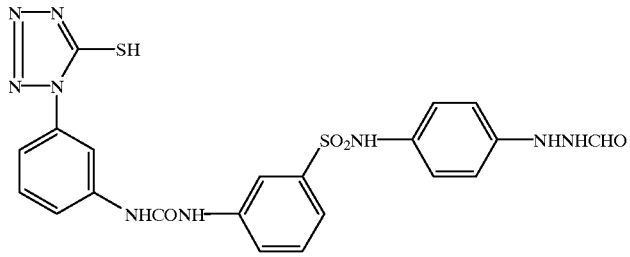
I-14
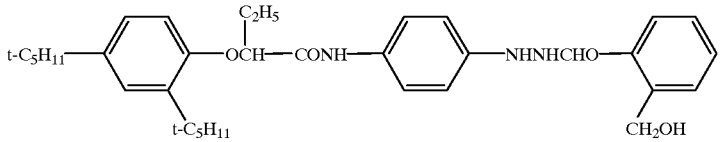
I-15
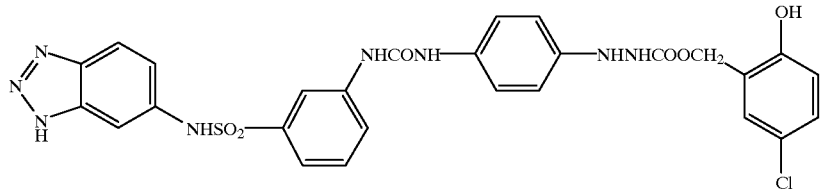
I-16
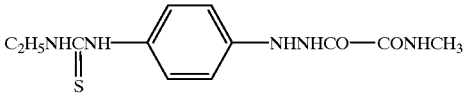
I-17
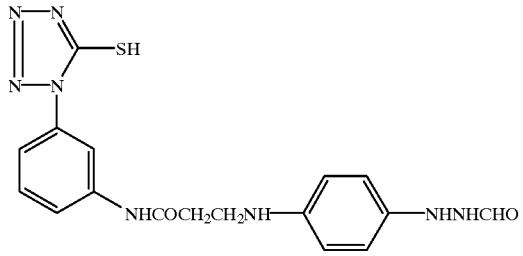

-continued
I-18
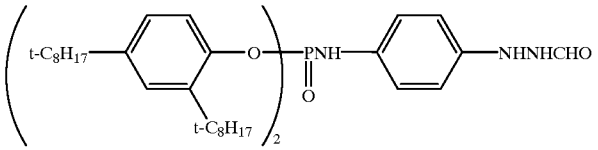
I-19
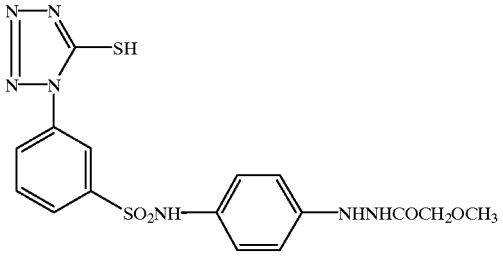
I-20
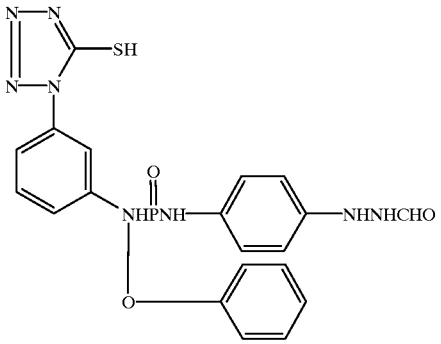
I-21
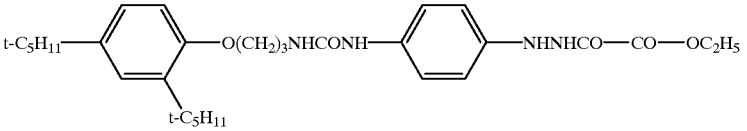
I-22
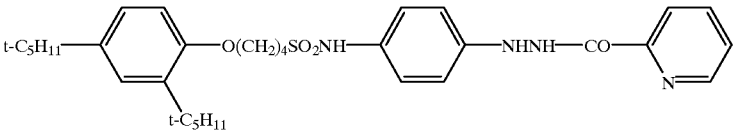
I-23
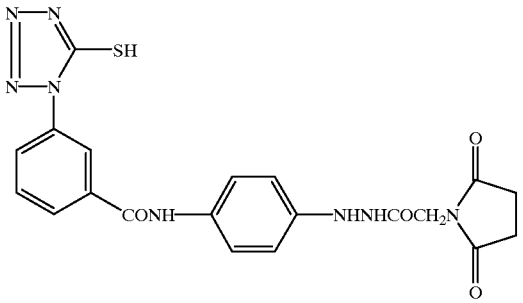
I-24
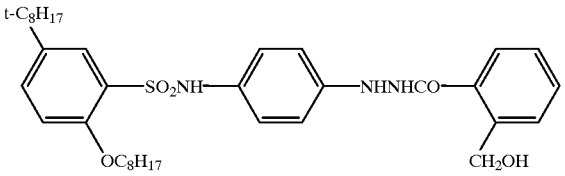

-continued
I-25
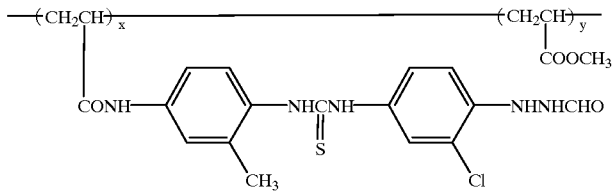
x : y = 3 : 97
average molecular weight
~100,000
I-26
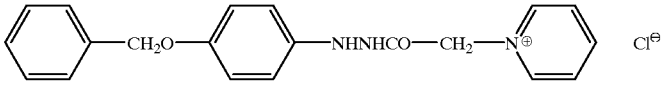
I-27
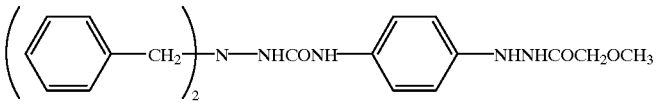
I-28
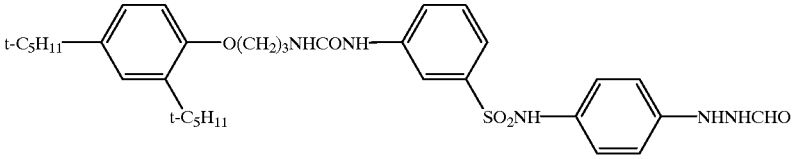
I-29
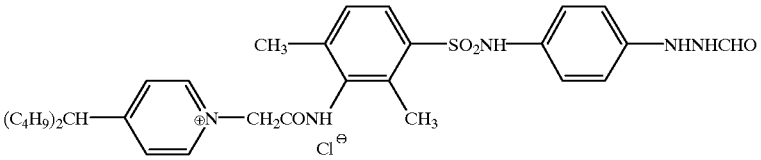
I-30
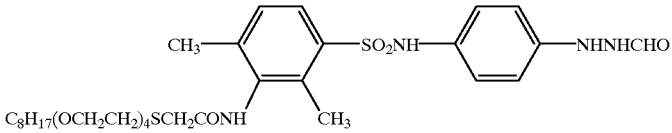
I-31
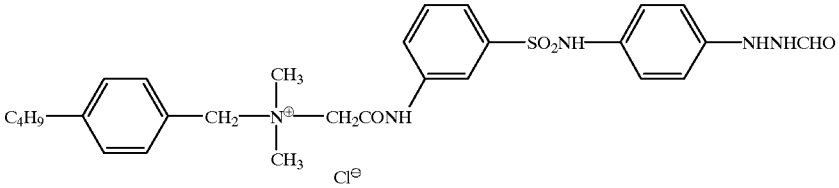
I-32
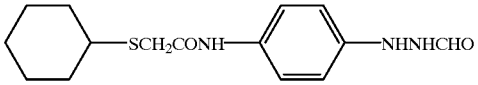

-continued
I-33
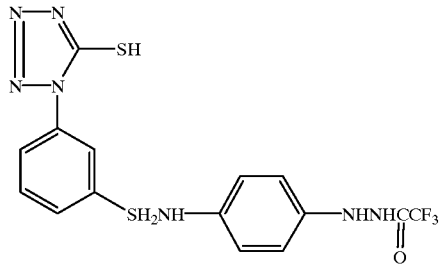
I-34
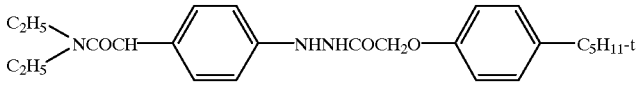
I-35
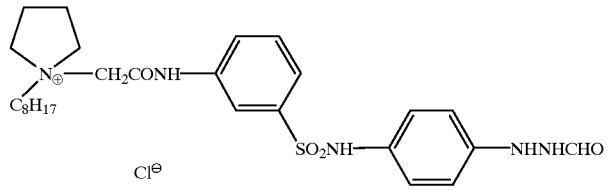
I-36
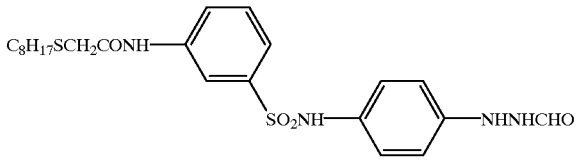
I-37
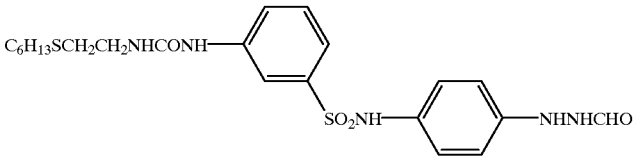
I-38
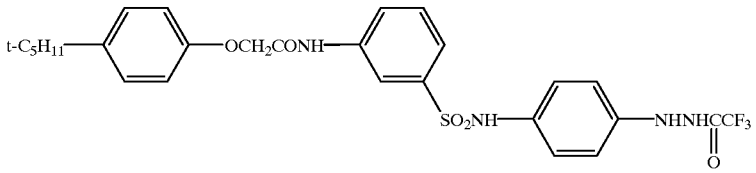
I-39
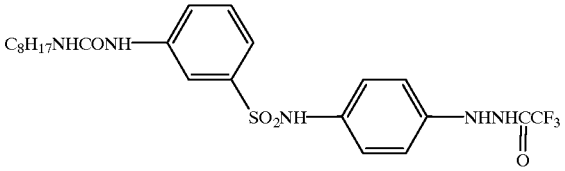
I-40
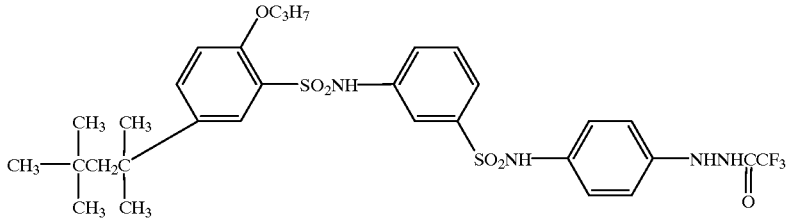

-continued
I-41
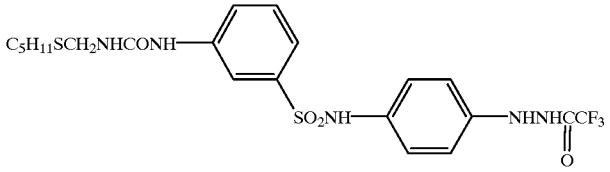
I-42
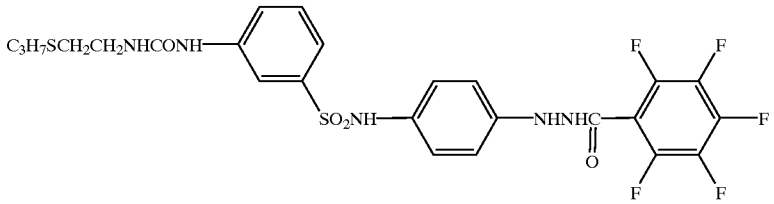
I-43
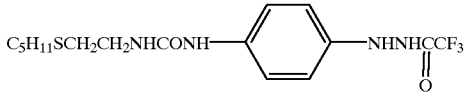
I-44
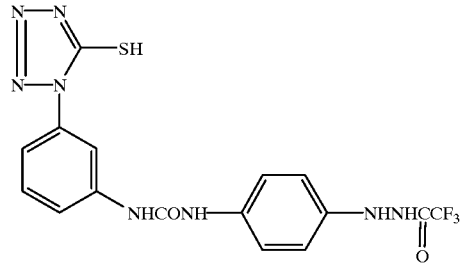
I-45
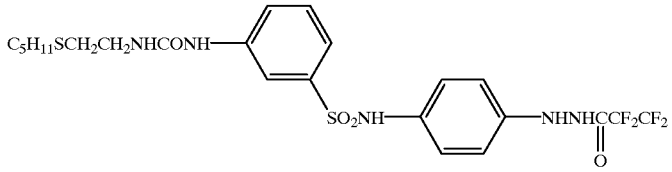
I-46
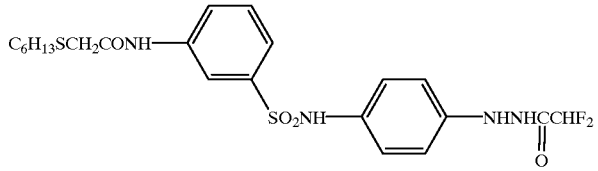
I-47
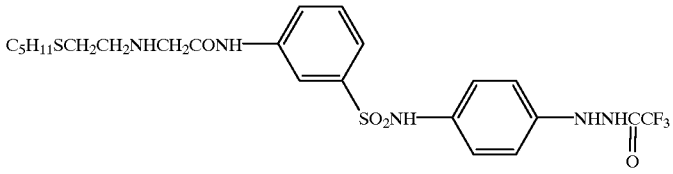
I-48
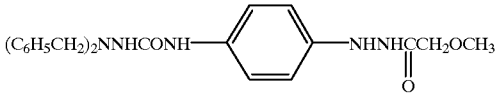

-continued
I-49
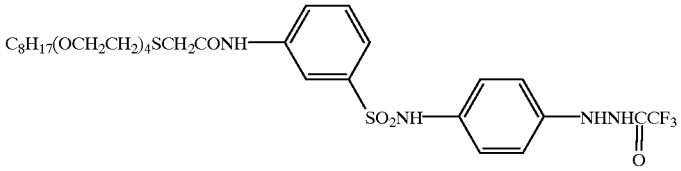
I-50
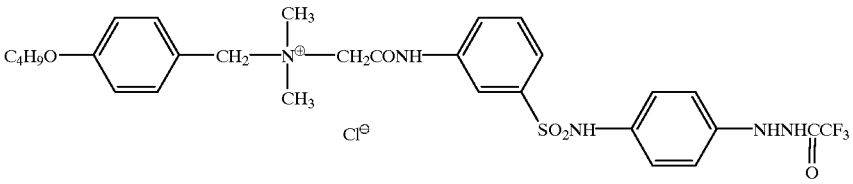
I-51
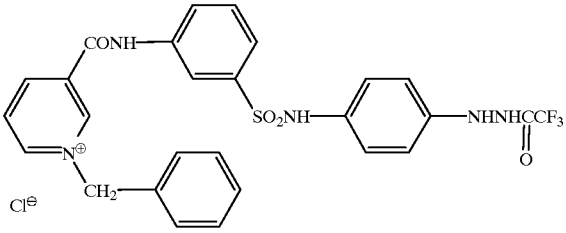
I-52
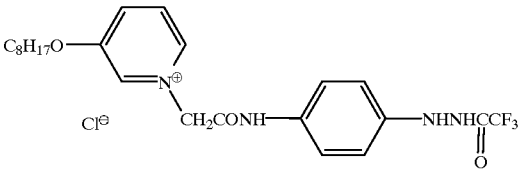
I-53
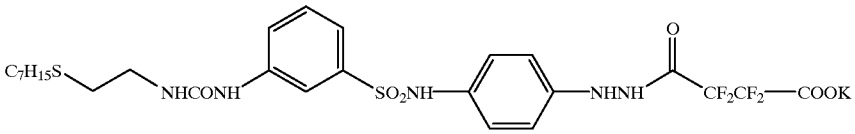
I-54
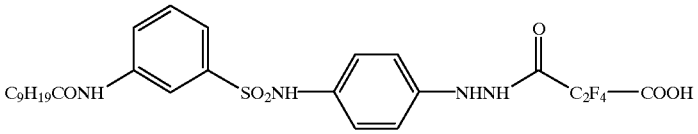
I-55
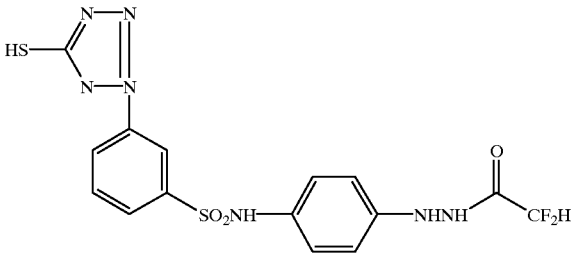
I-56
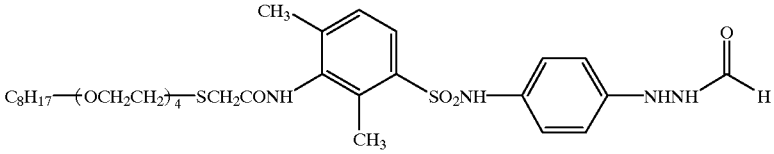

-continued
I-57
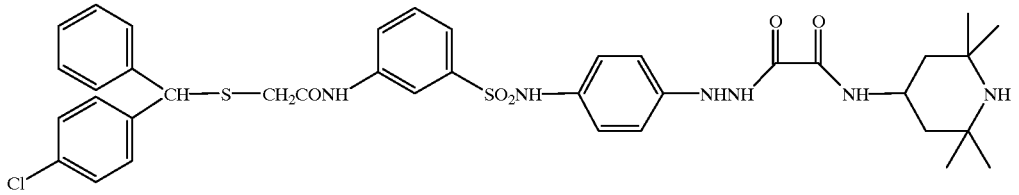
I-58
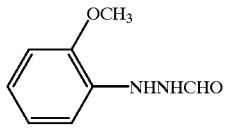
I-59
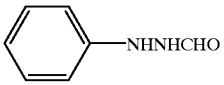
I-60
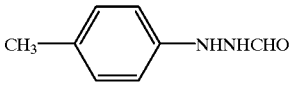
I-61
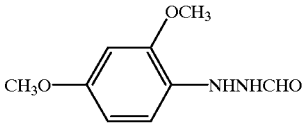
I-62
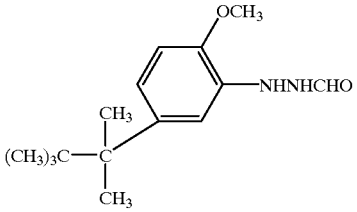
I-63
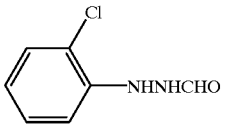
I-64
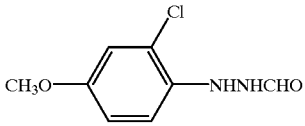
I-65
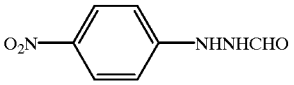
I-66
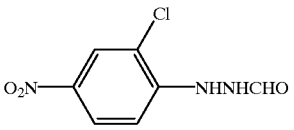

-continued
I-67
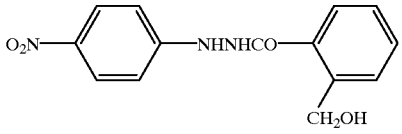
I-68
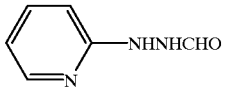
I-69
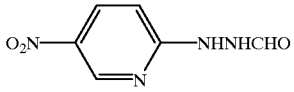
I-70
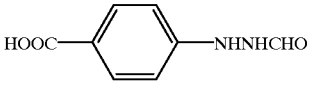
I-71
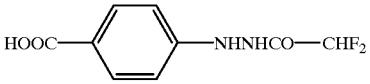
I-72
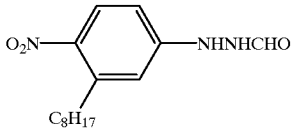
I-73
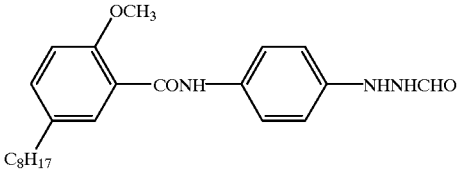
I-74
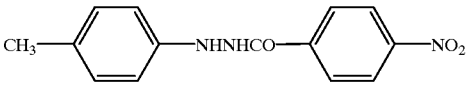
I-75
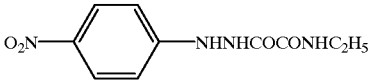
I-76
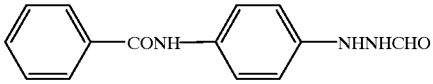
I-77
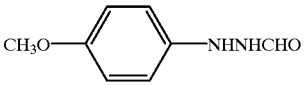
I-78
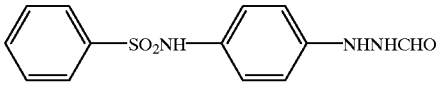

-continued

I-79

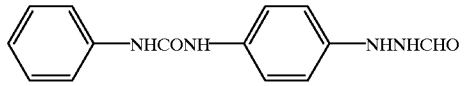

I-80

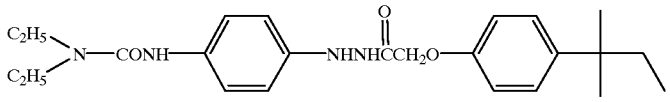

I-81

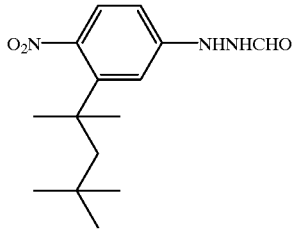

I-82

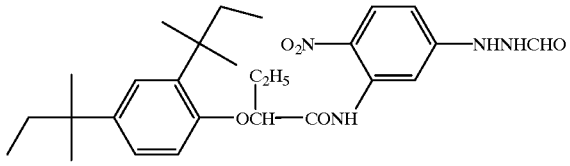

I-83

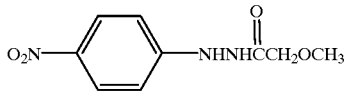

I-84

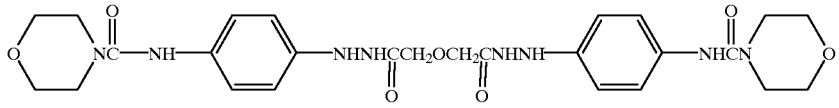

In addition to the above-mentioned examples, the hydrazine derivatives which can be used herein include those examples described in Research Disclosure, Item 23516 (November 1983, page 346), the references cited therein, and the following patents.

| | | | |
|---|---|---|---|
| USP | 4,080,207 | 4,269,929 | 4,276,364 |
| | 4,278,748 | 4,385,108 | 4,459,347 |
| | 4,478,928 | 4,560,638 | 4,686,167 |
| | 4,912,016 | 4,988,604 | 4,994,365 |
| | 5,041,355 | 5,104,769 | |
| UKP | 2,011,391B | | |
| EP | 217,310 | 301,799 | 356,898 |
| JP-A | 179734/1985 | 170733/1986 | 270744/1986 |
| | 178246/1987 | 270948/1987 | 29751/1988 |
| | 32538/1988 | 104047/1988 | 121838/1988 |
| | 129337/1988 | 223744/1988 | 234244/1988 |
| | 234245/1988 | 234246/1988 | 294552/1988 |
| | 306438/1988 | 10233/1989 | 90439/1989 |
| | 100530/1989 | 105941/1989 | 105943/1989 |
| | 276128/1989 | 280747/1989 | 283548/1989 |
| | 283549/1989 | 285940/1989 | 2541/1990 |
| | 77057/1990 | 139538/1990 | 196234/1990 |
| | 196235/1990 | 198440/1990 | 198441/1990 |
| | 198442/1990 | 220042/1990 | 221953/1990 |
| | 221954/1990 | 285342/1990 | 285343/1990 |
| | 289843/1990 | 302750/1990 | 304550/1990 |

-continued

| | | |
|---|---|---|
| 37642/1991 | 54549/1991 | 125134/1991 |
| 184039/1991 | 240036/1991 | 240037/1991 |
| 259240/1991 | 280038/1991 | 282536/1991 |
| 51143/1992 | 56842/1992 | 84134/1992 |
| 230233/1990 | 96053/1992 | 216544/1992 |
| 45761/1993 | 45762/1993 | 45763/1993 |
| 45764/1993 | 45765/1993 | |

Japanese Patent Application No. 94925/1993.

Besides, the following hydrazine derivatives are also useful. Exemplary compounds include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; and the compounds of the general formulae (H) and (Ha) in JP-A 104426/1995, more specifically compounds H-1 to H-44 described on pages 8 to 15 of the same.

The hydrazine derivative is preferably used in an amount of $1\times10^{-6}$ mol to $1\times10^{-1}$ mol, more preferably $1\times10^{-5}$ mol to $5\times10^{-2}$ mol per mol of total silver available from the organic silver salt and silver halide combined.

In the practice of the invention, the hydrazine derivative is used as a solution in a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

In the practice of the invention, an indazole, typically nitroindazole is preferably used as an antifoggant in combination with the hydrazine derivative.

In the photothermographic material of the invention, a nucleation promoter is preferably added in combination with the hydrazine derivative. The nucleation promoter used herein includes amine derivatives, onium salts, disulfide derivatives, and hydroxylamine derivatives. Examples of the nucleation promoter are compounds A-1 to A-47 described in Japanese Patent Application No. 266204/1995.

The other typical ultrahigh contrast promoting agent is a compound containing a quaternary nitrogen atom, which is generally selected from pyridinium compounds of the following formulae (Pa), (Pb) and (Pc), quinolinium compounds, and tetrazolium compounds of the formula (T) shown later. First, the pyridinium compounds are described.

(Pa)

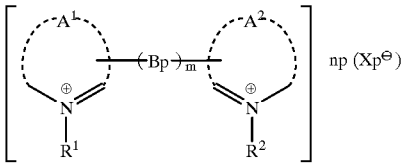

-continued (Pb)

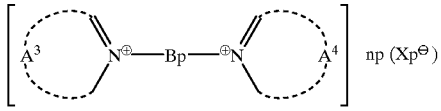

(Pc)

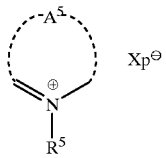

In formulae (Pa), (Pb) and (Pc), each of $A^1$, $A^2$, $A^3$, $A^4$, and $A^5$ is a group of non-metallic atoms necessary to complete a nitrogenous heterocyclic ring which may contain an oxygen, nitrogen or sulfur atom and have a benzene ring fused thereto. The heterocyclic ring formed by $A^1$, $A^2$, $A^3$, $A^4$ or $A^5$ may have a substituent which may be identical or different among $A^1$, $A^2$, $A^3$, $A^4$, and $A^5$. Exemplary substituents include alkyl, aryl, aralkyl, alkenyl, alkynyl, halogen, acyl, alkoxycarbonyl, aryloxycarbonyl, sulfo, carboxy, hydroxy, alkoxy, aryloxy, amide, sulfamoyl, carbamoyl, ureido, amino, sulfonamide, sulfonyl, cyano, nitro, mercapto, alkylthio, and arylthio groups. Preferred exemplary rings formed by $A^1$, $A^2$, $A^3$, $A^4$, and $A^5$ are five and six-membered rings such as pyridine, imidazole, thiozole, oxazole, pyrazine, and pyrimidine rings, with the pyridine ring being most preferred.

Bp is a divalent linking group which is selected from an alkylene group, arylene group, alkenylene group, —$SO_2$—, —SO—, —O—, —S—, —CO—, and —N($R^6$)— wherein $R^6$ is an alkyl group, aryl group or hydrogen atom, alone or in admixture. Preferably Bp is an alkylene or alkenylene group.

Each of $R^1$, $R^2$, and $R^5$ is an alkyl group having 1 to 20 carbon atoms. $R^1$ and $R^2$ may be the same or different. The alkyl group may be a substituted or unsubstituted one, with exemplary substituents being the same as those exemplified as the substituent on $A^1$, $A^2$, $A^3$, $A^4$, and $A^5$. Preferably, each of $R^1$, $R^2$, and $R^5$ is an alkyl group having 4 to 10 carbon atoms. More preferred are unsubstituted alkyl groups or aryl-substituted alkyl groups.

Xp is a counter ion necessary to provide an electric charge balance throughout the molecule, for example, a chloride, bromide, iodide, nitrate, sulfate, p-toluenesulfonate, and oxalate ion. Letter np represents a number of counter ions necessary to provide an electric charge balance throughout the molecule, with np=0 in the case of an intramolecular salt.

Illustrative, non-limiting, examples of the pyridinium compound which can be used herein are given below.

P-1
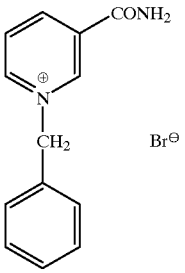
P-2
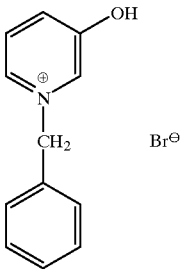
P-3
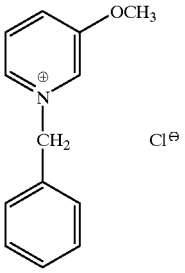
P-4
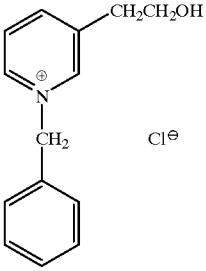
P-5
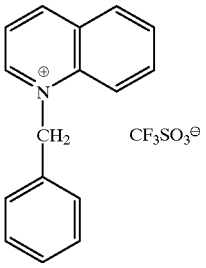
P-6
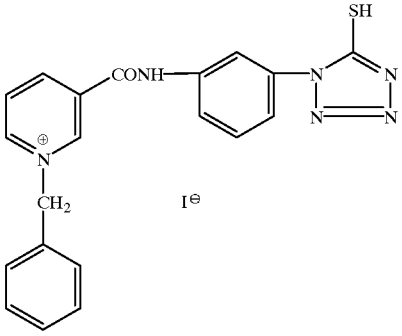
P-7
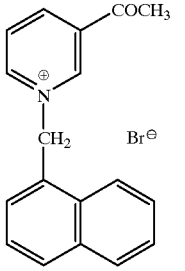
P-8
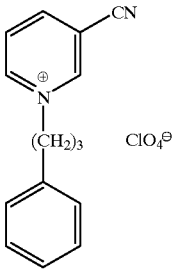
P-9
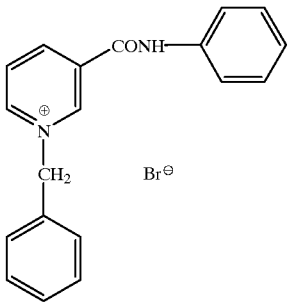
P-10
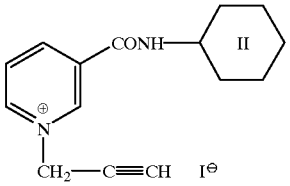

-continued
P-11
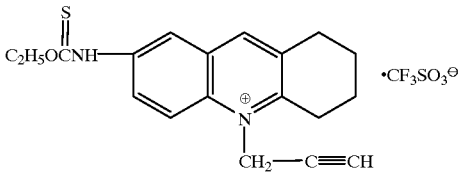
P-12
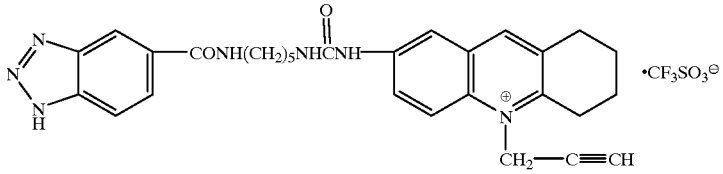
P-13
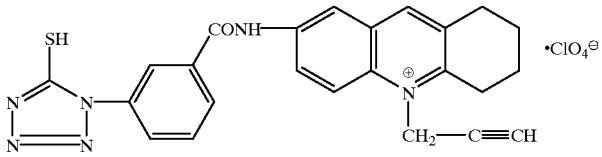
P-14
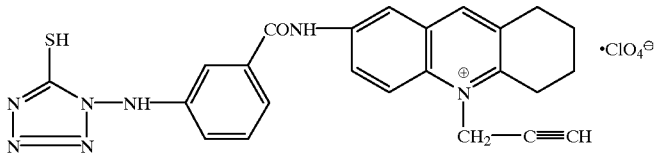
P-15
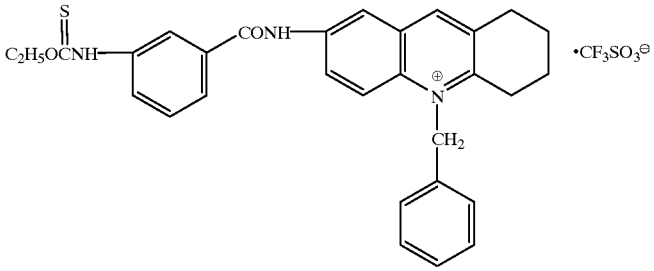
P-16
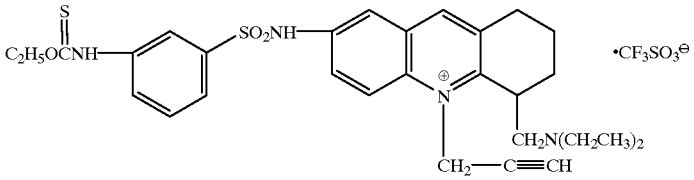
P-17
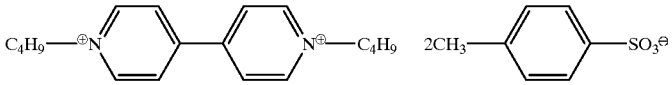
P-18
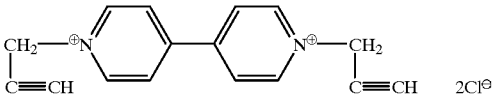

-continued

P-19

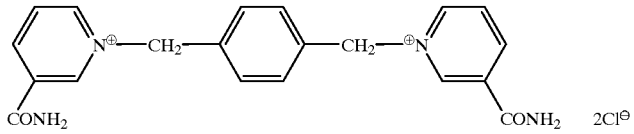

P-20

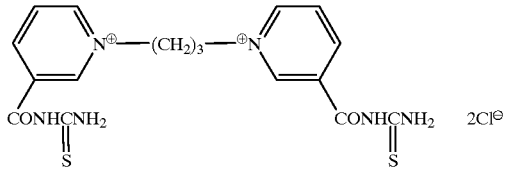

P-21

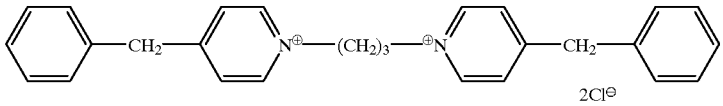

P-22

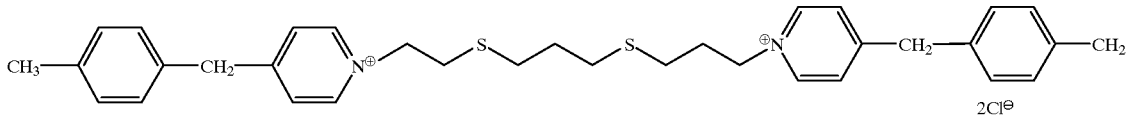

P-23

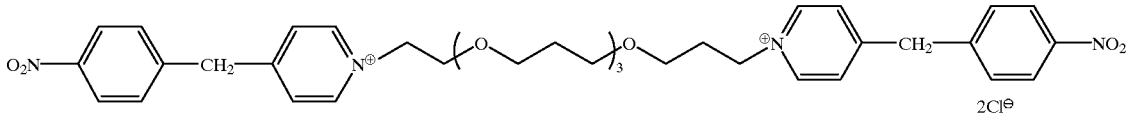

P-24

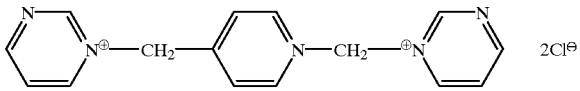

P-25

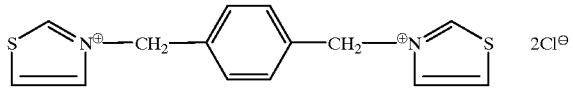

P-26

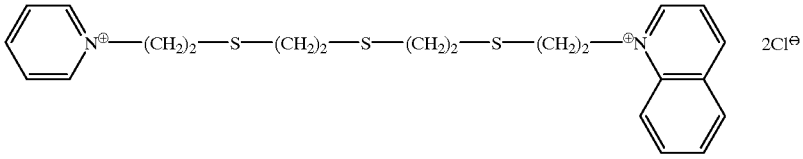

Another example of the compound containing a quaternary nitrogen atom is a triphenyltetrazolium compound of the following formula (T).

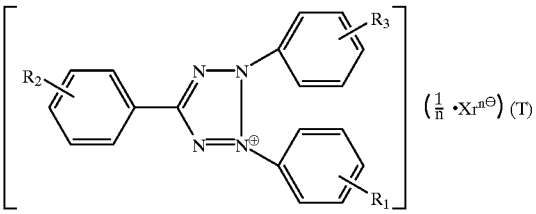

In formula (T), each of substituents $R_1$, $R_2$ and $R_3$ on the phenyl group is preferably a hydrogen atom or electron attractive group having a negative Hammette's sigma value ($\sigma_p$). Hammette's sigma value associated with phenyl substitution is found in the literature, for example, the article of C. Hansch et al. in Journal of Medical Chemistry, vol. 20, 304 (1977). Preferred groups having a negative Hammette's sigma value include methyl ($\sigma_p$=−0.17), ethyl (−0.15), cyclopropyl (−0.21), n-propyl (−0.13), isopropyl (−0.15), cyclobutyl (−0.15), n-butyl (−0.16), isobutyl (−0.20), n-pentyl (−0.15), cyclohexyl (−0.22), amino (−0.66), acetylamino (−0.15), hydroxyl (−0.37), methoxy (−0.27), ethoxy (−0.24), propoxy (−0.25), butoxy (−0.32), and pentoxy (−0.34). All these groups are useful as the substituent on the compound of formula (T).

Letter n is equal to 1 or 2. The anion represented by $Xr^{n-}$ includes, for example, halide ions such as chloride, bromide and iodide ions; residues of inorganic acids such as nitric acid, sulfuric acid and perchloric acid; residues of organic acids such as sulfonic acid and carboxylic acids; and anionic surfactants, for example, lower alkylbenzenesulfonate anions such as p-toluenesulfonate anion, higher alkylbenzenesulfonate anions such as p-dodecylbenzenesulfonate anion, highly alkyl sulfate anions such as lauryl sulfate anion, borate anions such as tetraphenylboron, dialkylsulfosuccinate anions such as di-2-ethylhexylsulfosuccinate anion, polyether alcohol sulfate anions such as cetyl polyethenoxysulfate anion, higher aliphatic anions such as stearate anion, and polymers with an acid residue attached such as polyacrylate anion.

Illustrative, non-limiting, examples of the tetrazolium compound of formula (T) are shown below using a combination of $R_1$, $R_2$, $R_3$, and $Xr^{n-}$.

| Compound No. | $R_1$ | $R_2$ | $R_3$ | $Xr^{n\ominus}$ |
|---|---|---|---|---|
| T-1 | H | H | p-$CH_3$ | $Cl^{\ominus}$ |
| T-2 | p-$CH_3$ | H | p-$CH_3$ | $Cl^{\ominus}$ |
| T-3 | p-$CH_3$ | p-$CH_3$ | p-$CH_3$ | $Cl^{\ominus}$ |
| T-4 | H | p-$CH_3$ | p-$CH_3$ | $Cl^{\ominus}$ |
| T-5 | p-$OCH_3$ | p-$CH_3$ | p-$CH_3$ | $Cl^{\ominus}$ |
| T-6 | p-$OCH_3$ | H | p-$CH_3$ | $Cl^{\ominus}$ |
| T-7 | p-$OCH_3$ | H | p-$OCH_3$ | $Cl^{\ominus}$ |
| T-8 | m-$C_2H_5$ | H | m-$C_2H_5$ | $Cl^{\ominus}$ |
| T-9 | p-$C_2H_5$ | p-$C_2H_5$ | p-$C_2H_5$ | $Cl^{\ominus}$ |
| T-10 | p-$C_3H_7$ | H | p-$C_3H_7$ | $Cl^{\ominus}$ |
| T-11 | p-iso$C_3H_7$ | H | p-iso$C_3H_7$ | $Cl^{\ominus}$ |
| T-12 | p-$OC_2H_5$ | H | p-$OC_2H_1$ | $Cl^{\ominus}$ |
| T-13 | P-$OCH_3$ | H | p-iso$C_3H_7$ | $Cl^{\ominus}$ |
| T-14 | H | H | p-n$C_{12}H_{25}$ | $Cl^{\ominus}$ |
| T-15 | p-n$C_{12}H_{25}$ | H | p-n$C_{12}H_{25}$ | $Cl^{\ominus}$ |
| T-16 | H | P-$NH_2$ | H | $Cl^{\ominus}$ |
| T-17 | p-$NH_2$ | H | H | $Cl^{\ominus}$ |
| T-18 | p-$CH_3$ | H | p-$CH_3$ | $ClO_4^{\ominus}$ |

The above-mentioned tetrazolium compounds can be readily synthesized according to the method described in Chemical Reviews, vol. 55, pages 335–483, for example. The tetrazolium compounds of formula (T) may be used alone or in admixture of two or more in any desired ratio.

The pyridinium and tetrazolium compounds which are used as the ultrahigh contrast promoting agent according to the invention may be used to any layer which is disposed on the same side of the support as the silver halide emulsion layer although they are preferably added to the silver halide emulsion layer or a layer disposed adjacent thereto. Although the optimum amount of the pyridinium or tetrazolium compound added varies with the size and composition of silver halide grains, degree of chemical sensitization and the type of inhibitor, the amount is preferably $10^{-6}$ mol to $10^{-1}$ mol, more preferably $10^{-5}$ mol to $10^{-2}$ mol per mol of silver halide as in the case of hydrazine derivatives.

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly greater amount of about 2 to 15% by weight of that layer.

For photothermographic materials using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

Especially preferred reducing agents used herein are those compounds of the following formulae (R-I), (R-II), (R-III), and (R-IV).

(R-I)

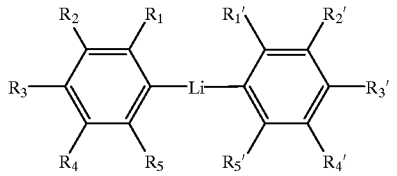

(R-II)

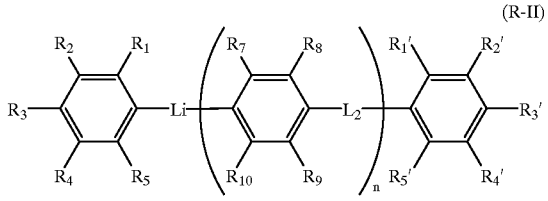

-continued (R-III)

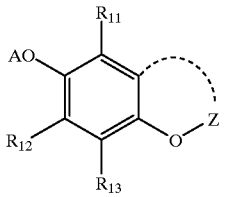

(R-IV)

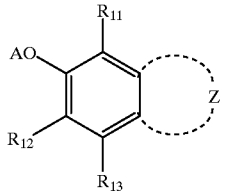

In formula (R-III), Z forms a cyclic structure represented by the following formula (Z-1) or (Z-2).

(Z-1)

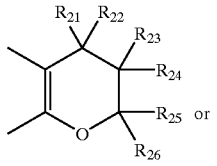

(Z-2)

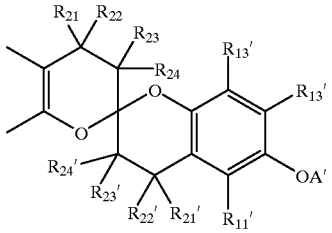

In formula (R-IV), Z forms a cyclic structure represented by the following formula (Z-3) or (Z-4).

(Z-3)

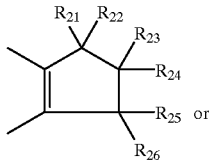

-continued (Z-4)

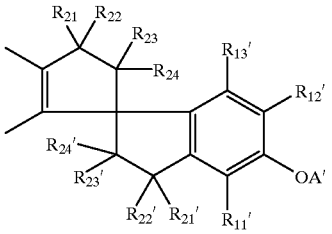

In formulae (R-I) and (R-II), each of $L_1$ and $L_2$ is a group CH—$R_6$ or a sulfur atom, and n is a natural number.

Herein, R is used as a representative of $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$. R is a hydrogen atom, alkyl group having 1 to 30 carbon atoms, aryl group, aralkyl group, halogen atom, amino group or a substituent represented by —O—A, with the proviso that at least one of $R_1$ to $R_5$, at least one of $R_1'$ to $R_5'$, and at least one of $R_7$ to $R_{10}$ each are a group represented by —O—A. Alternatively, R groups, taken together, may form a ring. A and A' each are a hydrogen atom, alkyl group having 1 to 30 carbon atoms, acyl group having 1 to 30 carbon atoms, aryl group, phosphate group or sulfonyl group. R, A and A' may be substituted groups while typical examples of the substituent include an alkyl group (including active methine groups), nitro group, alkenyl group, alkynyl group, aryl group, heterocyclic ring-containing group, group containing a quaternized nitrogen atom-containing heterocyclic ring (e.g., pyridinio group), hydroxyl group, alkoxy group (including a group containing recurring ethyleneoxy or propyleneoxy units), aryloxy group, acyloxy group, acyl group, alkoxycarbonyl group, aryloxycarbonyl group, carbamoyl group, urethane group, carboxyl group, imido group, amino group, carbonamide group, sulfonamide group, ureido group, thioureido group, sulfamoylamino group, semicarbazide group, thiosemicarbazide group, hydrazino-containing group, quaternary ammonio-containing group, mercapto group, (alkyl, aryl or heterocyclic)thio group, (alkyl or aryl)sulfonyl group, (alkyl or aryl)sulfinyl group, sulfo group, sulfamoyl group, acylsulfamoyl group, (alkyl or aryl)sulfonylureido group, (alkyl or aryl)sulfonylcarbamoyl group, halogen atom, cyano group, phosphoric acid amide group, phosphate structure-containing group, acylurea structure-bearing group, selenium or tellurium atom-containing group, and tertiary or quaternary sulfonium structure-bearing group. The substituent on R, A and A' may be further substituted, with preferred examples of the further substituent being those groups exemplified as the substituent on R. The further substituent, in turn, may be further substituted, the still further substituent, in turn, may be further substituted, and so on. In this way, multiple substitution is acceptable while preferred substituents are those groups exemplified as the substituent on R, A and A'.

Illustrative, non-limiting, examples of the compounds represented by formulae (R-I), (R-II), (R-III) and (R-IV) are given below.

TABLE 1

| No. | $R_1$, $R_{1'}$ | $R_2$, $R_{2'}$ | $R_3$, $R_{3'}$ | $R_4$, $R_{4'}$ | $R_5$, $R_{5'}$ | $L_1$ | $R_6$ |
|---|---|---|---|---|---|---|---|
| R-I-1 | —OH | —$CH_3$ | —H | —$CH_3$ | —H | CH—R6 | —H |
| R-I-2 | —OH | —$CH_3$ | —H | —$CH_3$ | —H | CH—R6 | —$CH_3$ |
| R-I-3 | —OH | —$CH_3$ | —H | —$CH_3$ | —H | CH—R6 | —$C_3H_7$ |
| R-I-4 | —OH | —$CH_3$ | —H | —$CH_3$ | —H | CH—R6 | —$C_5H_{11}$ |
| R-I-5 | —OH | —$CH_3$ | —H | —$CH_3$ | —H | CH—R6 | -TMB |
| R-I-6 | —OH | —$CH_3$ | —H | —$CH_3$ | —H | CH—R6 | —$C_9H_{19}$ |
| R-I-7 | —OH | —$CH_3$ | —H | —$CH_3$ | —H | S | — |

TABLE 1-continued

| No. | $R_1$, $R_{1'}$ | $R_2$, $R_{2'}$ | $R_3$, $R_{3'}$ | $R_4$, $R_{4'}$ | $R_5$, $R_{5'}$ | $L_1$ | $R_6$ |
|---|---|---|---|---|---|---|---|
| R-I-8 | —OH | —$CH_3$ | —H | —$C_2H_5$ | —H | S | — |
| R-I-9 | —OH | —$CH_3$ | —H | —$C_4H_9$(t) | —H | S | — |
| R-I-10 | —OH | —$C_4H_9$(t) | —H | —$CH_3$ | —H | CH—R6 | —H |
| R-I-11 | —OH | —$C_4H_9$(t) | —H | —$CH_3$ | —H | CH—R6 | —$CH_3$ |
| R-I-12 | —OH | —$C_4H_9$(t) | —H | —$CH_3$ | —H | CH—R6 | -TMB |
| R-I-13 | —OH | —$C_4H_9$(t) | —H | —$C_2H_5$ | —H | CH—R6 | -Ph |
| R-I-14 | —OH | —CHex | —H | —$CH_3$ | —H | S | — |
| R-I-15 | —OH | —$C_4H_9$(t) | —H | —$C_2H_5$ | —H | S | — |
| R-I-16 | —OH | —$C_2H_5$ | —H | —$C_4H_9$(t) | —H | CH—R6 | —H |
| R-I-17 | —OH | —$C_2H_5$ | —H | —$C_4H_9$(t) | —H | CH—R6 | —$CH_3$ |
| R-I-18 | —OH | —$C_2H_5$ | —H | —$C_4H_9$(t) | —H | CH—R6 | -TMB |
| R-I-19 | —OH | —$CH_3$ | —H | —$C_4H_9$(t) | —H | CH—R6 | -Ph |
| R-I-20 | —OH | —$CH_3$ | —Cl | —$C_4H_9$(t) | —H | CH—R6 | —H |
| R-I-21 | —OH | —$CH_3$ | —H | —$C_4H_9$(t) | —$OCH_3$ | CH—R6 | —H |
| R-I-22 | —H | —$C_4H_9$(t) | —OH | —CPen | —H | CH—R6 | —H |
| R-I-23 | —H | —$C_4H_9$(t) | —OH | —$C_4H_9$(t) | —H | CH—R6 | -TMB |
| R-I-24 | —H | —$C_4H_9$(t) | —OH | —H | —H | CH—R6 | —H |
| R-I-25 | —H | —$C_4H_9$(t) | —OH | —H | —H | CH—R6 | —$C_3H_7$ |
| R-I-26 | —H | —$CH_3$ | —OH | —$C_4H_9$(t) | —H | CH—R6 | -TMB |
| R-I-27 | —H | —$C_2H_5$ | —OH | —$C_4H_9$(t) | —H | CH—R6 | —H |
| R-I-28 | —H | —$CH_3$ | —OH | —$C_2H_5$ | —H | CH—R6 | -TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |
| R-I-34 | —H | —$CH_3$ | —OH | —$C_4H_9$(t) | —H | S | — |
| R-I-35 | —H | —CHex | —OH | —$C_4H_9$(t) | —H | S | — |

TMB: 1,3,3-trimethylbutyl group
CPen: cyclopentyl group
CHex: cyclohexyl group
(R-I)

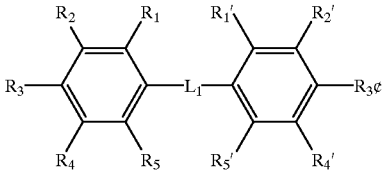

TABLE 2

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH—R6 | —H |
| R-I-37 | —OH | —$C_4H_9$(t) | —H | —$CH_3$ | —H | —H | —$CH_3$ | —OH | —$CH_3$ | —H | CH—R6 | —H |
| R-I-35 | —OH | —$CH_3$ | —H | —$CH_3$ | —H | —H | —CHex | —OH | —$CH_3$ | —H | CH—R6 | —$CH_3$ |
| R-I-39 | —OH | —$C_4H_9$(t) | —H | —$CH_3$ | —H | —H | —$CH_3$ | —OH | —$CH_3$ | —H | CH—R6 | —$CH_3$ |
| R-I-40 | —OH | —$CH_3$ | —H | —$CH_3$ | —H | —H | —$CH_3$ | —OH | —$CH_3$ | —H | CH—R6 | -TMB |
| R-I-41 | —OH | —$C_4H_9$(t) | —H | —$CH_3$ | —H | —H | —$CH_3$ | —OH | —$CH_3$ | —H | CH—R6 | -TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$(t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

CHex: cyclohexyl group
(R-I)

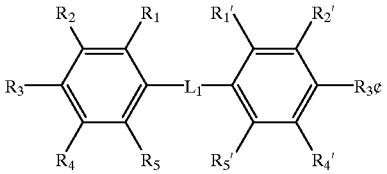

TABLE 3

| No. | $R_1$, $R_{1'}$ | $R_2$, $R_{2'}$ | $R_3$, $R_{3'}$ | $R_4$, $R_{4'}$ | $R_5$, $R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH—R6 | —H | CH—R6' | —$CH_3$ | 1 |
| R-II-2 | —OH | —$CH_3$ | —H | —$CH_3$ | —H | —OH | —$C_2H_5$ | —$CH_3$ | —H | CH—R6 | -TMB | CH—R6' | —$CH_3$ | 1 |
| R-II-3 | —OH | —$C_4H_9$(t) | —H | —$CH_3$ | —H | —OH | —$CH_3$ | —$CH_3$ | —H | CH—R6 | —H | CH—R6' | -TMB | 3 |
| R-II-4 | —OH | —$CH_3$ | —H | —$CH_3$ | —H | —OH | —$C_2H_5$ | —$CH_3$ | —H | CH—R6 | -TMB | CH—R6' | -TMB | 2 |
| R-II-5 | —H | —$C_4H_9$(t) | —OH | —$CH_3$ | —H | —OH | —$CH_3$ | —$CH_3$ | —H | S | — | CH—R6' | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH—R6' | -TMB | 3 |

(R-II)

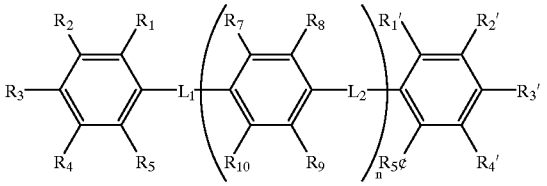

TABLE 4

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | -DHP | —H |

DHP: 2,4-dihydroxyphenyl group (R-III)

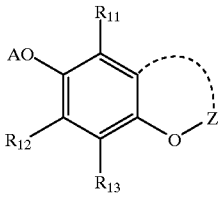

(Z-1)

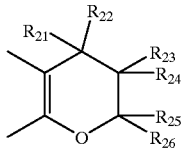

TABLE 5

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |

TABLE 5-continued

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

(R-III)

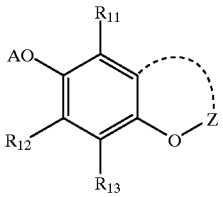

(Z-2)

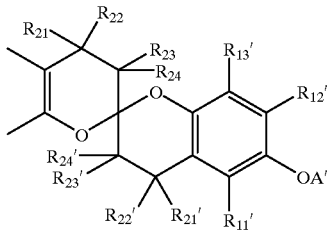

TABLE 6

| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

(R-IV)

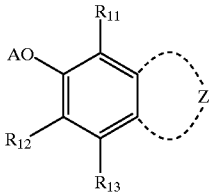

(Z-3)

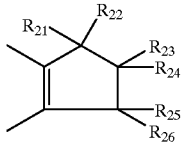

TABLE 7

| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

(R-IV)

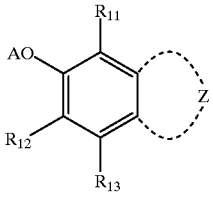

TABLE 7-continued
| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
(Z-4)
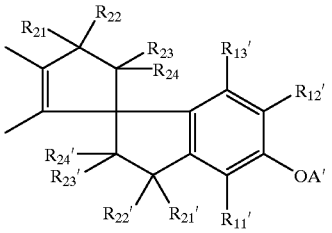
R-I-45
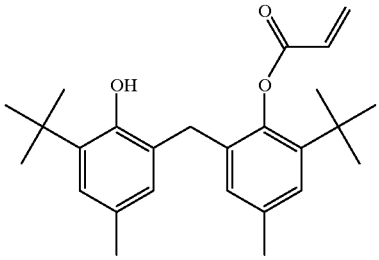
R-I-46
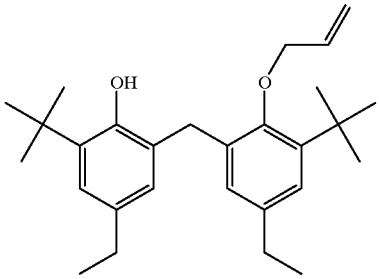
R-I-47
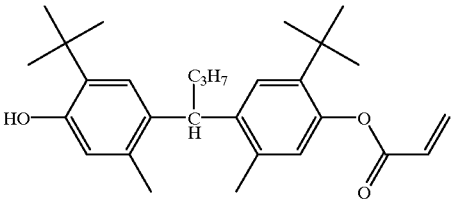
R-I-48
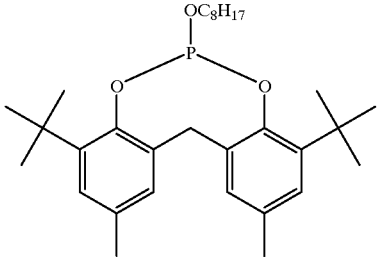
-continued
R-I-49
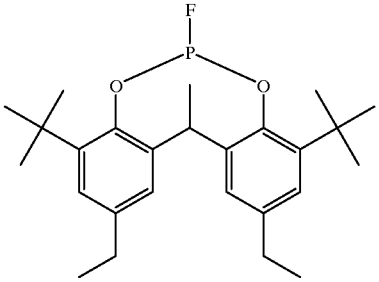
R-I-50
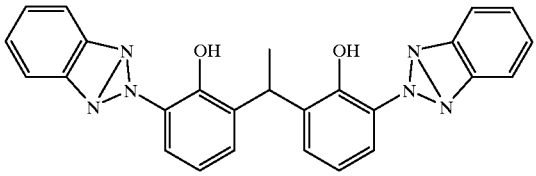
R-I-51
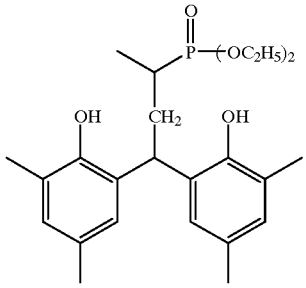
R-I-52
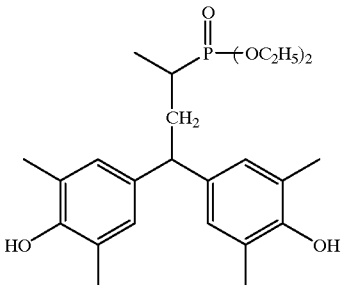

-continued

R-I-53

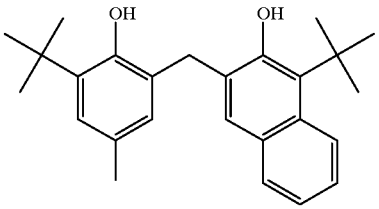

R-I-54

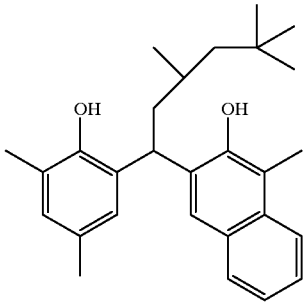

R-I-55

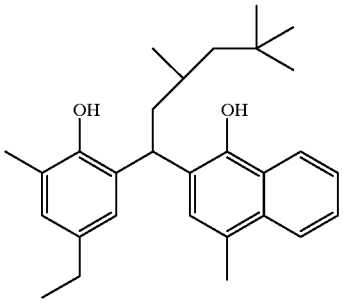

R-II-9

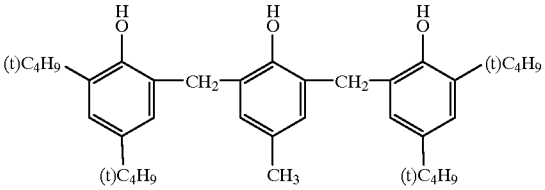

R-II-10

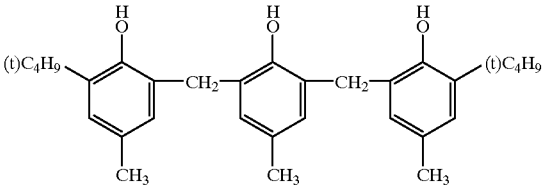

R-II-11

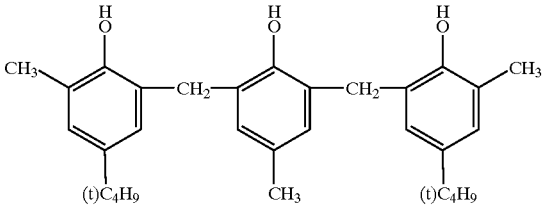

-continued

R-II-10

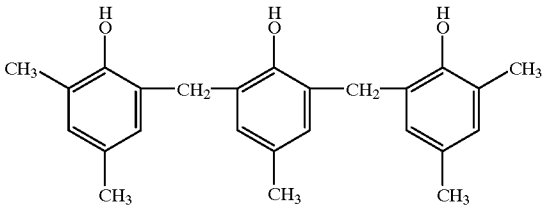

The reducing agent is preferably used in an amount of $1\times10^{-3}$ to 10 mol, more preferably $1\times10^{-2}$ to 1.5 mol per mol of silver. The reducing agent and the ultrahigh contrast promoting agent are preferably used in a molar ratio between $1:10^{-3}$ and $1:10^{-1}$.

In the practice of the invention, the reducing agent is used after it is dissolved in water or a water-miscible organic solvent such as methanol, ethanol, dimethylformamide, and acetonitrile.

A well-known emulsifying dispersion method is used for dissolving the reducing agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the reducing agent in powder form in water in a ball mill, colloidal mill or ultrasonic mixer. Also, the reducing agent may be contained in microparticulates of a polymer as described in JP-A 948/1990.

It is especially preferred to add the reducing agent by the solid dispersion method. Although the photosensitive layer having the reducing agent added in an amount of $1\times10^{-2}$ to 10 mol per mol of silver tends to lower its physical strength, such strength lowering is minimized when the reducing agent is added as a solid dispersion. For example, 1 to 50% by weight of the reducing agent is admixed with water with the aid of 1 to 30% by weight of the solids of a surfactant as a dispersant and the resulting water slurry is dispersed by a dispersing machine. It is desired to continue dispersion until a submicron dispersion having a mean particle size of up to 1 $\mu$m is obtained.

In a further preferred embodiment of the invention, the photothermographic material further contains a nucleation promoter which is an onium salt compound of the general formula (A-1), (A-2), (A-3) or (A-4).

First, the general formula (A-1) is described in detail.

(A-1)

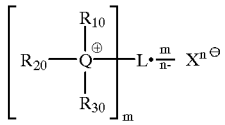

In formula (A-1), $R_{10}$, $R_{20}$ and $R_{30}$ are independently an alkyl, cycloalkyl, aralkyl, aryl, alkenyl, cycloalkenyl, alkynyl or heterocyclic group, which may have a substituent. Q is a nitrogen or phosphorus atom. L is a m-valent organic group attaching to $Q^+$ at its carbon atom, and m is an integer of 1 to 4. $X^{n-}$ is a n-valent counter anion, and n is an integer of 1 to 3, with the proviso that $X^{n-}$ does not exist where $R_{10}$, $R_{20}$, $R_{30}$ or L has an anionic group as a substituent to form an intramolecular salt with $Q^+$.

Examples of the group represented by $R_{10}$, $R_{20}$ and $R_{30}$ include normal or branched alkyl groups such as methyl, ethyl, propyl, isopropyl, butyl, isobutyl, sec-butyl, tert-butyl, octyl, 2-ethylhexyl, dodecyl, hexadecyl and octadecyl; aralkyl groups such as substituted or unsubstituted benzyl; cycloalkyl groups such as cyclopropyl, cyclopentyl and cyclohexyl; aryl groups such as phenyl, naphthyl, and phenanthryl; alkenyl groups such as allyl, vinyl and 5-hexenyl; cycloalkenyl groups such as cyclopentenyl and cyclohexenyl; alkynyl groups such as phenylethynyl; and heterocyclic groups such as pyridyl, quinolyl, furyl, imidazolyl, thiazoyl, thiadiazolyl, benzotriazolyl, benzothiazolyl, morpholyl, pyrimidyl, and pyrrolidyl.

Examples of the substituent on these groups include those groups as exemplified for $R_{10}$, $R_{20}$ and $R_{30}$; halogen atoms such as fluorine, chlorine, bromine and iodine, nitro, (alkyl or aryl)amino, alkoxy, aryloxy, (alkyl or aryl)thio, carbonamide, carbamoyl, sulfonamide, sulfamoyl, hydroxyl, sulfoxy, sulfonyl, carboxyl (inclusive of carboxylate), sulfonate (inclusive of sulfonato), cyano, oxycarbonyl and acyl groups.

Examples of the group represented by L in formula (A-1) include those groups as exemplified for $R_{10}$, $R_{20}$ and $R_{30}$ when m is 1. Examples of the group represented by L when m is an integer of 2 or more include polymethylene groups such as trimethylene, tetramethylene, hexamethylene, pentamethylene, octamethylene, and dodecamethylene; arylene groups such as phenylene, biphenylene and naphthylene; polyvalent alkylene groups such as trimethylenemethyl and tetramethylenemethyl; and polyvalent arylene groups such as phenylene-1,3,5-toluyl and phenylene-1,2,4,5-tetrayl.

Examples of the counter anion represented by $X^{n-}$ in formula (A-1) include halide ions such as chloride, bromide and iodide ions; carboxylate ions such as acetate, oxalate, fumarate and benzoate ions; sulfonate ions such as p-toluenesulfonate, methanesulfonate, butanesulfonate and benzenesulfonate ions; and sulfate, perchlorate, carbonate and nitrate ions.

In formula (A-1), $R_{10}$, $R_{20}$ and $R_{30}$ are preferably groups having up to 20 carbon atoms. $R_{10}$, $R_{20}$ and $R_{30}$ are preferably aryl groups having up to 15 carbon atoms when Q is a phosphorus atom, and alkyl, aralkyl and aryl groups having up to 15 carbon atoms when Q is a nitrogen atom. Letter m is preferably 1 or 2. When m is 1, L is preferably a group having up to 20 carbon atoms, especially an alkyl, aralkyl or aryl group having up to 15 carbon atoms in total. When m is 2, L represents a divalent organic group which is preferably an alkylene, arylene or aralkylene group or a divalent group formed by combining such a group with a —CO—, —O—, —N(NR')—, —S—, —SO—or —$SO_2$— group. It is noted that NR' is hydrogen or a group as defined for $R_{10}$, $R_{20}$ and $R_{30}$, and where more than one NR' group is present within a molecule, they may be identical or different or bonded together. Preferably, L is a divalent group having up to 20 carbon atoms in total and attaching to $Q^+$ at its carbon atom when m is 2. When m is an integer of 2 or more, a plurality of groups are present for each of $R_{10}$, $R_{20}$ and $R_{30}$ within a molecule while the plurality of groups may be identical or different.

The counter anion represented by $X^{n-}$ is preferably a halide, carboxylate, sulfonate or sulfate ion, and n is preferably 1 or 2.

Many of the compounds of the general formula (A-1) are well known in the art and commercially available as chemical reagents. They are generally synthesized, when Q is phosphorus, by reacting phosphinic acids with alkylating agents such as alkyl halides and sulfonic acid esters; or replacing counter anions of phosphonium salts in a conventional manner. When Q is nitrogen, the compounds are generally synthesized by reacting primary, secondary or tertiary amino compounds with alkylating agents such as alkyl halides and sulfonic acid esters.

Illustrative, non-limiting, examples of the compound of formula (A-1) are given below.

A-1

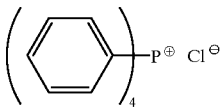

A-2

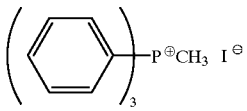

A-3

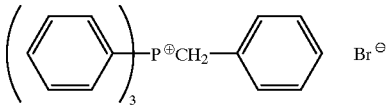

A-4

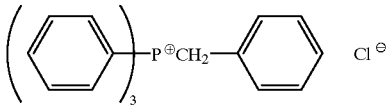

A-5

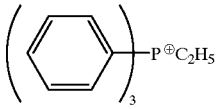

A-6

$(n\text{-}C_4H_9)_4P^{\oplus}\ Br^{\ominus}$

A-7

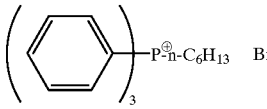

A-8

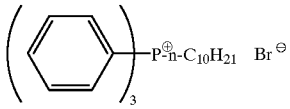

A-9

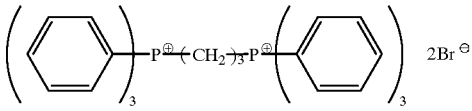

A-10

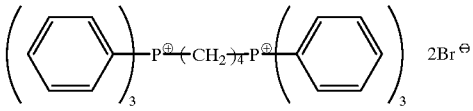

-continued
A-11
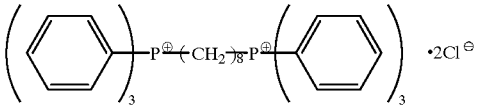
A-12
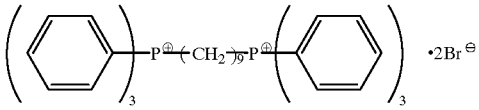
A-13
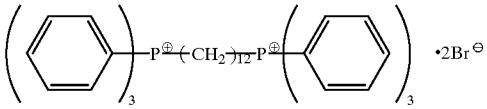
A-14
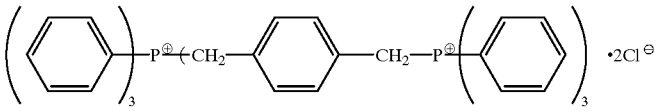
A-15
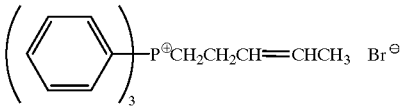
A-16
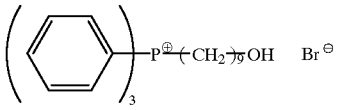
A-17
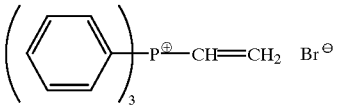
A-18
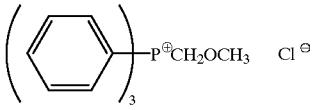
A-19
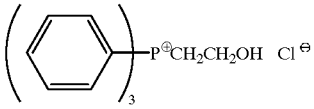
A-20
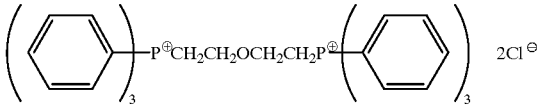
A-21
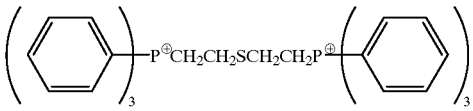
A-22
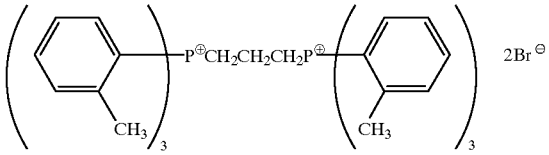
A-23
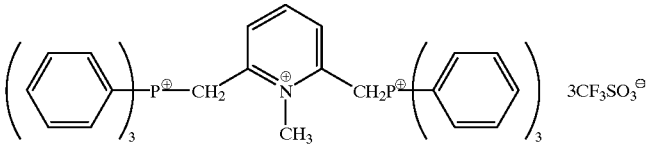
A-24
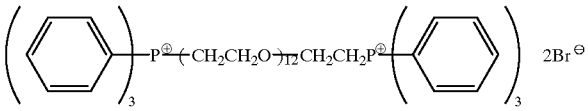
A-25
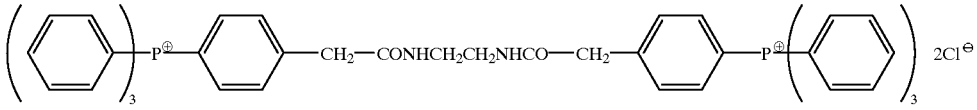
A-26
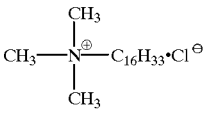
A-27
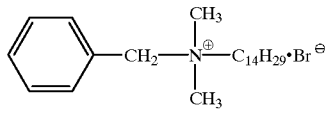

-continued
A-28
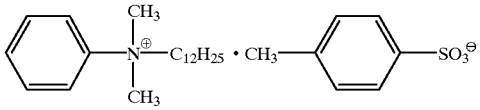
A-29
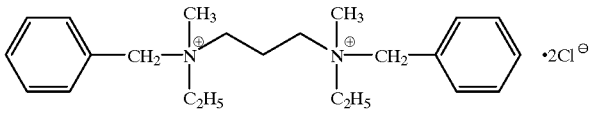
A-30
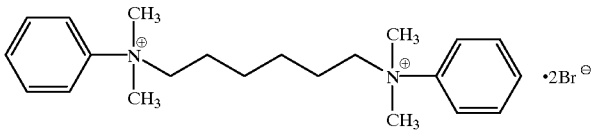
A-31
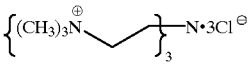
A-32
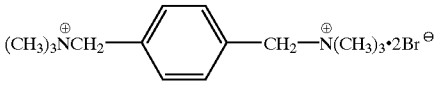
A-33
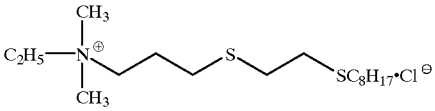
A-34
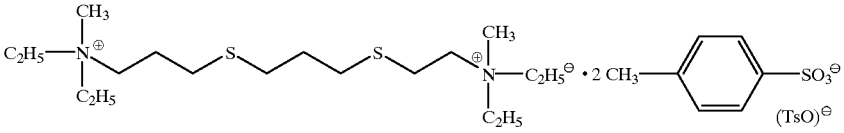
A-35
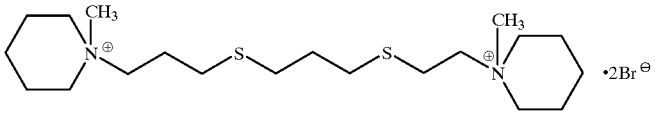
A-36
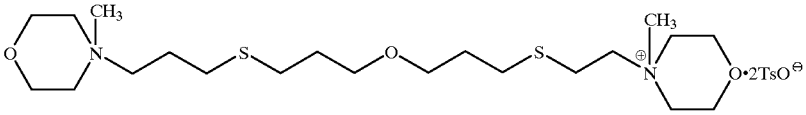
A-37
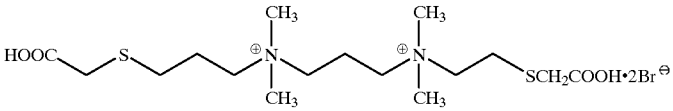
A-38
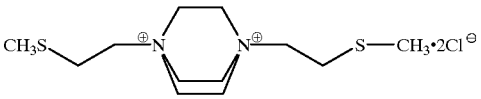
A-39
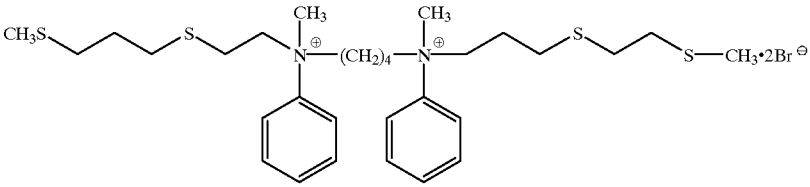

-continued

A-40

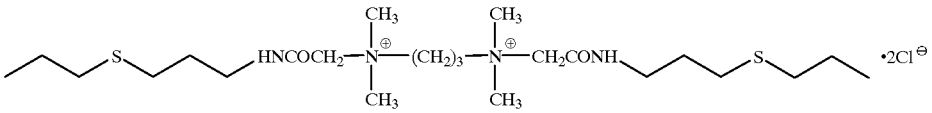

A-41

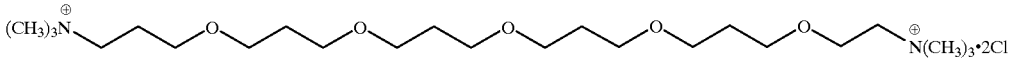

A-42

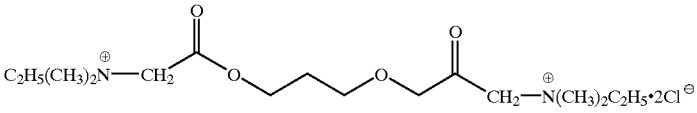

Next, the general formulae (A-2) and (A-3) are described in detail.

(A-2)

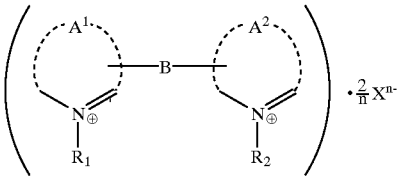

(A-3)

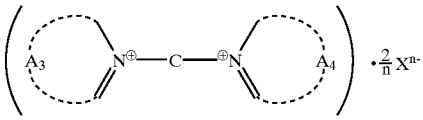

In formulae (A-2) and (A-3), each of $A_1$, $A_2$, $A_3$, and $A_4$ is an organic residue to complete a substituted or unsubstituted, unsaturated heterocyclic ring with the quaternized nitrogen atom, which may contain carbon, hydrogen, oxygen, nitrogen and sulfur atoms and may have a benzene ring fused thereto. Examples of the unsaturated heterocyclic ring formed by $A_1$, $A_2$, $A_3$, and $A_4$ include pyridine, quinoline, isoquinoline, imidazole, thiazole, thiadiazole, benzotriazole, benzothiazole, pyrimidine, and pyrazole rings, with the pyridine, quinoline and isoquinoline rings being preferred.

Each of B and C is a divalent linking group which is an alkylene, arylene, alkenylene, alkynylene, —$SO_2$—, —SO—, —O—, —S—, —N(RN)—, —C═O— or —P═O— alone or a combination thereof. It is noted that RN is hydrogen or an alkyl, aryl or aralkyl group. More preferably, each of B and C is an alkylene, arylene, —C═O—, —O—, —S—or —N(RN)— alone or a combination thereof.

Each of $R_1$ and $R_2$, which may be identical or different, is an alkyl or aralkyl group, preferably an alkyl group having 1 to 20 carbon atoms. The alkyl group may have a substituent, for example, halogen atoms (e.g., chlorine and bromine), substituted or unsubstituted alkyl (e.g., methyl and hydroxyethyl), substituted or unsubstituted aryl (e.g., phenyl, tolyl and p-chlorophenyl), substituted or unsubstituted acyl (e.g., benzoyl, p-bromobenzoyl and acetyl), (alkyl or aryl)oxycarbonyl, sulfo (inclusive of sulfonato), carboxy (inclusive of carboxylate), mercapto, hydroxy, alkoxy (e.g., methoxy and ethoxy), aryloxy, carbonamide, sulfonamide, sulfamoyl, carbamoyl, ureido, thioureido, (alkyl or aryl) amino, cyano, nitro, alkylthio, and arylthio groups. More preferably, each of $R_1$ and $R_2$ is an alkyl group having 1 to 10 carbon atoms, and preferred substituents are carbamoyl, oxycarbonyl, acyl, aryl, sulfo (inclusive of sulfonato), carboxy (inclusive of carboxylate) and hydroxy groups.

The unsaturated heterocyclic ring that each of $A_1$, $A_2$, $A_3$, and $A_4$ forms with the quaternized nitrogen atom may have a substituent which is selected from those groups exemplified as the substituent on the alkyl group of $R_1$ and $R_2$. Preferred substituents are aryl having 6 to 10 carbon atoms, alkyl, carbamoyl, (alkyl or aryl)amino, oxycarbonyl, alkoxy, aryloxy, (alkyl or aryl)thio, hydroxy, carbonamide, sulfonamide, sulfo (inclusive of sulfonate), and carboxy (inclusive of carboxylate) groups.

The counter anion represented by $X^{n-}$ is as defined in formula (A-1), with its preferred examples being the same.

The compounds of formulae (A-2) and (A-3) can be synthesized by well-known methods. Reference is made to Quart. Rev., 16, 163 (1962).

Illustrative, non-limiting, examples of the compounds of formulae (A-2) and (A-3) are given below.

B-1

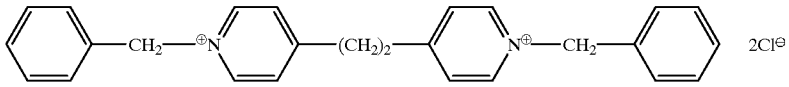

B-2

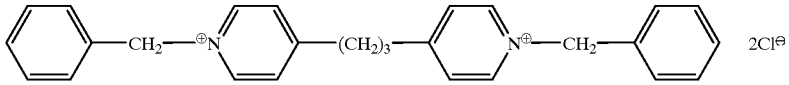

-continued
B-3
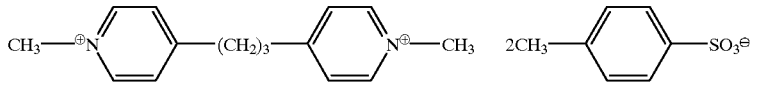
B-4
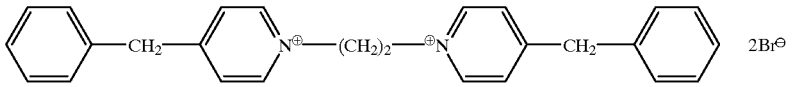
B-5
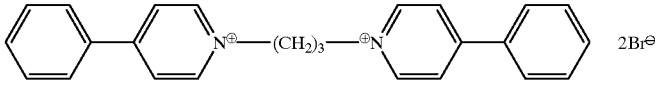
B-6
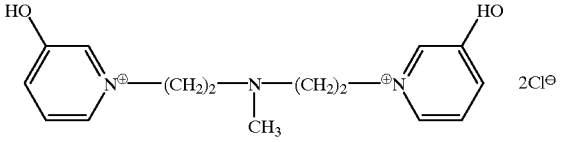
B-7
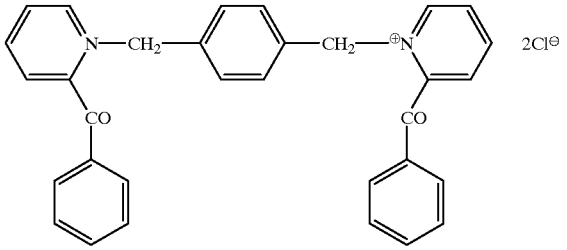
B-8
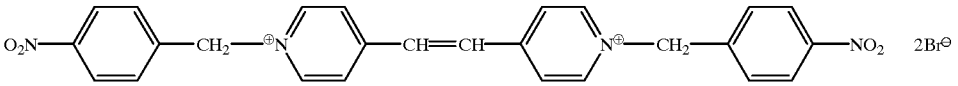
B-9
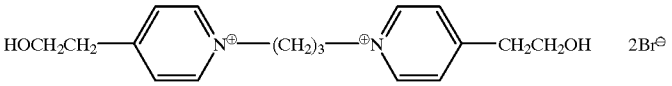
B-10
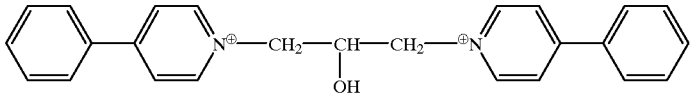
B-11
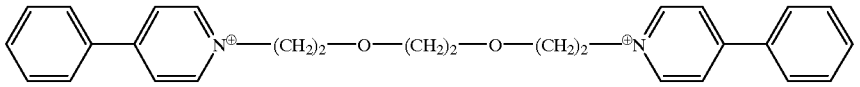
B-12
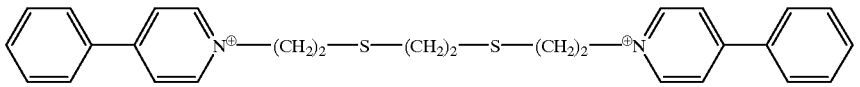
B-13
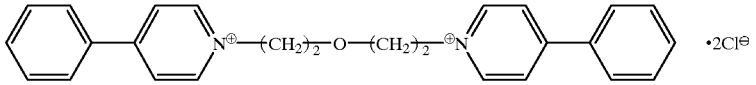
B-14
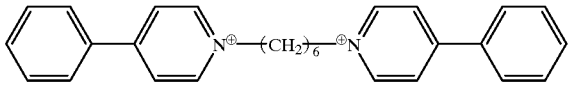

-continued
B-15
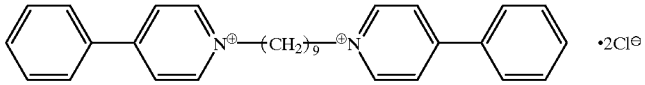
B-16
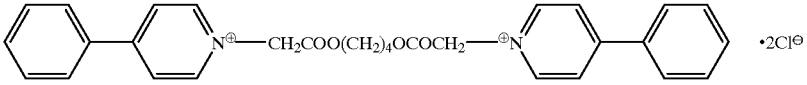
B-17
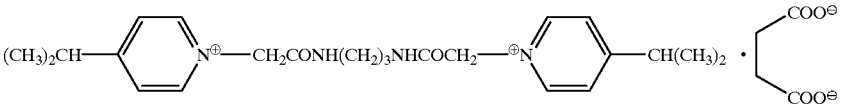
B-18
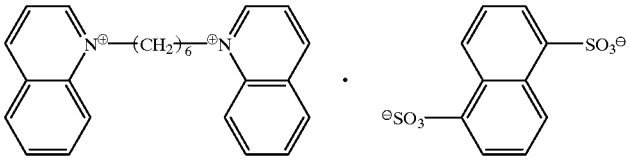
B-19
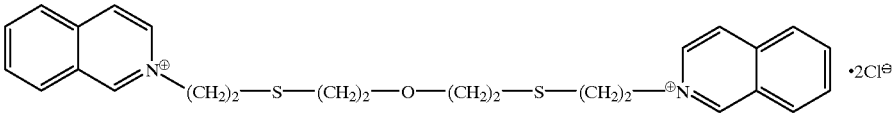
B-20
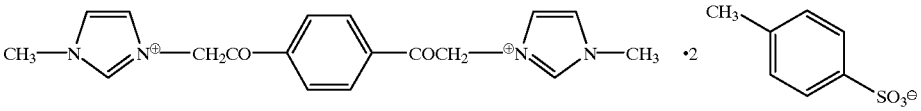
B-21
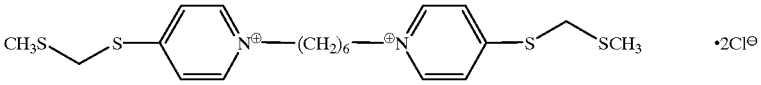
B-22
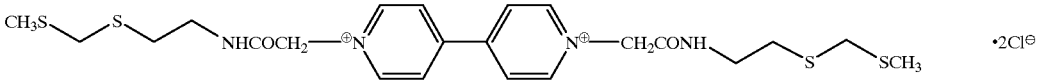
B-23
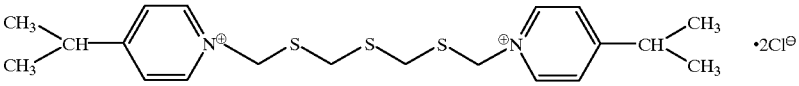
B-24
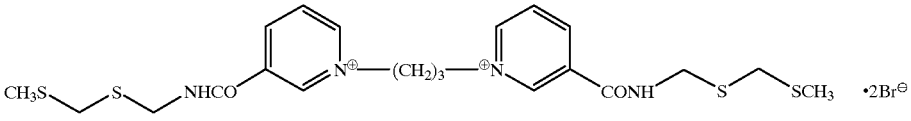
B-25
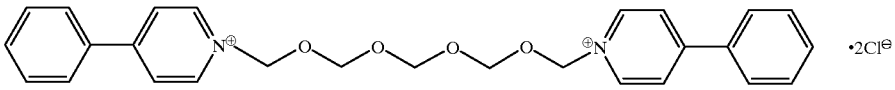
B-26
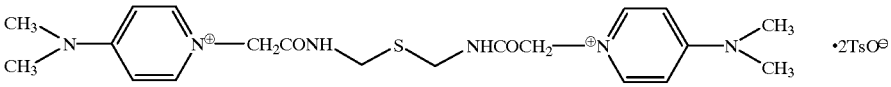

-continued

B-27

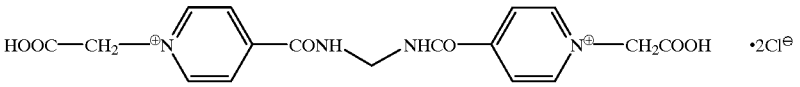

Next, the general formula (A-4) is described in detail.

(A-4)

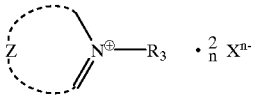

In formula (A-4), Z is an organic residue to complete a substituted or unsubstituted, unsaturated heterocyclic ring with the quaternized nitrogen atom. The nitrogenous unsaturated heterocyclic ring may contain carbon, hydrogen, oxygen, and sulfur atoms and may have a benzene ring fused thereto and a substituent. Examples of the nitrogenous unsaturated heterocyclic ring are the same as $A_1$, $A_2$, $A_3$, and $A_4$ in formulae (A-2) and (A-3), with the pyridine, quinoline and isoquinoline rings being preferred. Where the nitrogenous unsaturated heterocyclic ring completed by Z has a substituent, examples of the substituents are the same as described for the substituent on $A_1$, $A_2$, $A_3$, and $A_4$ in formulae (A-2) and (A-3), with preferred examples being the same.

$R_3$ is an alkyl or aralkyl group, preferably a substituted or unsubstituted, normal, branched or cyclic alkyl group preferably having 1 to 20 carbon atoms. The substituent on this group is the same as described for the substituent on $R_1$ and $R_2$ in formula (A-2), with preferred examples being the same.

The counter anion represented by $X^{n-}$ is as defined in formula (A-1), with its preferred examples being the same.

The compounds of formula (A-4) can be synthesized by well-known methods. Reference is made to Quart. Rev., 16, 163 (1962).

Illustrative, non-limiting, examples of the compound of formula (A-4) are given below.

C-1

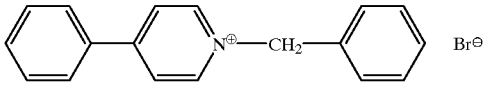

C-2

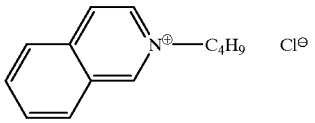

C-3

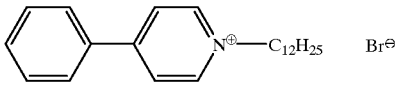

C-4

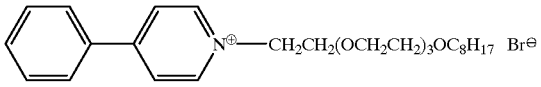

-continued

C-5

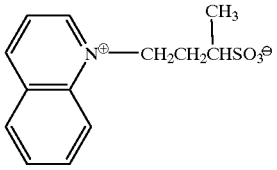

C-6

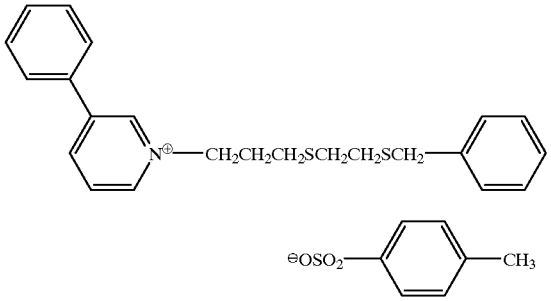

C-7

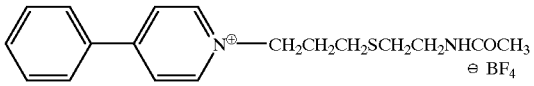

C-8

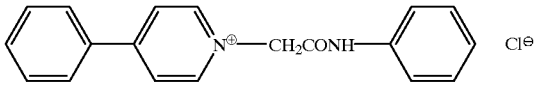

C-9

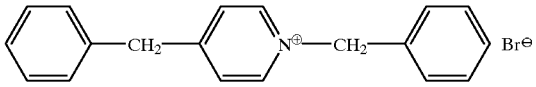

C-10

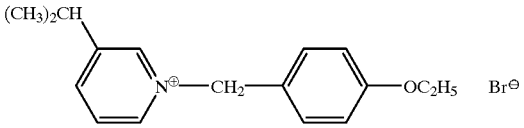

C-11

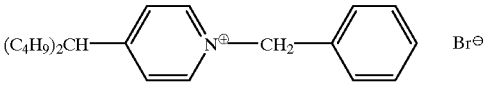

C-12

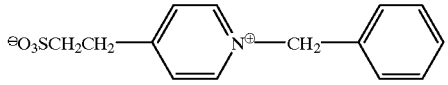

C-13

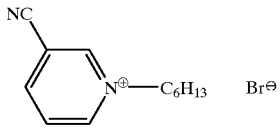

-continued

C-14

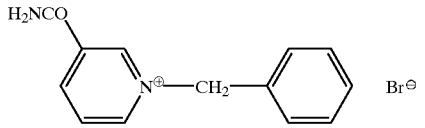

In the practice of the invention, the compound of formulae (A-1) to (A-4) is added to photosensitive material by dissolving it in an organic solvent, for example, alcohols (e.g., methanol, ethanol, propanol and fluorinated alcohol), ketones (e.g., acetone and methyl ethyl ketone), dimethylformamide, dimethylsulfoxide, and methyl cellosolve to form a solution. A well-known emulsifying dispersion method is used for dissolving the compound with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the compound in powder form in water in a ball mill, colloidal mill or ultrasonic means.

The compound of formulae (A-1) to (A-4) may be added to either the silver halide emulsion layer or another hydrophilic colloid layer on the same side of the support, preferably the silver halide emulsion layer or a hydrophilic colloid layer disposed adjacent thereto.

The amount of the compound of formulae (A-1) to (A-4) added is preferably $1\times10^{-6}$ to $2\times10^{-2}$ mol, more preferably $1\times10^{-5}$ to $2\times10^{-2}$ mol, most preferably $2\times10^{-5}$ to $1\times10^{-2}$ mol per mol of the silver halide.

In addition to the compound of formulae (A-1) to (A-4), an amine, disulfide or hydroxymethyl derivative may be used as a nucleation promoter if desired.

Useful amine derivatives include the compounds represented by chemical formulae [21], [22] and [23] in JP-A 84331/1995, specifically the compounds described on pages 6 to 8 thereof; the compounds represented by the general formula (Na) in JP-A 104426/1995, specifically the compounds Na-1 to Na-22 described on pages 16 to 20 thereof; and the compounds represented by the general formulae (1), (2), (3), (4), (5), (6) and (7) in JP-A 37817/1995, specifically the compounds 1-1 to 1-19, 2-1 to 2-22, 3-1 to 3-36, 4-1 to 4-5, 5-1 to 5-41, 6-1 to 6-58, and 7-1 to 7-38 described therein. Useful disulfide derivatives are described in JP-A 198147/1986, for example. Useful hydroxymethyl derivatives are described in U.S. Pat. Nos. 4,693,956, 4,777,118, and EP 231850, with diarylmethanol derivatives being preferred.

The photothermographic material according to the invention is processed by a photothermographic process to form photographic images. As described in the preamble, such photothermographic materials are disclosed in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

The photothermographic material according to the invention preferably contains a reducible silver source (e.g., organic silver salt), a catalytic amount of a photocatalyst (e.g., silver halide), a toner for controlling the tonality of silver, and a reducing agent, typically dispersed in a binder (typically organic binder) matrix. Although the photothermographic material is stable at room temperature, it is developed merely by heating at an elevated temperature (e.g., higher than 60° C., preferably 80 to 120° C.) after exposure, that is, without a need for a processing solution. Upon heating, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

In the photothermographic material of the invention, the ultrahigh contrast promoting agent participates in the image forming process to form a ultrahigh contrast image. Formation of ultrahigh contrast images assisted by ultrahigh contrast promoting agents is well known for systems to be processed with solutions, but not known for heat developing systems using organic silver salts and is thus quite unexpected.

The photothermographic material of the invention has at least one photosensitive layer on a support. It is acceptable to form only a photosensitive layer on a support although it is preferred to form at least one non-photosensitive layer on the photosensitive layer. In order to control the quantity or wavelength distribution of light transmitted to the photosensitive layer, a filter layer may be formed on the same side as or on the opposite side to the photosensitive layer, or a dyestuff or pigment may be contained in the photosensitive layer. The dyestuff used to this end is preferably selected from the compounds described in Japanese Patent Application No. 11184/1995. The photosensitive layer may consist of two or more strata. Also a combination of high/low sensitivity strata or low/high sensitivity strata may be used for the adjustment of gradation.

In the photothermographic material of the invention, various additives such as surfactants, antioxidants, stabilizers, plasticizers, UV absorbers, and coating aids may be used. These additives may be added to any of the photosensitive layer, non-photosensitive layer and other layers.

A binder is used to hold such additives. It is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

Addition of toners is quite desirable. Preferred toners are disclosed in Research Report No. 17029. Exemplary toners include imides such as phthalimide; cyclic imides, pyrazolin-5-ones, and quinazolinones such as succinimide, 3-phenyl-2-pyrazoline-5-one, 1-phenylurazol, quinazoline and 2,4-thiazolizinedione; naphthalimides such as N-hydroxy-1,8-naphthalimide; cobalt complexes such as cobalt hexamine trifluoroacetate; mercaptans such as 3-mercapto-1,2,4-triazole; N-(aminomethyl) aryldicarboxyimides such as N-(dimethylaminomethyl) phthalimide; combinations of a blocked pyrazole, an isothiuronium derivative and a certain optical bleaching agent such as a combination of N,N'-hexamethylenebis(1-carbamoyl-3,5-dimethylpyrazole), 1,8-(3,6-dioxaoctane)bis (isothiuroniumtrifluoroacetate) and 2-tribromomethylsulfonyl-benzothiazole; merocyanine dyes such as 3-ethyl-5-{(3-ethyl-2-benzothiazolinylidene)-1-methylethylidene}-2-thio-2,4-oxazolidinedione; phthalazinones, phthalazinone derivatives or metal salts thereof such as 4-(1-naphthyl)phthalazinone, 6-chlorophthalazinone, 5,7-dimethyloxyphthalazinone and 2,3-dihydro-1,4-phthalazinedione; combinations of phthalazinones with sulfinic acid derivatives such as a combination of 6-chlorophthalazinone with sodium benzenesulfinate and a combination of 8-methylphthalazinone with sodium p-trisulfonate; combinations of phthalazines with phthalic acid; combinations of phthalazines (inclusive of phthalazine adducts) with maleic anhydride and at least one of phthalic acid, 2,3-naphthalenedicarboxylic acid and o-phenylenic acid derivative and anhydrides thereof (e.g., phthalic acid, 4-methylphthalic acid, 4-nitrophthalic acid, and tetrachlorophthalic anhydride); quinazolinediones, benzoxazine, and naphthoxazine derivatives; benzoxazine-2,4-diones such as 1,3-benzoxazine-2,4-dione; pyrimidine and asym-triazines such as 2,4-dihydroxypyrimidine; and tetraazapentalene derivatives such as 3,6-dimercapto-1,4-diphenyl-1H,4H-2,3a,5,6a-tetraazapentalene. Phthalazones are preferred toners.

The silver halide which is useful as a catalytic amount of photocatalyst may be selected from photosensitive silver halides such as silver bromide, silver iodide, silver chloride, silver chlorobromide, silver iodobromide, and silver chloroiodobromide, with an iodide ion being preferably contained. The silver halide may be added to the image forming layer by any desired method whereupon the silver halide is disposed close to the reducible silver source. In general, the silver halide is contained in an amount of 0.75 to 30% by weight based on the reducible silver source. The silver halide may be prepared by converting a silver soap moiety through reaction with a halide ion, or by preforming silver halide and adding it upon generation of a soap, or a combination of these methods. The latter method is preferred.

The reducible silver source is preferably selected from silver salts of organic and hetero-organic acids containing a reducible silver ion source, especially silver salts of long chain aliphatic carboxylic acids having 10 to 30 carbon atoms, especially 15 to 25 carbon atoms. Also preferred are complexes of organic or inorganic silver salts with ligands having an overall stability constant to silver ion in the range of 4.0 to 10.0. Preferred examples of the silver salt are described in Research Disclosure Nos. 17029 and 29963. Included are silver salts of organic acids (e.g., gallic acid, oxalic acid, behenic acid, stearic acid, palmitic acid, and lauric acid); silver salts of carboxyalkylthioureas (e.g., 1-(3-carboxypropyl)thiourea and 1-(3-carboxypropyl)-3,3-dimethylthiourea); silver complexes of polymeric reaction products of aldehydes and hydroxy-substituted aromatic carboxylic acids (exemplary aldehydes are formaldehyde, acetaldehyde and butylaldehyde and exemplary hydroxy-substituted acids are salicylic acid, benzoic acid, 3,5-dihydroxybenzoic acid, and 5,5-thiodisalicylic acid); silver salts or complexes of thioenes (e.g., 3-(2-carboxyethyl)-4-hydroxymethyl-4-(thiazoline-2-thioene and 3-carboxymethyl-4-thiazoline-2-thioene); silver complexes or salts of nitrogenous acids such as imidazoles, pyrazoles, urazoles, 1,2,4-thiazoles, 1H-tetrazoles, 3-amino-5-benzylthio-1,2,4-triazoles, and benzotriazoles; silver salts of saccharin and 5-chlorosalicylaldoxime; and silver salts of mercaptides. The preferred silver source is silver behenate. The reducible silver source is preferably used in an amount of up to 3 g/m$^2$, more preferably up to 2 g/m$^2$ of silver.

An antifoggant may be contained in the photosensitive material according to the invention. The most effective antifoggant was mercury ion. Use of a mercury compound as the antifoggant in photosensitive material is disclosed, for example, in U.S. Pat. No. 3,589,903. Mercury compounds, however, are undesirable from the environmental aspect. Preferred in this regard are non-mercury antifoggants as disclosed, for example, in U.S. Pat. Nos. 4,546,075 and 4,452,885 and JP-A 57234/1984.

Especially preferred non-mercury antifoggants are compounds as disclosed in U.S. Pat. Nos. 3,874,946 and 4,756,999 and heterocyclic compounds having at least one substituent represented by —C($X^1$) ($X^2$) ($X^3$) wherein $X^1$ and $X^2$ are halogen atoms such as F, Cl, Br, and I, and X is hydrogen or halogen. Preferred examples of the antifoggant are shown below.

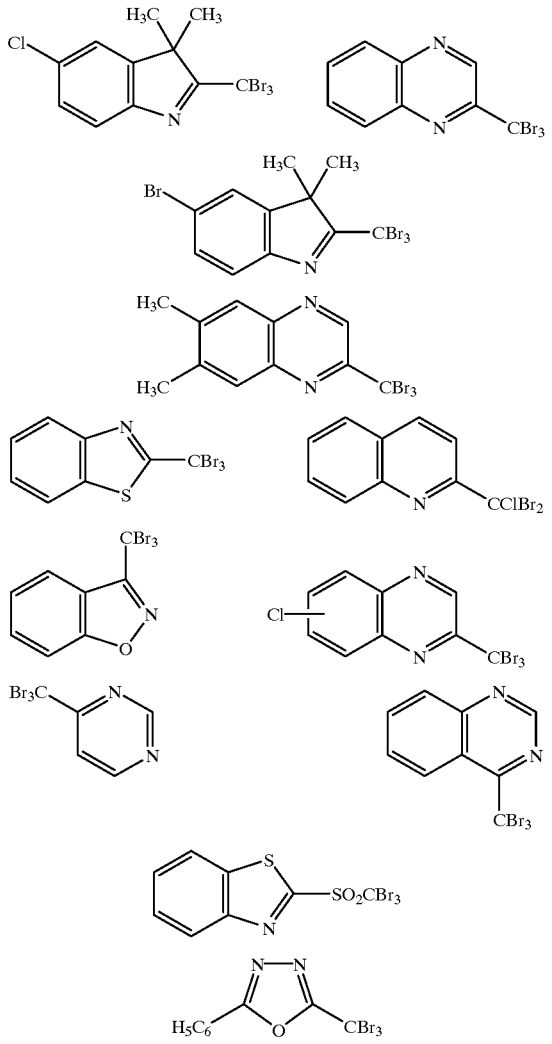

-continued

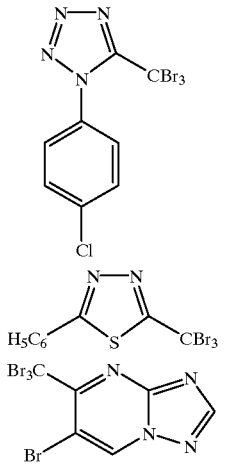

More preferred antifoggants are disclosed in U.S. Pat. No. 5,028,523, British Patent Application Nos. 92221383.4, 9300147.7 and 9311790.1.

In the photothermographic material according to the invention, there may be used sensitizing dyes as disclosed in JP-A 159841/1988, 140335/1985, 231437/1988, 259651/1988, 304242/1988, and 15245/1988, U.S. Pat. Nos. 4,639,414, 4,740,455, 4,741,966, 4,751,175, and 4,835,096.

Useful sensitizing dyes which can be used herein are described in Research Disclosure, Item 17643 IV-A (December 1978, page 23), ibid., Item 1831 X (August 1978, page 437) and the references cited therein.

It is advantageous to select a sensitizing dye having appropriate spectral sensitivity to the spectral properties of a particular light source of various scanners. Exemplary sensitizing dyes include (A) simple merocyanines as described in JP-A 162247/1985 and 48653/1990, U.S. Pat. No. 2,161,331, W. German Patent No. 936,071, and Japanese Patent Application No. 189532/1991 for argon laser light sources; (B) tri-nucleus cyanine dyes as described in JP-A 62425/1975, 18726/1979 and 102229/1984 and merocyanines as described in Japanese Patent Application No. 103272/1994 for He—Ne laser light sources; (C) thiacarbocyanines as described in JP-B 42172/1973, 9609/1976, 39818/1980, JP-A 284343/1987 and 105135/1990 for LED light sources and red semiconductor laser light sources; and (D) tricarbocyanines as described in JP-A 191032/1984 and 80841/1985 and 4-quinoline nucleus-containing dicarbocyanines as described in JP-A 192242/1984 and 67242/1991 (as represented by formulae (IIIa) and (IIIb) therein) for infrared semiconductor laser light sources.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

For exposure of the photothermographic material of the invention, an Ar laser (488 nm), He—Ne laser (633 nm), red semiconductor laser (670 nm), and infrared semiconductor laser (780 nm and 830 nm) are preferably used.

A dyestuff-containing layer may be included as an antihalation layer in the photothermographic material of the invention. For Ar laser, He-Ne laser, and red semiconductor laser light sources, a dyestuff is preferably added so as to provide an absorbance of at least 0.3, more preferably at least 0.8 at an exposure wavelength in the range of 400 to 750 nm. For infrared semiconductor laser light sources, a dyestuff is preferably added so as to provide an absorbance of at least 0.3, more preferably at least 0.8 at an exposure wavelength in the range of 750 to 1500 nm. The dyestuffs may be used alone or in admixture of two or more. The dyestuff may be added to a dyestuff layer disposed on the same side as the photosensitive layer adjacent to the support or a dyestuff layer disposed on the support opposite to the photosensitive layer.

The photothermographic material of the invention is a ultrahigh contrast printing photosensitive material and contains an organic silver salt, a photosensitive silver halide, a reducing agent, and a ultrahigh contrast promoting agent on one surface of a support. A back layer is preferably disposed on the other or back surface of the support. In one preferred embodiment, at least one of layers on the one and other surfaces of the support is a polymer layer containing a conductive metal oxide and/or a conductive high molecular weight compound, that is, a conductive layer.

The provision of a conductive polymer layer suppresses the generation of pepper fog upon heat development and eliminates the occurrence of development variation, ensuring formation of a uniform image. The conductive polymer layer also insures flatness for the photothermographic material by preventing distortion which would occur particularly when a plastic film is used as the support. The conductive polymer layer further prevents electrostatic charging and hence, troubles associated therewith.

The electroconductive substance used in the conductive polymer layer is selected from conductive metal oxides and conductive high molecular weight compounds.

First, the conductive metal oxides used herein are preferably crystalline metal oxide particles. Such metal oxide grains containing oxygen defects and metal oxide grains containing a trace amount of hetero atom serving as a donor to the metal oxide are preferred because they are generally highly conductive. The latter is especially preferred because it causes no fog to a silver halide emulsion. Examples of the metal oxide include ZnO, $TiO_2$, $SnO_2$, $Al_2O_3$, $In_2O_3$, $SiO_2$, MgO, BaO, $MoO_3$, and $V_2O_5$, and composite oxides thereof, with the ZnO, $TiO_2$, and $SnO_2$ being preferred. Useful metal oxides containing a hetero atom are ZnO having Al, In, etc. added thereto, $SnO_2$ having Sb, Nb, halogen, etc. added thereto, and $TiO_2$ having Nb, Ta, etc. added thereto, for example. The amount of hetero atom added is preferably 0.01 to 30 mol %, more preferably 0.1 to 10 mol %.

Metal oxide particles are conductive and preferably have a volume resistivity of up to $10^7$ Ω-cm, especially $10^1$ Ω-cm to $10^5$ Ω-cm. For the detail of these metal oxides, reference is made to JP-A 143431/1981 and 120519/1981, and 62647/1983. Also useful are conductive materials in the form of other crystalline metal oxide (e.g., titanium oxide) particles or fibers having the above-mentioned metal oxide deposited thereon as described in JP-B 6235/1984.

Preferably the metal oxide particles have a particle size of less than about 10 μm. Particles with a particle size of less than about 2 μm are convenient because they are stable after dispersion. Especially when conductive particles having a particle size of less than about 0.5 μm (generally more than about 0.05 μm) are used to minimize light scattering, a transparent photosensitive material can be advantageously produced. Where the conductive material is acicular or fibrous, such needles or fibers should preferably have a length of less than about 30 μm and a diameter of less than 2 μm, more preferably a length of about 1 to 25 μm, a diameter of about 0.05 to 0.5 μm, and a length/diameter ratio of at least 3/1.

The conductive high molecular weight compounds used herein are preferably polyvinyl benzenesulfonates, polyvinyl benzyltrimethylammonium chloride, quaternary salt polymers as described in U.S. Pat. Nos. 4,108,802, 4,118,231, 4,126,467, and 4,137,217, and polymer latexes as described in U.S. Pat. No. 4,070,189, OLS 2,830,767, JP-A 296352/1986 and 62033/1986.

Illustrative, non-limiting examples of the conductive high molecular weight compound are given below.

CP-1

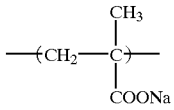

CP-2

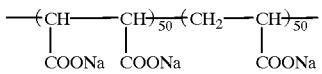

CP-3

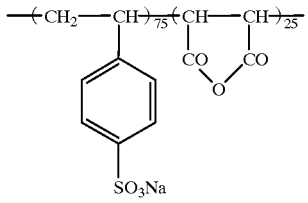

CP-4

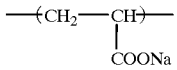

CP-5

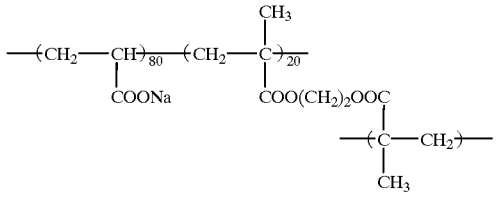

CP-6

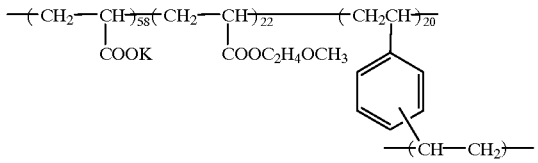

CP-7

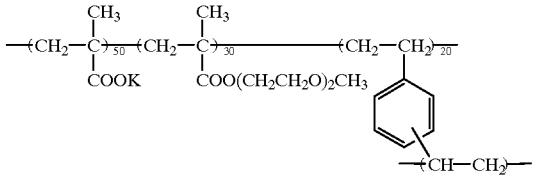

The present invention favors the use of conductive metal oxides.

According to the invention, the conductive metal oxide or conductive high molecular weight compound is dispersed or dissolved in a binder. The binder used herein is a polymer capable of forming a film. Exemplary polymers include proteins such as gelatin and casein; cellulose derivatives such as carboxymethyl cellulose, hydroxyethyl cellulose, acetyl cellulose, diacetyl cellulose, and triacetyl cellulose; saccharides such as dextran, agar, sodium alginate and starch derivatives; and synthetic polymers such as polyvinyl alcohol, polyvinyl acetate, polyacrylates, polymethacrylates, polystyrene, polyacrylamides, poly-N-vinyl pyrrolidone, polyesters, polyvinyl chloride, and polyacrylic acid. Especially preferred are gelatin (including lime-treated gelatin, acid-treated gelatin, enzyme decomposed gelatin, phthalated gelatin, and acetylated gelatin), acetyl cellulose, diacetyl cellulose, triacetyl cellulose, polyvinyl acetate, polyvinyl alcohol, polybutyl acrylate, polyacrylamides, and dextran.

In order to more effectively utilize the conductive metal oxide or conductive high molecular weight compound to reduce the resistance of the conductive layer, it is desired that the volume content of the conductive substance in the conductive layer be as high as possible. Since at least about 5% by volume of the binder is necessary for the layer to have sufficient strength, the volume content of the conductive substance in the conductive layer is desirably in the range of 5 to 95%.

The amount of the conductive metal oxide or conductive high molecular weight compound used is preferably 0.05 to 20 grams, especially 0.1 to 10 grams per square meter of the photosensitive material. The conductive layer preferably has a surface resistivity of less than about $10^{12}\Omega$, especially $10^{4}$ to $10^{11}\Omega$ as measured at 25° C. and RH 25% because more antistatic effect is obtained in this range.

The conductive layer containing the conductive metal oxide or conductive high molecular weight compound is disposed on a support on the same side as a surface bearing the organic silver salt or on the opposite side corresponding to the back layer. The conductive substance may be contained in any of constituent layers of photosensitive material including an organic silver salt-containing layer (which is generally identical with a photosensitive or emulsion layer containing photosensitive silver halide), an emulsion layer surface protective layer, an intermediate layer, an undercoat layer, a back layer, and a back surface protective layer. If desired, more than one conductive layer may be provided.

On either the emulsion-bearing surface or the back surface, the conductive layer should preferably be provided as an outermost layer because better results are expectable. The outermost layer may be a back layer where no back surface protective layer is formed thereon, a back surface protective layer or an emulsion layer surface protective layer (each protective layer is inclusive of an overcoat layer). Preferably the outermost layer is a surface protective layer or overcoat layer, especially a surface protective layer or overcoat layer on the back surface.

Although the present invention favors a one-side photosensitive material having a photosensitive layer on one surface of a support and a back layer on the other surface thereof, a double-side photosensitive material having a photosensitive layer on either surface of a support is also acceptable in the practice of the invention. In the double-side photosensitive material, the conductive layer is preferably a surface protective layer or overcoat layer on the emulsion-bearing surface serving as the outermost layer.

In the practice of the invention, a fluorinated surfactant is preferably used in combination with the conductive substance to achieve more antistatic effect.

Preferred examples of the fluorinated surfactant include those surfactants having a fluoroalkyl, fluoroalkenyl or fluoroaryl group having at least 4 carbon atoms and an ionic group which is selected from an anionic group (e.g., sulfonic acid or salts, sulfuric acid or salts, carboxylic acid or salts, and phosphoric acid or salts), a cationic group (e.g., amine salts, ammonium salts, aromatic amine salts, sulfonium salts, and phosphonium salts), a betaine group (e.g., carboxyamine salts, carboxyammonium salts, sulfoamine salts, sulfoammonium salts, and phosphoammonium salts), and a nonionic group (e.g., substituted or unsubstituted polyoxyalkylene, polyglyceryl and sorbitan residue). These fluorinated surfactants are described in JP-A 10722/1974, 149938/1980, and 196544/1983, UKP 1,330,356, 1,417,915, and 1,439,402, U.S. Pat. Nos. 4,335,201 and 4,347,308.

Illustrative, non-limiting, examples of the fluorinated surfactant are given below.

F-1

$C_8F_{17}SO_3K$

F-2

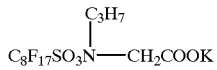

$C_8F_{17}SO_3N(C_3H_7)-CH_2COOK$

F-3

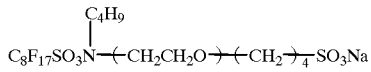

$C_8F_{17}SO_3N(C_4H_9)-(CH_2CH_2O)-(CH_2)_4-SO_3Na$

F-4

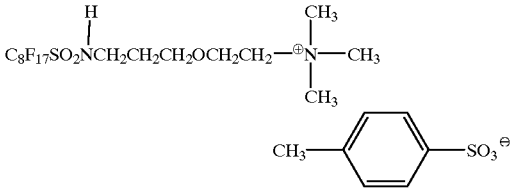

$C_8F_{17}SO_2N(H)CH_2CH_2CH_2OCH_2CH_2-N^{\oplus}(CH_3)_2-C_6H_4-CH_3-SO_3^{\ominus}$ The layer to which the fluorinated surfactant is added is not critical. The fluorinated surfactant may be added to at least one layer selected from a surface protective layer, emulsion layer, intermediate layer, undercoat layer, and back layer. The preferred destination of addition is a surface protective layer on either the emulsion layer side or the back layer side, especially surface protective layers on both sides. Where the surface protective layer consists of two or more strata, the surfactant may be added to any of the strata. Alternatively, the surfactant may be overcoated on the surface protective layer.

The amount of the fluorinated surfactant used is preferably 0.0001 to 1 gram, more preferably 0.0002 to 0.25 gram, especially 0.0003 to 0.1 gram per square meter of the photosensitive material. The fluorinated surfactants may be used alone or in admixture of two or more.

Another antistatic agent may be used in the layer containing the fluorinated surfactant or another layer to achieve more antistatic effect.

In general, it is well known for printing plate-forming photosensitive materials that a conductive layer containing a conductive metal oxide or conductive high molecular weight compound is provided between the photosensitive layer and the support or on the back surface. This conductive layer aims to prevent electrostatic attraction of debris to the photosensitive material during handling, which would become noise upon exposure.

Quite unexpectedly, when applied to a photothermographic material containing a ultrahigh contrast promoting agent, the conductive polymer layer is effective for suppressing the occurrence of pepper fog upon development and reducing dot variation. The results are completely different from the prior art.

Support

The support used herein should have a glass transition temperature (Tg) of at least 90° C., especially 90 to 350° C. Tg is determined by means of a differential scanning calorimeter (DSC). More particularly, 10 mg of a sample is heated in a nitrogen gas stream at a rate of 20° C./min. to 300° C., quenched to room temperature, and then heated again at a rate of 20° C./min. Tg is an arithmetic average between the temperature at which a deviation from the base line starts in the second heating cycle and the temperature at which a new base line is assumed.

Preferred examples of the plastic film used as the support in the present invention are shown in Table 8.

TABLE 8

| No. | Film material | Abbreviation | Tg (° C.) |
|---|---|---|---|
| 1 | Polycarbonate | PC | 140–150 |
| 2 | Polysulfone | PSO | 190 |
| 3 | Polyarylate | PAr | 193–215 |
| 4 | Polyether sulfone | PES | 223–230 |
| 5 | Polyparabanic acid | PPA | 290 |
| 6 | Polyamide imide | PAI | 285–350 |
| 7 | Polyphenylene sulfide | PPS | 90 |
| 8 | Polyethylene naphthalate | PEN | 113 |
| 9 | Polyether ether ketone | PEEK | 143 |
| 10 | Polyether imide | PEI | 216 |
| 11 | All aromatic polyamide | APA | 275 |
| 12 | Syndiotactic polystyrene | SPS | 100 |
| 13 | Polymethyl methacrylate | PMMA | 105 |

A film is generally prepared from such a polymer by a melt method generally known as a melt extrusion method or a solvent method of dissolving the polymer in an organic solvent and casting the solution. The melt extrusion method is especially preferred because a further improvement in dimensional stability is expectable.

More particularly, a film is prepared by heat melting the polymer and extruding the melt, followed by cooling for solidification. The extruder used herein may be either of single and twin shaft extruders which may be vented or not. The extruder is preferably equipped with a mesh filter for comminuting or removing secondary agglomerates and removing debris and foreign matter. Extruding conditions are not critical and may be properly selected in accordance with a particular situation. Preferably extrusion is carried out through a T die at a temperature between the melting point of the polymer and the decomposition temperature plus 50° C.

At the end of extrusion, the resulting preform or raw sheet is cooled and solidified. The coolant used herein may be any of gases, liquids, and metal rolls. Where a metal roll is used, it is preferably combined with such means as air knife, air chamber, touch roll and electrostatic charging which is effective for preventing thickness variation or waving. The cooling or solidifying temperature is generally in the range between 0° C. and the Tg of the raw sheet plus 30° C., preferably between the Tg of the raw sheet minus 50° C. and the Tg. A cooling rate may be properly selected in the range of 200° C./sec. to 3° C./sec. The thus obtained raw sheet generally has a gage of about 100 to 5,000 $\mu$m.

The solidified raw sheet is then oriented monoaxially or biaxially. In the case of biaxial orientation, the sheet may be simultaneously oriented in longitudinal and transverse directions or sequentially oriented first in one direction and then in another direction. Orientation may be done in one stage or multiple stages. The orienting method used herein includes tentering, stretching between rolls, bubbling utilizing a pneumatic pressure, and rolling. Any desired one may be selected from such orienting methods or any desired combination may be used. The orienting temperature is generally set between the Tg and the melting point of the raw sheet. In the case of sequential or multi-stage orientation, the first stage is preferably carried out at a temperature between the Tg and the crystallizing temperature of the raw sheet and the second stage at a temperature between the Tg and the melting point of the raw sheet. The orienting rate is preferably $1\times10^{-to}$ $1\times10^{7}$%/min., more preferably $1\times10^{3}$ to $1\times10^{7}$%/min. An area stretching factor of at least 8, especially at least 10 is preferred because a transparent film satisfying smoothness, humid dimensional stability and heat dimensional stability would not be obtained by stretching at an area factor of less than 8.

Preferably the film oriented under the above-mentioned conditions is further thermoset for improving dimensional stability at elevated temperature, heat resistance, and strength balance within the film plane. Thermosetting may be done in a conventional manner. Usually, the oriented film is held for ½ to 1,880 seconds at a temperature in the range between the Tg and the melting point of the film, especially between the upper limit temperature of a service environment and the melting point of the film while the film is kept under a tensioned, loosened or shrinkage limited condition. Thermosetting may be carried out two or more times under a different set of conditions within the above-mentioned range. Also thermosetting may be carried out in an inert gas atmosphere such as argon gas and nitrogen gas. In order to produce a least heat shrinkable film, any one of thermosetting steps is preferably carried out in a shrinkage limited condition. The proportion of shrinkage limit is up to 20%, preferably up to 15% in a longitudinal and/or transverse direction.

Stretching and thermosetting conditions are preferably adjusted such that the magnitude $|\Delta n|$ of complex refraction index of the film may be up to $40\times10^{-3}$ whereby a film having improved physical properties including transparency can be obtained.

In a further preferred embodiment, the support used herein experiences a dimensional change of less than 0.04% when heated at 115° C. for 30 seconds. More preferably, the support experiences a dimensional change of up to 0.03%, especially up to 0.02% when heated at 115° C. for 30 seconds. The lower the percent thermal dimensional change, the better are the results. However, the practical lower limit is about 0.001% at present. Supports experiencing a thermal dimensional change of more than 0.04% are undesirable because they are less adhesive to the overlying image-forming layer. Preferred examples of the support include supports of polycarbonate (PC), polyethylene terephthalate (PET), polyether sulfone (PES), polyarylate (PAr), polyether ether ketone (PEEK), polysulfone (PSO), and syndiotactic polystyrene (SPS), and heat treated ones thereof. Among others, PC and PET and heat treated ones thereof are preferred. PC and heat treated PET are especially preferred.

The support may contain organic or inorganic fine particles therein. Preferred fine particles are of silica, alumina, calcium carbonate, titania, calcium chloride, crosslinked polymethyl methacrylate, and crosslinked polystyrene. These particles preferably have a particle size of 0.02 to 3 μm and are added in an amount of 10 to 1,000 ppm. For ease of handling, the support should preferably have a Young's modulus of 200 to 800 kg/mm$^2$, especially 300 to 600 kg/mm$^2$.

Preferably the support is heat treated before a photosensitive layer is coated thereon. Heat treatment is usually carried out at a temperature of 80 to 200° C., preferably 100 to 180° C., more preferably 110 to 160° C. Heat treatment may be carried out at a fixed temperature within this range or while raising or lowering the temperature within this range. Preferably heat treatment is carried out at a fixed temperature or while lowering the temperature. The heat treatment time is from 1 minute to 200 hours. Less than 1 minute of heat treatment is ineffective. With more than 200 hours, no further effect is obtained, the support can be colored or embrittled, and manufacturing efficiency is aggravated.

Heat treatment may be done on the support in roll form or while feeding the support in web form. Heat treatment of the support in roll form may be either of (1) a cold winding method of placing a roll at room temperature in a constant temperature tank and (2) a hot winding method of heating a web at a predetermined temperature while feeding it and taking up the web in a roll form. Method (1) requires a time for heating and cooling, but a less investment for installation. Method (2) requires a winding device at high temperature, but a short heating time.

Heat treatment in roll form often invites surface failures such as creases by roll tightening and transfer of winding core section due to thermal shrinkage stresses generated during heat treatment. It is desirable to take a measure for preventing the transfer of winding core section by knurling opposite edges of a support to slightly raise only the edges. The knurled area preferably has a width of 2 to 50 mm, more preferably 5 to 30 mm, most preferably 7 to 20 mm and a height of 0.5 to 100 μm, more preferably 1 to 50 μm, most preferably 2 to 20 μm. Knurling may be done from one side or from both sides and preferably at a temperature above Tg. The atmosphere under which heat treatment is done should preferably have an absolute humidity corresponding to a water content of up to 22 grams, more preferably up to 16 grams, most preferably up to 8 grams per kg of air from the standpoint of blocking during heat treatment. No lower limit is imposed on the absolute humidity although the lower limit is usually a water content of about 0.1 gram per kg of air.

The roll is preferably wound under tension per unit width at an initial (leading edge) tension of 3 to 75 kg/cm$^2$ and a final (trailing edge) tension of 3 to 75 kg/cm$^2$. Loose winding below this range would allow the roll to undergo sag deformation under gravity during heat treatment. Beyond this range, wrinkles would form due to tightening. More preferably the initial tension is 5 to 40 kg/cm$^2$ and the final tension is 3 to 35 kg/cm$^2$. It is preferred to wind a web into a roll under controlled tension such that the initial tension is greater than the final tension.

In the practice of the invention, the support is preferably fed under a tension of up to 13 kg/cm$^2$ during heat treatment because the percent thermal dimensional change of the support is dramatically reduced. As a result, quite unexpectedly, the adhesion of the support and the overlying layer is outstandingly improved.

Preferably the winding core has a diameter of 100 to 600 mm. A smaller diameter would cause wrinkles and depressions to form during heat treatment. With a larger diameter, the resulting roll becomes too bulky and inconvenient for transportation and storage. More preferably, the diameter is 150 to 450 mm, most preferably 200 to 400 mm. The winding core should preferably have an exactly circular cross-section.

The winding core is preferably made of a material which maintains a sufficient modulus of elasticity during heat treatment and is resistant to deformation by thermal shrinkage stresses of the support wound thereon. Winding cores of ceramics, metals, resins, and fiber-reinforced plastics (FRP) are thus preferred. Specifically, preferred metals are aluminum, stainless steel (or iron-chromium-nickel alloy), brass (or copper-nickel alloy), copper, iron, and duralumin (aluminum-copper-magnesium-manganese-silicon alloy), with aluminum, stainless steel and iron being more preferred.

Preferred ceramic materials include $3Al_2O_3$-$2SiO_2$, $BaTiO_2$, $SrTiO_3$, $Y_2O_3$—$ThO_2$, $ZrTiO_3$, $ZrO_2$, $Si_3N$, $SiCMgO.SiO_2$, $MgCr_2O_4$—$TiO_2$ although not limited thereto. Especially preferred are $3Al_2O_3$-$2SiO_2$, $BaTiO_2$, $SrTiO_3$, and $ZrO_2$. FRP consists of fibers impregnated with a resin, and typical fibers include glass fibers, carbon fibers, boron fibers, nylon fibers, polyester fibers, cotton and paper. Examples of the impregnating resin include phenol resins, epoxy resins, polyacetal resins, polyimide resins, nylon resins, saturated polyester resins, and unsaturated polyester resins. For detail, reference is made to Japanese Mechanical Society Ed., "Manual of Mechanical Engineering," 3rd Ed., Maruzen K. K., B4-117 to 30.

Preferred resins include phenol resins, epoxy resins, polyacetal resins, polyimide resins, nylon resins, saturated polyester resins, unsaturated polyester resins, polyacryl resins, polymethacryl resins, fluoro-resins, polycarbonate resins, polyarylate resins, polyurethane resins, polystyrene resins, polyethylene resins, polypropylene resins, cellulose ester resins, rubber, vinyl acetate polymers and copolymers, vinyl chloride polymers and copolymers, and polymer blends.

The winding core may be made of a mixture of two or more materials or a laminate. For example, aluminum is coated on the surface with $Al_2O_3$ or thinly coated with a fluoro-resin.

Where the support in web form is heat treated, a heating zone is required. The heat treatment of the support in web form is preferred to the heat treatment in roll form because a support surface of better quality is obtained. The web is preferably fed under a tension of 0.1 to 13 kg/cm$^2$, more preferably 0.3 to 10 kg/cm$^2$, most preferably 0.5 to 4 kg/cm$^2$. Such a low tension should be accomplished in the heating zone. Then suction drums are located upstream and downstream of the heating zone so that the web may be fed under a weak tension through the heating zone while the web is subsequently taken up under a higher tension. The web is preferably sufficiently cooled by means of a chill roll before it is taken up. This is effective for further reducing a dimensional change. Forces applied to the support include a stress caused by thermal shrinkage of itself as well as the winding tension. Therefore, in a preferred mode, a thermal shrinkage is previously measured and web feed is controlled such that the supply amount may be greater than the take-up amount by the shrinkage. Heat treatment is preferably done for 1 to 60 minutes, more preferably 3 to 30 minutes, most preferably 5 to 15 minutes. When a long heat treating time requiring a longer heating zone is desired, heat treatment may be done in two or more divided portions.

Preferably heat treatment is carried out after undercoating. This is because the percent dimensional change can be increased by the tension applied during the undercoating step. By containing a matte agent in the undercoat layer, surface flatness can be increased during roll form heat treatment.

It is desired that various coating layers of the photothermographic material including a silver halide emulsion layer, anti-halation layer, intermediate layer, and backing layer be firmly bonded to the support. To this end, any of well-known methods may be used as described below.

(1) A first method is to establish a bonding force by first subjecting the support to surface activating treatment and applying a coating layer directly thereto. The surface activating treatment used herein includes chemical treatment, mechanical treatment, corona discharge treatment, flame treatment, UV treatment, radio frequency treatment, glow discharge treatment, active plasma treatment, laser treatment, mixed acid treatment, and ozone oxidizing treatment.

(2) A second method is by forming an undercoat layer on the support after similar surface activating treatment or without surface activating treatment, and then applying a coating layer thereto. See U.S. Pat. Nos. 2,698,241, 2,764,520, 2,864,755, 3,462,335, 3,475,193, 3,143,421, 3,501,301, 3,460,944, 3,674,531, UKP 788,365, 804,005, 891,469, JP-B 43122/1973 and 446/1976.

By virtue of these surface treatments, the support which is originally hydrophobic is given more or less polar groups on its surface or increased in crosslinking density on its surface whereby the affinity force to polar groups of components in the undercoating solution is increased or the surface becomes more adherent to form a firm bond.

With respect to the construction of the undercoat layer, various implements are contemplated. Included are a multilayer technique of forming on the support a first undercoat layer in the form of a layer which is well adherent to the support and forming thereon a second undercoat layer in the form of an affinitive resin layer which is well adherent to a photographic layer, and a single layer technique of forming on the support a single layer of a resin containing both a hydrophobic group and an affinitive group.

Among the surface treatments associated with the first method (1), corona discharge treatment is best known in the art. Corona discharge treatment can be carried out by any of well-known techniques as disclosed in JP-B 5043/1973, 51905/1972, JP-A 28067/1972, 83767/1974, 41770/1976, and 131576/1976. A discharge frequency of 50 Hz to 5,000 kHz, especially 5 kHz to several hundred kHz is appropriate. A too low discharge frequency would generate a less stable discharge, with which pinholes can be formed in a substrate. A too high discharge frequency requires a special device for impedance matching, undesirably increasing the cost of installation. With respect to the strength of treatment on a substrate, about 0.001 to 5 kV·A·min/m$^2$, preferably 0.01 to 1 kV·A·min/m$^2$ is appropriate for improving the wettability of ordinary plastic films such as polyesters and polyolefins. The gap between the electrode and the dielectric roll is usually 0.5 to 2.5 mm, preferably 1.0 to 2.0 mm.

Glow discharge treatment is very effective surface treatment in most cases. Glow discharge treatment can be carried out by any of well-known techniques as disclosed in JP-B 7578/1960, 10336/1961, 22004/1970, 22005/1970, 24040/1970, 43480/1971, U.S. Pat. Nos. 3,057,792, 3,057,795, 3,179,482, 3,288,638, 3,309,299, 3,424,735, 3,462,335, 3,475,307, 3,761,299, UKP 997,093, and JP-A 129262/1978. Glow discharge treatment conditions include a pressure of 0.005 to 20 Torr, preferably 0.02 to 2 Torr. Under a too low pressure, surface treatment becomes less effective. Under a too high pressure, overcurrent would flow to generate sparks, which is not only dangerous, but also causes substrate failure. Glow discharge is generated by applying high voltage between at least a pair of spaced apart metal plates or bars in a vacuum chamber. The applied voltage varies with the composition and pressure of the atmospheric gas although a steady glow discharge occurs at a voltage of 500 to 5,000 volts under a pressure within the above-mentioned range. A voltage in the range of 2,000 to 4,000 volts is preferred for improving adhesion. The discharge frequency is from direct current to several thousand MHz, preferably 50 Hz to 20 MHz as found in the prior art. With respect to the strength of treatment on a substrate, about 0.01 to 5 kV·A·min/m$^2$, preferably 0.15 to 1 kV·A·min/m$^2$ is appropriate to achieve desired adhesion.

With respect to the undercoating method (2), various techniques are well known in the art. In the multilayer technique, the first undercoat layer is formed of copolymers prepared from a monomer selected from vinyl chloride, vinylidene chloride, butadiene, methacrylic acid, acrylic acid, itaconic acid, and maleic anhydride and various other polymers such as polyethylene imine, epoxy resins, grafted gelatin, and nitrocellulose. The second undercoat layer is usually formed of gelatin.

In the single layer technique, supports are often swollen to achieve interfacial mixing with a hydrophilic undercoat polymer, thereby providing good adhesion.

Examples of the affinitive undercoat polymer used herein include water-soluble polymers, cellulose esters, latex polymers, and water-soluble polyesters. The water-soluble polymers include gelatin, gelatin derivatives, casein, agar, sodium alginate, starch, polyvinyl alcohol, polyacrylic acid copolymers, and maleic anhydride copolymers; the cellulose esters include carboxymethyl cellulose and hydroxyethyl cellulose; the latex polymers include vinyl chloride-containing copolymers, vinylidene chloride-containing copolymers, acrylate-containing copolymers, vinyl acetate-containing copolymers, and butadiene-containing copolymers. Among these, gelatin is most preferred.

The compound used to swell the support includes resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid, and chloral hydrate.

In the undercoat layer, various polymer hardening agents may be used. Examples of the polymer hardening agent include chromium salts (e.g., chromium alum), aldehydes (e.g., formaldehyde and glutaraldehyde), isocyanates, active halogen compounds (e.g., 2,4-dichloro-6-hydroxy-s-triazine), and epichlorohydrin resins. Further in the undercoat layer, inorganic fine particles such as $SiO_2$ and $TiO_2$ and fine particles of polymethyl methacrylate (1 to 10 $\mu$m) may be contained as a matte agent.

Additionally, the undercoating solution may contain various additives if desired. Exemplary additives are surfactants, antistatic agents, anti-halation agents, coloring dyestuffs, pigments, coating aids, and antifoggants. Where an undercoating solution for forming the first undercoat layer is used, the undercoating layer need not contain at all an etching agent such as resorcin, chloral hydrate, and chlorophenol. It is acceptable to contain such an etching agent in the undercoating solution if desired.

The undercoating solution can be coated by various coating procedures including dip coating, air knife coating, curtain coating, roller coating, wire bar coating, gravure coating, and extrusion coating using a hopper of the type described in U.S. Pat. No. 2,681,294. If desired, two or more layers may be concurrently coated by the methods described in U.S. Pat. Nos. 2,761,791, 2,941,898, 3,508,947, and 3,526,528 as well as Harazaki, "Coating Engineering," Asakura Publishing K.K., 1973, page 253.

In a further preferred embodiment of the invention, at least one of outermost surfaces of a photothermographic material has a degree of smoothness or matte corresponding to a Bekk smoothness of up to 4,000 seconds, especially 10 to 4,000 seconds. Within this range, the material is improved in feed or transportation.

Where a back layer is formed on the surface of the support opposite to the photosensitive layer, the outermost surface of the back layer should preferably have a Bekk smoothness within the above-defined range.

The degree of matte used herein designates a degree of "surface roughness." The surface roughness is a roughness given by irregularities occurring at minute intervals on a surface, on the basis of which the surface is generally perceived by the senses to be "smooth" or "rough." The degree of matte is measured by various methods, for example, by means of a surface roughness meter and surface topographic observation under an optical microscope and scanning electron microscope. The average roughness of a surface is typically expressed by a Bekk smoothness as prescribed in JIS P-8119. The Bekk smoothness is determined by pressing a flat plate having an effective area of 10 $cm^2$ against a surface to be tested under a pressure of 1 $kg/cm^2$, passing air between the plate and the surface under a differential pressure of 370 mmHg, and measuring the time (in second) required for 10 ml of air to pass therebetween. A longer time indicates a lower degree of matte and a shorter time indicates a greater degree of matte. For precision measurement of Bekk smoothness, a pneumatic micrometer type tester is useful. Using the Oken type smoothness measurement described in J. TAPPI, Paper Pulp Test No. 5, a Bekk smoothness can be measured in a simple reproducible manner (Yamamoto et al., Journal of Paper and Pulp Technology Association, 20, 2, 17–24 (1966)).

In general, a photosensitive material is given a degree of matte using a matte agent. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinyl-benzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 $\mu$m to 30 $\mu$m are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the photosensitive material of the invention, the matte agent is preferably contained in an outermost surface layer, a layer functioning as an outermost surface layer, a layer close to the outer surface or a layer functioning as a so-called protective layer. A degree of matte may be controlled by changing the particle size and amount of the matte agent.

The degree of matte declines as the particle size or amount of the matte agent increases. Increasing the particle size of the matte agent is especially effective for reducing the degree of matte. For example, when a matte agent is added to a surface protective layer of cellulose acetate having a thickness of 2 μm, a degree of matte within the range of the invention is acquired by adding a matte agent having a particle size of 3 to 20 μm so as to provide a coverage of 5 to 1,000 mg/m$^2$. Since the relationship of a degree of matte to the amount of matte agent added varies with the thickness of a surface protective layer, type of binder and coating technique, an optimum amount of matte agent added is determined for a particular photosensitive material in accordance with the desired degree of matte.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), polyvinyl chloride, poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), polyesters, polyurethanes, phenoxy resins, poly(vinylidene chloride), polyepoxides, polycarbonates, poly(vinyl acetate), cellulose esters, and polyamides. The binder may be dissolved or emulsified in water or organic solvent to form a solution or dispersion which is coated to form a layer.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

Next, the photosensitive silver halide is described. A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is preferably up to 0.20 μm, more preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. The metal complex is preferably contained in an amount of 1 nmol to 10 mmol, more preferably 10 nmol to 100 μmol per mol of silver. Illustrative metal complex structures are those described in JP-A 225449/1995. Preferred among cobalt and iron complexes are hexacyano metal complexes. Illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl)tellurides, bis(oxycarbonyl)ditellurides, bis(carbamoyl)ditellurides, compounds having a P═Te bond, tellurocarboxylic salts, Te-organyltellurocarboxylic esters, di(poly)tellurides, tellurides, telluroles, telluroacetals, tellurosulfonates, compounds having a P—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

The photothermographic material of the present invention is preferably a one side photosensitive material having at least one photosensitive layer containing a silver halide emulsion on one surface of a support and a backing layer (or back layer) on the other surface.

In the present invention, a matte agent may be added to the one side photosensitive material for improving transportation. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the backing layer should preferably have a degree of matte as expressed by a Bekk smoothness of up to 3,000 seconds, more preferably 10 to 250 seconds, especially 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the practice of the invention, the backing layer preferably has a maximum absorbance of 0.3 to 2 in a desired wavelength range, more preferably an IR absorbance of 0.5 to 2 and an absorbance of 0.001 to less than 0.5 in the visible range. Most preferably it is an anti-halation layer having an optical density of 0.001 to less than 0.3.

Where anti-halation dyestuffs are used in the practice of the invention, such a dyestuff may be any compound which has sufficiently low absorption in the visible region and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a photothermographic image system according to the present invention.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the photosensitive layer or a protective layer therefor according to the invention, there may be used light absorbing substances and filter dyes as described in U.S. Pat. Nos. 3,253,921, 2,274,782, 2,527,583, and 2,956,879. The dyestuffs may be mordanted as described in U.S. Pat. No. 3,282,699.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 1,000 to 10,000 seconds, especially 2,000 to 10,000 seconds is preferred.

The emulsion layer is based on a binder. Exemplary binders are naturally occurring polymers and synthetic resins, for example, gelatin, polyvinyl alcohol, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to hold various components. The effective range may be properly determined by those skilled in the art without undue experimentation. Taken at least as a measure for holding the organic silver salt in the film, the weight ratio of the binder to the organic silver salt is preferably in the range of from 15:1 to 1:2, more preferably from 8:1 to 1:1.

With respect to the binder for the photosensitive layer and other hydrophilic colloid layers, the binders described in JP-A 18542/1990 may be used.

Where the support used herein is made of a solvent resistant plastic material which is not dissolved or swollen in an organic solvent used in the coating of photosensitive material, various coating layers may be formed from a coating solution of components in an organic solvent. However, where the support is made of a plastic material which can be dissolved or swollen in an organic solvent, various coating layers are desirably formed from a dispersion of components in water. In the latter case, a less aggressive organic solvent can, of course, be used in a non-influential amount.

A water dispersion of components for coating may be prepared as follows.

(1) A first procedure is by preparing a water dispersion of a thermoplastic resin as a binder (for example, a water dispersion or emulsion of polyvinyl butyral, polyurethane or polyvinyl acetate) and adding organic silver salt, silver halide, reducing agent and other additives to the dispersion.

(2) A second procedure is by adding such additives to a thermoplastic resin solution and dispersing in water.

More particularly, a water dispersion of a thermoplastic resin may be formed by any well-known dispersion method. For example, an aqueous dispersion is prepared by adding 5 to 80% by weight of a plasticizer (e.g., saturated or unsaturated higher fatty acid ester) to resin powder, adding 1 to 30% by weight of an alkylarylsulfonate as a dispersant, heating the mixture at a temperature above Tg for dissolving solids, agitating the solution in an emulsifying/dispersing machine while gradually adding water, thereby once forming a dispersion of water-in-resin type, and further gradually adding water to induce phase transition, thereby forming a dispersion of resin-in-water type. Preferably the dispersion has as small a particle size as possible. The particle size can be controlled by adjusting the viscosity of a resin solution phase and the shearing force of the dispersing machine. Preferably the dispersion is comminuted to a mean particle size of less than 1 $\mu$m.

There may be used commercially available water dispersions, for example, aqueous dispersions of polyvinyl butyral available under the trade name of Butvar Dispersion FP and BR from Monsanto Co. and water dispersions of polyurethane available under the trade name of Adeka Bon-Tighter HUX-350, 232, 551, 290H, and 401 from Asahi Denka Kogyo K.K.

In the practice of the invention, the thermoplastic resin is used in such a range that it may effectively function as a binder. The effective range may be properly determined by those skilled in the art without undue experimentation. Taken at least as a measure for holding the organic silver salt in the film, the weight ratio of the binder to the organic silver salt is preferably in the range of from 15:1 to 1:2, more preferably from 8:1 to 1:1.

EXAMPLES

Examples of the invention are given below by way of illustration and not by way of limitation.

Example 1

Preparation of Back-Coated Support

On a back surface of a polyethylene naphthalate film and a polyethylene terephthalate film both of 100 $\mu$m thick, aqueous solutions of the following composition were concurrently coated to form a back layer and a back surface protective layer in an overlapping manner. Note that the coverage of components is per square meter of the film. The back layer contained 1.5 grams of gelatin, 30 mg of sodium p-dodecylbenzenesulfonate, 100 mg of 1,2-bis (vinylsulfonylacetamide)ethane, 50 mg of dyestuff (a), 100 mg of dyestuff (b), 30 mg of dyestuff (c), 50 mg of dyestuff (d), and 1 mg of proxisel. The back surface protective layer contained 1.5 grams of gelatin, 20 mg of polymethyl methacrylate having a mean particle size of 2.5 μm, 15 mg of sodium p-dodecylbenzenesulfonate, 15 mg of sodium dihexyl-α-sulfosuccinate, 50 mg of sodium acetate, and 1 mg of proxisel.

Dyestuffs (a), (b), (c), and (d) are shown below.

Dyestuff (a)

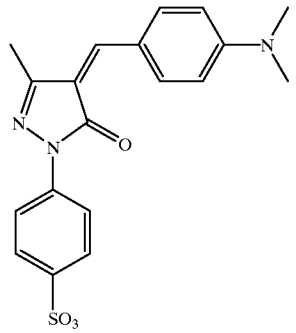

Dyestuff (b)

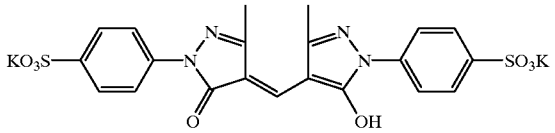

Dyestuff (c)

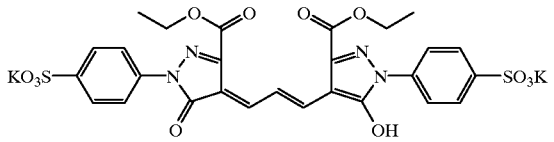

Dyestuff (d)

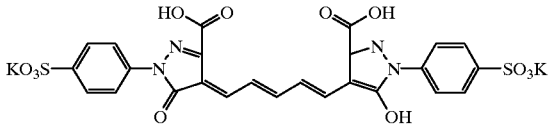

Preparation of Organic Silver Salt Emulsion

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K by Denki Kagaku Kogyo K.K.). The dispersion was further dispersed in 600 grams of polyvinyl butyral (Denka Butyral #4000-2 by Denki Kagaku Kogyo K.K.) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Preparation of Photosensitive Layer Coating Solution

Various chemicals were added to the above-prepared organic acid silver salt emulsion as follows. It is noted that the amounts of chemicals added are expressed per mol of silver. With stirring 25° C., 10 mg of sodium phenylthiosulfonate, 70 mg of dye (a), 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. Then, 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound (a), 0.3 mol of reducing agent (R-I-5), and $6.5\times10^{-3}$ mol of ultrahigh contrast promoting agent (I-65) were added. With stirring, 5 grams of tetrachlorophthalic acid, 1.1 grams of Megafax F-176P (fluorinated surfactant by Dai-Nihon Inn Chemical Industry K.K.), 590 grams of 2-butanone and 10 grams of methyl isobutyl ketone were added.

This is designated photosensitive layer coating solution A. Dye (a) and disulfide compound (a) are shown below.

Dye (a)

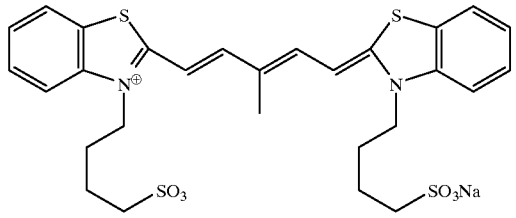

Disulfide compound (a)

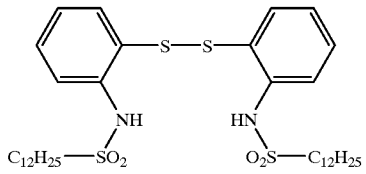

For comparison purposes, a photosensitive layer coating solution B was prepared as above except that the ultrahigh contrast promoting agent I-65 was omitted.

Photosensitive Layer Surface Protective Layer Coating Solution

A coating solution was prepared by dissolving 75 grams of CAB 171-15S (cellulose acetate butyrate by Eastman Chemical Products, Inc.), 5.7 grams of 4-methylphthalic acid, 1.5 grams of tetrachlorophthalic anhydride, 12.5 grams of phthalazine, 0.3 grams of Megafax F-176P, 2 grams of Sildex H31 (spherical silica by Dokai Chemical K.K., mean particle size 3 μm), and 7 grams of Sumidur N3500 (polyisocyanate by Sumitomo-Bayern Urethane K.K.) in 3,070 grams of 2-butanone and 30 grams of ethyl acetate.

Coating on Photosensitive Layer Surface

On the back coated support, the photosensitive layer coating solution was applied to the opposite surface to form a photosensitive layer in a coverage of 2 g/m$^2$ of silver. The protective layer coating solution was applied onto the photosensitive layer to form a protective layer having a dry thickness of 2 $\mu$m. The combination of the support with the photosensitive layer coating solution is shown in Table 9.

TABLE 9

| No. | Support | Emulsion layer coating solution | Ultrahigh contrast promoting agent | Dmax | γ | Color shift |
|---|---|---|---|---|---|---|
| 1 | PET | A | used | 4.83 | 13.5 | Rejected |
| 2 | PET | B | not used | 2.35 | 2.5 | OK |
| 3 | PEN | A | used | 4.85 | 13.5 | OK |
| 4 | PEN | B | not used | 2.35 | 2.5 | OK |

With respect to the construction, only sample No. 3 falls within the scope of the invention while sample Nos. 1, 2, and 4 are comparative samples.

Tests

A photosensitive material sample was exposed by means of a 633-nm He—Ne laser sensitometer and heated at 120° C. for 25 seconds for heat development to produce an image which was measured for maximum density (Dmax) and gradient (γ) by means of a densitometer. Note that γ is the gradient of a straight line connecting points of density 0.3 and 3.0 on a characteristic curve. The results are shown in Table 9.

A dimensional change before and after heat development was measured. Sample Nos. 1 and 2 underwent a shrinkage of 0.15% in a longitudinal direction and an expansion of 0.08% in a transverse direction. Sample Nos. 3 and 4 showed very good dimensional stability as demonstrated by a shrinkage of 0.006% in a longitudinal direction and an expansion of 0.005% in a transverse direction.

A false setting of color registration was evaluated by exposing two specimens for each sample to light through a screen tint so as to provide a dot area of 30%, with the two specimens oriented at an angle of 90°, and heating the specimens at 120° C. for 25 seconds for development. Using the thus obtained image, a positive presensitized (PS) plate was printed. Two color printing was done on paper using a magenta color printing ink and a cyan color printing ink. The printed paper was visually observed for false setting of color registration. A sample was rated "OK" when no false setting of color registration was observed and "Rejected" when a definite false setting of color registration was observed. The results are shown in Table 9.

Sample No. 3 showed high Dmax, high γ, sharp dots and no false setting of color registration. In sample Nos. 2 and 4, a definite false setting of color registration was not acknowledged due to blunt dots. Sample No. 1 showed sharp dots and a definite false setting of color registration.

Example 2

A photothermographic material was prepared as in Example 1 except that a polyarylate film of 100 $\mu$m thick was used as the support. On similar measurement, equivalent results to Example 1 were obtained.

Example 3

Photosensitive material samples were prepared by coating an aqueous dispersion on polyether sulfone (PES) and polyether ether ketone (PEEK) supports.

Preparation of Photosensitive Silver Halide Grains C

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 96:4 were added over 10 minutes by a controlled double jet method while maintaining the solution at pAg 7.7. At the same time as the start of silver nitrate addition, a salt of hexacyanoferrate(III) and a complex salt of hexachloroiridate(III) were added over 5 minutes in an amount of $1\times10^{-5}$ mol/mol of Ag. Thereafter, 0.3 gram of 4-hydroxy-6-methyl-1,3,3a,7-tetraazaindene was added to the solution, which was adjusted to pH 5 with NaOH. There were obtained cubic silver iodobromide grains C having a mean grain size of 0.06 $\mu$m, a coefficient of variation of projected area diameter of 8%, and a (100) plane ratio of 87%. The emulsion was desalted by adding a gelatin flocculant thereto to cause flocculation and sedimentation. 0.1 gram of phenoxyethanol was added to adjust the emulsion to pH 5.9 and pAg 7.5.

Preparation of Photosensitive Emulsion C Containing Organic Fatty Acid Silver

Behenic acid, 10.6 grams, was dissolved in 300 ml of water by heating at 90° C. With thorough stirring, 31.1 ml of 1N sodium hydroxide was added to the solution, which was allowed to stand at the temperature for one hour. The solution was then cooled to 30° C., 7.0 ml of 1N phosphoric acid was added thereto, and with thorough stirring, 0.13 gram of N-bromosuccinimide was added. Thereafter, with stirring, the above-prepared silver halide grains C were added to the solution heated at 40° C. in such an amount as to give 10 mol % of silver based on the behenic acid. Further, 25 ml of 1N silver nitrate aqueous solution was continuously added over 2 minutes. With stirring continued, the dispersion was allowed to stand for one hour.

Excess salts were removed from the aqueous dispersion by filtration. To the resulting wet dispersion, an aqueous dispersion of polyvinyl butyral, Butvar Dispersion FP was added in such an amount as to give 5 grams of polyvinyl butyral per gram of silver behenate. The mixture was dispersed again by means of a ultrasonic mixer.

Preparation of Coated Sample

Coating on the Back Surface Side

An aqueous coating solution of the following composition was coated so as to give a coverage of 5 g/m$^2$ of polyvinyl alcohol.

| | |
|---|---|
| Polyvinyl alcohol | 6.0 g |
| Water | 100 ml |
| Boric acid | 0.2 g |
| Dye S-1 | 0.05 g |

dye S-1

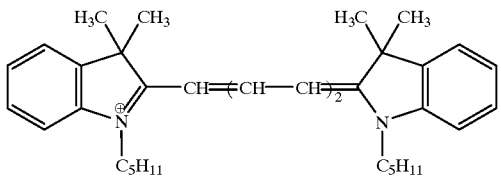

-continued

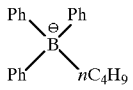

Coating on the Photosensitive Layer side

A photosensitive layer and a surface protective layer were concurrently coated in an overlapping manner.

The photosensitive layer was formed by coating an aqueous coating solution of the following composition so as to give a coverage of 1.5 g/m$^2$ of silver.

| | |
|---|---|
| Photosensitive emulsion C | 73 g |
| Sensitizing dye-1 (0.05% in methanol) | 2 ml |
| Antifoggant-1 (0.01% in methanol) | 3 ml |
| Antifoggant-2 (1.5% in methanol) | 8 ml |
| Antifoggant-3 (2.4% in DMF) | 5 ml |
| Dispersion of phthalazine and reducing agent-1 in water (solids 28 wt %) | 10 g |
| Hydrazine derivative H-1 (1% in methanol) | 1 ml |

The compounds used herein are as shown below.

sensitizing dye-1

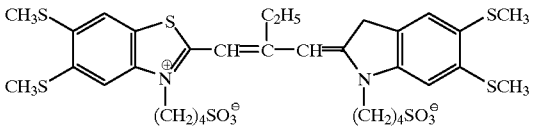

antifoggant-1

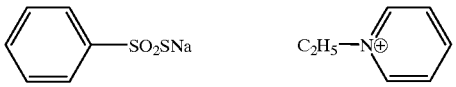

antifoggant-2

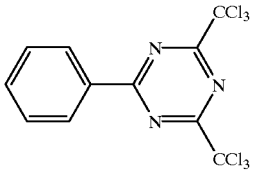

antifoggant-3

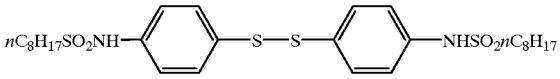

reducing agent-1

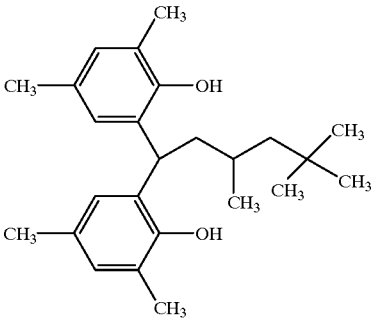

-continued hydrazine derivative H-1

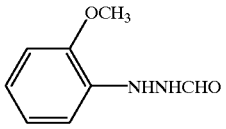

The dispersion of phthalazine and reducing agent-1 in water was prepared by adding 4.6 grams of a dispersant Demol SN-B (trade name, Kao Corporation) to 5.0 grams of phthalazine and 18 grams of developing agent-1, adding 72 ml of water thereto, and agitating the mixture in a sand mill with glass beads as a medium. The dispersion had a mean particle size of 0.3 $\mu$m.

The surface protective layer was formed by coating a solution of the following composition to a wet coating thickness of 100 $\mu$m.

| | |
|---|---|
| Water | 190 ml |
| Silica (mean particle size 3.0 $\mu$m) | 0.2 g |
| Polyvinyl alcohol | 8.0 g |
| 4-methylphthalic acid | 0.72 g |
| Tetrachlorophthalic acid | 0.8 g |
| Sodium dodecylbenzenesulfonate | 2.0 g |

The thus coated sample was evaluated as in Example 1, finding high Dmax, sharp dots, and no false setting of color registration.

TABLE 10

| Support | Dmax | γ | False setting of color registration |
|---|---|---|---|
| PES | 3.92 | 11.3 | OK |
| PEEK | 3.95 | 11.7 | OK |

Photothermographic material samples were prepared as in Example 1 except that ultrahigh contrast promoting agents I-75, I-57, I-48, I-27, I-21 and I-16 were used instead of the agent I-65. On measurement, these samples showed equivalent results to Example 1.

By using a plastic film having a Tg of at least 90° C. as a support, a photothermographic material is improved in dimensional stability so that a false setting of color registration is eliminated.

Example 4

Preparation of Organic Acid Silver Salt Emulsion

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K by Denki Kagaku Kogyo K.K.). The dispersion was further dispersed in 600 grams of polyvinyl butyral (Denka Butyral #4000-2 by Denki Kagaku Kogyo K.K.) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Preparation of Emulsion Layer Coating Solution

Various chemicals were added to the above-prepared organic acid silver salt emulsion as follows. It is noted that the amounts of chemicals added are expressed per mol of silver. With stirring 25° C., 10 mg of sodium phenylthiosulfonate, 70 mg of dye (a), 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. Then, 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound (a), 0.3 mol of reducing agent (R-I-5), and $6.5\times10^{-3}$ mol of ultrahigh contrast promoting agent (I-65) were added. With stirring, 5 grams of tetrachlorophthalic acid, 1.1 grams of Megafax F-176P (fluorinated surfactant by Dai-Nihon Ink Chemical Industry K.K.), 590 grams of 2-butanone and 10 grams of methyl isobutyl ketone were added.

Dye (a) and disulfide compound (a) are as shown in Example 1.

Emulsion Surface Protective Layer Coating Solution

A coating solution was prepared by dissolving 75 grams of CAB 171-15S (cellulose acetate butyrate by Eastman Chemical Products, Inc.), 5.7 grams of 4-methylphthalic acid, 1.5 grams of tetrachlorophthalic anhydride, 12.5 grams of phthalazine, 0.3 gram of Megafax F-176P, 2 grams of Sildex H31 (spherical silica by Dokai Chemical K.K., mean particle size 3 μm), and 7 grams of Sumidur N3500 (polyisocyanate by Sumitomo-Bayern Urethane K.K.) in 3,070 grams of 2-butanone and 30 grams of ethyl acetate.

Preparation of Back-Coated Support

On a polyethylene terephthalate (PET) film of 100 μm thick having an undercoat layer of vinylidene chloride on either surface, a conductive layer and a protective layer both of the composition shown below were successively coated in the described order.

| | |
|---|---|
| Conductive layer | |
| Jurimer ET-410 (polyacrylate, Nihon Junyaku K.K.) | 38 mg/m$^2$ |
| $SnO_2$/Sb (9/1 weight ratio, mean particle size 0.25 μm) | 216 mg/m$^2$ |
| Compound-1 | 5 mg/m$^2$ |
| Compound-2 | 5 mg/m$^2$ |
| Protective layer | |
| Chemipearl S-120 (aqueous dispersion of polyolefin, Mitsui Petro-Chemical K.K.) | 33 mg/m$^2$ |
| Matte agent (polymethyl methacrylate particles, mean particle size 5.0 μm) | 20 mg/m$^2$ |
| Snowtex C (silica, Nissan Chemical K.K.) | 17 mg/m$^2$ |

-continued

| | |
|---|---|
| Compound-1 | 5 mg/m$^2$ |
| Compound-3 | 5 mg/m$^2$ |
| Sodium polystyrene sulfonate | 2 mg/m$^2$ |
| Megafax F-176P | 3 mg/m$^2$ |

Compound-1, 2 and 3 used herein are shown below.

compound-1

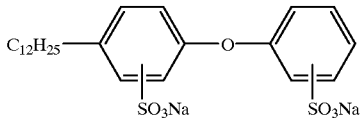

compound-2

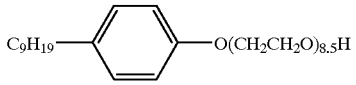

compound-3

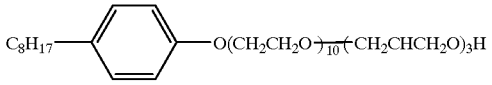

Coating on Photosensitive Layer Surface

After the conductive and protective layers were coated on the back surface of the support, the emulsion layer coating solution was applied on the opposite surface of the support to form an emulsion layer in a coverage of 2 g/m$^2$ of silver. The emulsion surface protective layer coating solution was applied onto the emulsion layer to form a protective layer having a dry thickness of 2 μm. This is designated sample No. 201 within the preferred scope of the invention.

Preparation of Comparative sample

Comparative sample No. 201A was prepared by the same procedure as sample No. 201 except that instead of the conductive and protective layers coated on the back surface of the support in sample No. 201, aqueous solutions of the following composition were successively coated to form a back layer and a back surface protective layer. Note that the coverage of components is per square meter of the film. The back layer contained 1.5 grams of gelatin, 30 mg of sodium p-dodecylbenzenesulfonate, 100 mg of 1,2-bis (vinylsulfonylacetamide)ethane, 50 mg of dyestuff (a), 100 mg of dyestuff (b), 30 mg of dyestuff (c), 50 mg of dyestuff (d), and 1 mg of proxisel. The back surface protective layer contained 1.5 grams of gelatin, 20 mg of polymethyl methacrylate having a mean particle size of 2.5 μm, 15 mg of sodium p-dodecylbenzenesulfonate, 15 mg of sodium dihexyl-α-sulfosuccinate, 50 mg of sodium acetate, and 1 mg of proxisel.

Dyestuffs (a), (b), (c), and (d) are as shown in Example 1.

Tests

Measurement of Surface Resistivity

At the stage when the conductive layer or back layer was coated on the back surface, the sample was measured for surface electric resistivity. Measurement was done by allowing a specimen to stand in an atmosphere of 25° C. and RH 25% for 12 hours, placing the specimen between brass electrodes of 10 cm long spaced a gap of 0.14 cm (the surface of each electrode to come in contact with the specimen was lined with stainless steel), and measuring surface resistivity after 1 minute by means of an electrometer TR8651 by Takeda Riken K.K. Sample No. 201 has a surface resistivity of $10^8\Omega$ and comparative sample No.

201A has a surface resistivity of $10^{15}\Omega$. Upon heat development, sample No. 201 encountered less troubles including deposition of debris and adhesion to the photothermographic machine by electrostatic charging.

Photographic Properties

A photosensitive material sample was exposed by means of a 633-nm He—Ne laser sensitometer and heat developed by contacting the back surface with a heating drum at 120° C. for 20 seconds. The resulting image was measured for Dmax, Dmin and γ by means of a densitometer. Note that γ is the gradient of a straight line connecting points of density 0.3 and 3.0 on a characteristic curve. The results are shown in Table 11.

TABLE 11

| Sample No. | Dmax | Dmin | γ |
|---|---|---|---|
| 201 | 4.35 | 0.19 | 13.7 |
| 201A | 4.29 | 0.19 | 13.5 |

It is evident that both samples show high Dmax and high contrast.

Pepper Fog

Pepper fog was evaluated by carrying out development at 120° C. for a varying time of 18, 20, 25, and 30 seconds. The pepper fog count was determined by observing the image through a 25× magnifier and counting black spots within a circle of 3 mm in diameter. The results are shown in Table 12.

TABLE 12

| | Pepper fog count upon development at 120° C. for | | | |
|---|---|---|---|---|
| Sample No. | 18 sec. | 20 sec. | 25 sec. | 30 sec. |
| 201 | 1 | 3 | 4 | 10 |
| 201A | 1 | 5 | 11 | 43 |

It is evident that fewer black spots generated in sample No. 201 within the preferred scope of the invention than in the comparative sample.

Dot Variation

The sample was exposed to xenon flash light through an interference filter having a peak at 633 nm so as to provide a dot area of about 10% and heat developed at 120° C. for 20 seconds. The resulting dot film was visually observed for uniformity. High and low density regions were locally distributed in comparative sample No. 201A whereas sample No. 201 was regarded uniform without a perceivable density variation. The film of comparative sample No. 201A was found distorted at the end of development whereas the film of sample No. 201 was free of distortion and remained satisfactorily flat.

Example 5

Samples were prepared as in Example 4 except that ultrahigh contrast promoting agents I-75, I-77, I-57, I-48, I-27, I-21 and I-16 were used instead of the agent I-65. These samples gave satisfactory results equivalent to sample No. 201.

Example 6

Sample No. 203 was prepared as in Example 4 except that the conductive layer and the protective layer thereon were omitted, and instead, a conductive layer of the following composition was coated.

| Conductive layer | |
|---|---|
| Jurimer ET-410 (polyacrylate, Nihon Junyaku K.K.) | 38 mg/m$^2$ |
| $SnO_2$/Sb (9/1 weight ratio, mean particle size 0.25 μm) | 216 mg/m$^2$ |
| Compound-1 | 5 mg/m$^2$ |
| Compound-2 | 5 mg/m$^2$ |
| Compound-3 | 5 mg/m$^2$ |
| Matte agent (polymethyl methacrylate particles, mean particle size 5.0 μm) | 20 mg/m$^2$ |
| Megafax F-176P | 3 mg/m$^2$ |

Sample No. 203 was measured for surface resistivity as in Example 4. Its surface resistivity was as low as $6.0\times10^7\Omega$, indicating minimal troubles upon heat development including deposition of debris and adhesion to the photothermographic machine by electrostatic charging.

Sample No. 203 was also examined for photographic properties, pepper fog, and dot variation as in Example 4. The results are shown in Tables 13 and 14. It is evident from Tables 13 and 14 that the pepper fog count is further reduced. No problem was found with respect to dot variation.

Example 7

Sample No. 204 was prepared as in Example 4 except that an overcoat (OC) layer of the following composition was coated on the emulsion surface protective layer.

| | |
|---|---|
| CAB 171-15S | 51 mg/m$^2$ |
| $SnO_2$/Sb (9/1 weight ratio, mean particle size 0.25 μm) | 187 mg/m$^2$ |

Sample No. 204 on the emulsion-bearing side was measured for surface resistivity as in Example 4. Its surface resistivity on the emulsion-bearing side was as low as $2.5\times10^7\Omega$, indicating minimal deposition of debris by electrostatic charging.

Sample No. 204 was also examined for photographic properties, pepper fog, and dot variation as in Example 4. The results are shown in Tables 13 and 14. It is evident from Tables 13 and 14 that the pepper fog count is further reduced. No problem was found with respect to dot variation.

Additional samples were prepared as in Examples 6 and 7 except that ultrahigh contrast promoting agents I-75, I-77, I-57, I-48, I-27, I-21 and I-16 were used instead of the agent I-65. These samples gave satisfactory results equivalent to sample Nos. 203 and 204.

Example 8

Preparation of Photosensitive Silver Halide Grains C

In 900 ml of water were dissolved 7.5 grams of inert gelatin and 10 mg of potassium bromide. The solution was adjusted to pH 3.0 at a temperature of 350° C. To the solution, 370 ml of an aqueous solution containing 74 grams of silver nitrate and an aqueous solution containing potassium bromide and potassium iodide in a molar ratio of 96:4 were added over 10 minutes by a controlled double jet method while maintaining the solution at pAg 7.7. At the same time as the start of silver nitrate addition, a salt of hexacyanoferrate(III) and a complex salt of hexachloroiridate(III) were added over 5 minutes in an amount of $1\times10^{-5}$ mol/mol of Ag. Thereafter, 0.3 gram of 4-hydroxy-6-methyl-1,3,3a,7-tetraazaindene was added to the solution, which was adjusted to pH 5 with NaOH. There were obtained cubic silver iodobromide grains C having a mean grain size of 0.06 μm, a coefficient of variation of projected area diameter of 8%, and a (100) plane ratio of 87%. The emulsion was desalted by adding a gelatin flocculant thereto to cause flocculation and sedimentation. 0.1 gram of phenoxyethanol was added to adjust the emulsion to pH 5.9 and pAg 7.5.

Preparation of Photosensitive Emulsion C Containing Organic Fatty Acid Silver

Behenic acid, 10.6 grams, was dissolved in 300 ml of water by heating at 90° C. With thorough stirring, 31.1 ml of 1N sodium hydroxide was added to the solution, which was allowed to stand at the temperature for one hour. The solution was then cooled to 30° C., 7.0 ml of 1N phosphoric acid was added thereto, and with thorough stirring, 0.13 gram of N-bromosuccinimide was added. Thereafter, with stirring, the above-prepared emulsion of silver halide grains C was added to the solution heated at 40° C. in such an amount as to give 10 mol % of silver based on the behenic acid. Further, 25 ml of 1N silver nitrate aqueous solution was continuously added over 2 minutes. With stirring continued, the dispersion was allowed to stand for one hour.

Excess salts were removed from the aqueous dispersion by filtration. To the resulting wet dispersion, a polystyrene-butadiene latex JSR #1500 (Nippon Synthetic Rubber K.K.) was added in such an amount as to give 5 grams of polymer solids per gram of silver behenate. The mixture was dispersed again by means of a ultrasonic mixer.

Preparation of Coated Sample

Coating on the Back Surface Side

An aqueous coating solution of the following composition was coated on the same support as in Example 4 to form a back layer in a coverage of 5 g/m$^2$ of polyvinyl alcohol.

| Back layer | |
|---|---|
| Polyvinyl alcohol | 6.0 g |
| Water | 100 ml |
| Boric acid | 0.2 g |
| Dye S-1 (see Example 1) | 0.05 g |

A back overcoat layer of the following composition was coated on the back layer.

| Back overcoat layer | |
|---|---|
| Hydroxyethyl cellulose | 38 mg/m$^2$ |
| $SnO_2$/Sb (9/1 weight ratio, mean particle size 0.25 μm) | 210 mg/m$^2$ |
| Sodium dodecylbenzenesulfonate | 5 mg/m$^2$ |

Coating on the Photosensitive Layer Side

A photosensitive layer and a surface protective layer were concurrently coated in an overlapping manner on the opposite surface of the support to the back layer.

The photosensitive layer was formed by coating an aqueous coating solution of the following composition so as to give a coverage of 2.0 g/m$^2$ of silver.

Photosensitive emulsion C 73 g

Sensitizing dye-1 (0.05% in methanol) 2 ml

Antifoggant-1 (0.01% in methanol) 3 ml

Antifoggant-2 (1.5% in methanol) 8 ml

Antifoggant-3 (2.4% in DMF) 5 ml

Dispersion of phthalazine and developing agent-1 in water (solids 28 wt %) 10 g

Hydrazine derivative I-58 (1% in methanol) 2 ml

The compounds used herein are as shown in Example 3.

The dispersion of phthalazine and developing agent-1 in water was prepared by adding 4.6 grams of a dispersant Demol SN-B (trade name, Kao Corporation) to 5.0 grams of phthalazine and 18 grams of developing agent-1, adding 72 ml of water thereto, and agitating the mixture in a sand mill with glass beads as a medium. The dispersion had a mean particle size of 0.3 μm.

The surface protective layer was formed by coating a solution of the following composition to a wet coating thickness of 100 μm.

| | |
|---|---|
| Water | 190 ml |
| Silica (mean particle size 3.0 μm) | 0.2 g |
| Polyvinyl alcohol | 8.0 g |
| 4-methylphthalic acid | 0.72 g |
| Tetrachlorophthalic acid | 0.8 g |
| Sodium dodecylbenzenesulfonate | 2.0 g |

The coatings were dried at 60° C. for 2 minutes, completing a photothermographic material sample No. 205.

Sample No. 205 on the emulsion-bearing side was measured for surface resistivity as in Example 4. Its surface resistivity on the emulsion-bearing side was as low as $2.0\times10^7\Omega$, indicating minimal deposition of debris by electrostatic charging.

Sample No. 205 was also examined for photographic properties, pepper fog, and dot variation as in Example 4. The results are shown in Tables 13 and 14.

TABLE 13

| Sample No. | Dmax | Dmin | γ |
|---|---|---|---|
| 203 | 4.38 | 0.18 | 13.7 |
| 204 | 4.51 | 0.19 | 14.3 |
| 205 | 5.01 | 0.20 | 14.5 |

TABLE 14

| | Pepper fog count upon development at 120° C. for | | | |
|---|---|---|---|---|
| Sample No. | 18 sec. | 20 sec. | 25 sec. | 30 sec. |
| 203 | 1 | 3 | 4 | 8 |
| 204 | 1 | 3 | 4 | 7 |
| 205 | 1 | 2 | 3 | 5 |

The data in Tables 13 and 14 show high Dmax and reduced pepper fog count. No problem was found with respect to dot variation.

The embodiment wherein a conductive polymer layer is provided is effective for improving photographic properties and preventing the occurrence of pepper fog and image variation. The photothermographic material is suitable for the manufacture of printing plates.

Example 9

Preparation of Silver Halide Grains D

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 96:4 were added over 10 minutes by a controlled double jet method while maintaining the solution at pAg 7.7. At the same time as the start of silver nitrate addition, a salt of hexacyanoferrate(III) and a complex salt of hexachloroiridate(III) were added over 5 minutes in an amount of $1\times10^{-5}$ mol/mol of Ag. Thereafter, 0.3 gram of 4-hydroxy-6-methyl-1,3,3a,7-tetraazaindene was added to the solution, which was adjusted to pH 5 with NaOH. There were obtained cubic silver iodobromide grains D having a mean grain size of 0.06 $\mu$m, a coefficient of variation of projected area diameter of 8%, and a (100) plane ratio of 87%. The emulsion was desalted by adding a gelatin flocculant thereto to cause flocculation and sedimentation. 0.1 gram of phenoxyethanol was added to adjust the emulsion to pH 5.9 and pAg 7.5.

Preparation of Organic Fatty Acid Silver Emulsion D

Behenic acid, 10.6 grams, was dissolved in 300 ml of water by heating at 90° C. With thorough stirring, 31.1 ml of 1N sodium hydroxide was added to the solution, which was allowed to stand at the temperature for one hour. The solution was then cooled to 30° C., 7.0 ml of 1N phosphoric acid was added thereto, and with thorough stirring, 0.13 gram of N-bromosuccinimide was added. Thereafter, with stirring, the above-prepared silver halide grains D were added to the solution heated at 40° C. in such an amount as to give 10 mol % of silver based on the behenic acid. Further, 25 ml of 1N silver nitrate aqueous solution was continuously added over 2 minutes. With stirring continued, the aqueous mixture was allowed to stand for one hour.

With stirring, 37 grams of a 1.2 wt % n-butyl acetate solution of polyvinyl acetate was slowly added to the aqueous mixture to form blocks of dispersion. Water was removed, and water washing and water removal were repeated twice. With stirring, 20 grams of a solution of 2.5% by weight polyvinyl butyral (average molecular weight 3,000) in a 1/2 solvent mixture of butyl acetate and isopropyl alcohol was added. To the thus obtained gel-like mixture of silver behenate and silver halide, 12.5 grams of polyvinyl butyral (average molecular weight 4,000) and 57 grams of isopropyl alcohol were added. The mixture was dispersed.

Preparation of coated Sample

A sample was prepared by successively forming layers on a heat-treated polyethylene terephthalate support. Coatings were dried at 75° C. for 5 minutes.

Back Layer

A coating solution of the following composition was coated on the back surface of the support opposite to the photosensitive layer to a wet thickness of 100 $\mu$m.

| | |
|---|---|
| 10% isopropyl alcohol solution of polyvinyl butyral (#4000-2, Denki Kagaku Kogyo K.K.) | 60 g |
| Isopropyl alcohol | 10 g |
| 8% ethyl acetate solution of 3-isocyanato-methyl-3,5,5-trimethylcyclohexyl isocyanate (Wako Junyaku K.K.) | 8 g |

A solution of 0.2 gram of dyestuff S-1 in 10 grams of methanol and 20 grams of acetone was added to a solution of the above composition so as to provide an absorbance of 0.8 at an exposure wavelength (670 nm).

dyestuff S-1

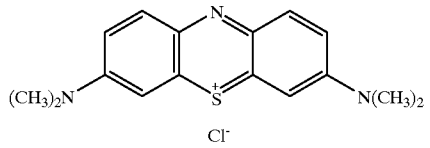

Photosensitive Layer

A photosensitive layer was formed by coating an aqueous coating solution of the following composition so as to give a coverage of 1.5 g/m$^2$ of silver.

Photosensitive emulsion D 73 g

Sensitizing dye D-1 (0.05% in methanol) 4 ml

Phthalazine (5% in methanol) 2.5 ml

Antifoggant-1 (1.7% in DMF) 2.5 ml

Reducing agent-1 (10% in acetone) 13 ml

Hydrazine derivative (1% in methanol) 2 ml 2-mercapto-5-methylbenzimidazole (0.5% in DMF) 5 ml $CaBr_2$ (0.3% in methanol) 6.5 ml Each of hydrazine derivatives H-1 to H-4 as shown below was used. Sensitizing dye D-1, antifoggant-1, and reducing agent-1 are shown below.

H-1

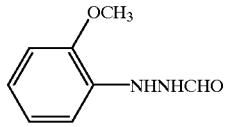

H-2

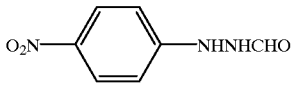

H-3

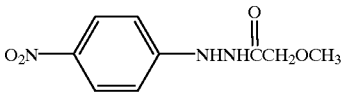

H-4

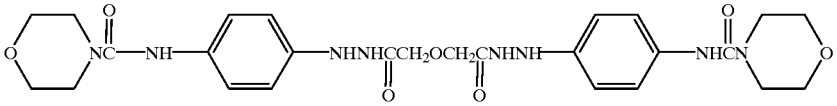

-continued sensitizing dye D-1

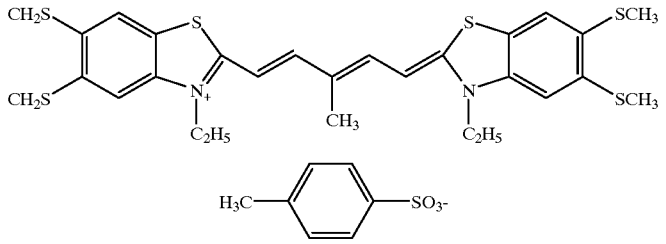

anitfoggant-1

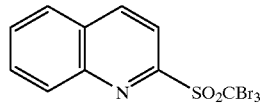

hydrazine derivative H-1

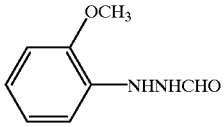

reducing agent-1

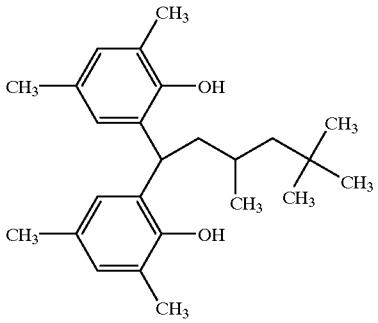

Surface Protective Layer

A solution of the following composition was coated on the photosensitive layer to a wet thickness of 100 μm.

| | |
|---|---|
| Acetone | 175 ml |
| Methanol | 15 ml |
| Cellulose acetate | 8.0 g |
| 4-methylphthalic acid | 0.72 g |
| Tetrachlorophthalic acid | 0.22 g |
| Tetrachlorophthalic anhydride | 0.5 g |

Back Surface Protective Layer le;2qA solution of the following composition was coated on the back layer (on the opposite side to the photosensitive layer) to a wet thickness of 100 μm.

| | |
|---|---|
| Acetone | 140 ml |
| 2-butanone | 70 ml |
| Methanol | 30 ml |
| Cellulose acetate | 9 g |

Four coating solutions were prepared by adding a varying amount of particulate polymethyl methacrylate having a particle size of 3 μm to the solution. Four back surface protective layers a, b, c and d having a Bekk smoothness of more than 10,000 sec. (free of polymethyl methacrylate), 5,000 to 4,500 sec., 4,000 to 3,500 sec., and up to 2,000 sec.

Sensitometry

The photothermographic material sample was exposed to xenon flash light for a light emission time of $10^{-3}$ second through an interference filter having a peak at 670 nm and heat developed on a heating drum at 115° C. for 15 seconds.

The image was examined for sensitivity and gradient (γ). The sensitivity is evaluated in terms of an inversion of an exposure dose providing a density of 3.0 and expressed by a relative value. Note that γ is the gradient of a straight line connecting points of density 0.1 and 1.5 on a characteristic curve, indicating the high contrast of toe gradation. The dyestuff in the back layer was extinguished by operating a halide lamp for 15 seconds after the heat development.

Feed Test

Each photosensitive material was cut into sections of 30.5 cm×25.4 cm with round corners having an inner radius of 0.5 cm. Film sections were kept in an atmosphere of 25° C. and RH 60% for 3 hours. An automatic feeder RN by Fuji Photo-Film Co., Ltd. was loaded with film sections and operated 100 times. The number of extra film sections fed was counted.

Natural Aging Storage Stability

Film sections cut as above were allowed to stand in an atmosphere of 25° C. and RH 50% for one day. A set of 10 overlapped film sections was placed in a bag of moisture-proof material which was sealed and maintained at 50° C. for 5 days (forced aging test). Storage stability was evaluated by measuring a fog density. For comparison purposes, film sections were subject to the same forced aging test except that they were stored at 4° C.

Natural aging storage stability was evaluated in terms of a percent increase of fog which is given as (fog of forcedly aged sample—fog of comparative sample)/(maximum density of comparative sample—density of support)×100%. The lower the percent increase of fog, the better is the natural aging storage stability.

The results are shown in Table 15.

TABLE 15

| Photosensitive material | Hydrazine derivative | Back layer | Bekk smoothness (sec.) | Sensitivity | γ | Feed | Fog increase upon forced aging |
|---|---|---|---|---|---|---|---|
| 1 (comparison) | — | a | ≧1,000 | 10 | 3 | 140 | 5 |
| 2 (comparison) | — | c | 4,000 −3,500 | 10 | 3 | 0 | 2.5 |
| 3 (comparison) | I-58 | a | ≧10,000 | 45 | 15 | 135 | 23 |
| 4 (comparison) | I-58 | b | 5,000 −4,500 | 47 | 15 | 16 | 21 |
| 5 | I-58 | c | 4,000 −3,500 | 45 | 16 | 0 | 1 |
| 6 | I-58 | b | 5,000 −4,500 | 48 | 16 | 10 | 1 |
| 7 | I-58 | d | ≦2,000 | 47 | 16 | 0 | 1 |
| 8 | I-65 | d | ≦2,000 | 50 | 17 | 0 | 1 |
| 9 | I-83 | d | ≦2,000 | 52 | 17 | 0 | 1 |
| 10 | I-84 | d | ≦2,000 | 50 | 17 | 0 | 1 |

As is evident from Table 15, samples within the scope of the present invention show high sensitivity, high i, a least increase of fog, and goof feed. In the absence of hydrazine, a Bekk smoothness of less than 4,000 seconds is less effective for suppressing fog increase. In the presence of hydrazine, a Bekk smoothness of less than 4,000 seconds becomes dramatically effective for storage stability.

Example 10

Photothermographic materials were prepared as in Example 9 except that hydrazine derivatives I-16, I-21, I-26, I-27, I-34, and I-57 were used instead of the hydrazine derivatives used in Example 9. A feed test was carried out. The results were equivalent to Example 9.

It is thus evident that when the outermost surface is adjusted to a Bekk smoothness in the preferred range of the invention, the photothermographic material is improved in storage stability and feed and produce ultrahigh contrast images with high Dmax and high contrast of toe gradation.

Example 11

Preparation of Silver Halide Grains E

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 96:4 were added over 10 minutes by a controlled double jet method while maintaining the solution at pAg 7.7. At the same time as the start of silver nitrate addition, a salt of hexacyanoferrate(III) and a complex salt of hexachloroiridate(III) were added over 5 minutes in an amount of $1\times10^{-5}$ mol/mol of Ag. Thereafter, 0.3 gram of 4-hydroxy-6-methyl-3,3a,7-tetraazaindene was added to the solution, which was adjusted to pH 5 with NaOH. There were obtained cubic silver iodobromide grains C having a mean grain size of 0.06 μm, a coefficient of variation of projected area diameter of 8%, and a (100) plane ratio of 87%. The emulsion was desalted by adding a gelatin flocculant thereto to cause flocculation and sedimentation. 0.1 gram of phenoxyethanol was added to adjust the emulsion to pH 5.9 and pAg 7.5.

Preparation of Organic Fatty Acid Silver Emulsion E

Behenic acid, 10.6 grams, was dissolved in 300 ml of water by heating at 90° C. With thorough stirring, 31.1 ml of 1N sodium hydroxide was added to the solution, which was allowed to stand at the temperature for one hour. The solution was then cooled to 30° C., 7.0 ml of 1N phosphoric acid was added thereto, and with thorough stirring, 0.13 gram of N-bromosuccinimide was added. Thereafter, with stirring, the above-prepared silver halide grains C were added to the solution heated at 40° C. in such an amount as to give 10 mol % of silver based on the behenic acid. Further, 25 ml of 1N silver nitrate aqueous solution was continuously added over 2 minutes. With stirring continued, the dispersion was allowed to stand for one hour.

With stirring, 37 grams of a 1.2 wt % n-butyl acetate solution of polyvinyl acetate was slowly added to the aqueous mixture to form blocks of dispersion. Water was removed, and water washing and water removal were repeated twice. With stirring, 20 grams of a solution of 2.5% by weight polyvinyl butyral (average molecular weight 3,000) in a 1/2 solvent mixture of butyl acetate and isopropyl alcohol was added. To the thus obtained gel-like mixture of silver behenate and silver halide, 12.5 grams of polyvinyl butyral (average molecular weight 4,000) and 57 grams of isopropyl alcohol were added. The mixture was dispersed.

Preparation of Coated Sample

Samples were prepared by successively forming layers on supports as shown in Table 16. Coatings were dried at 75° C. for 5 minutes.

The supports used were PEN, PC, PES, PAr, PEEK, PSF, SPS, and polyether PC and those supports which had been heat treated at 110° C. for 90 minutes. Also a PET support and heat treated PET supports were used. The PET supports were heat treated at 130° C. for 15 minutes while feeding at a rate of 20 m/min. under a varying tension of 15 kg/cm$^2$, 10 kg/cm$^2$, and 4 kg/cm$^2$.

Back Layer

A coating solution of the following composition was coated on the back surface of the support opposite to the photosensitive layer to a wet thickness of 100 μm.

10% isopropyl alcohol solution of polyvinyl butyral (#4000-2, Denki Kagaku Kogyo K.K.) 60 g Isopropyl alcohol 10 g 8% ethyl acetate solution of 3-isocyanatomethyl-3,5,5-trimethylcyclohexyl 8 g isocyanate (Wako Junyaku K.K.)

A solution of 0.2 gram of dyestuff S-1 in 10 grams of methanol and 20 grams of acetone was added to a solution of the above composition so as to provide an absorbance of 0.8 at an exposure wavelength (670 nm).

dyestuff S-1

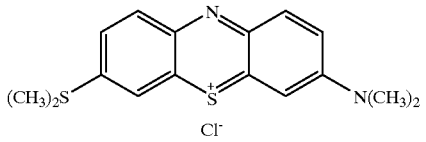

Photosensitive Layer

A photosensitive layer was formed by coating the support with an aqueous coating solution of the following composition so as to give a coverage of 1.5 g/m$^2$ of silver.

Photosensitive emulsion E 73 g

Sensitizing dye D-1 (0.05% in methanol) 4 ml

Phthalazine (5% in methanol) 2.5 ml

Antifoggant-1 (1.7% in DMF) 2.5 ml

Reducing agent-1 (10% in acetone) 13 ml

Hydrazine derivative H-1 (1% in methanol) 2 ml 2-mercapto-5-methylbenzimidazole (0.5% in DMF) 5 ml $CaBr_2$ (0.3% in methanol) 6.5 ml Sensitizing dye D-1, antifoggant-1, reducing agent-1, and hydrazine derivative H-1 are shown below.

sensitizing dye D-1

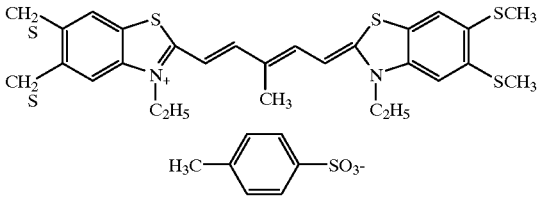

anitfoggant-1

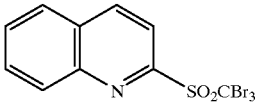

hydrazine derivative H-1

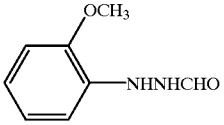

reducing agent-1

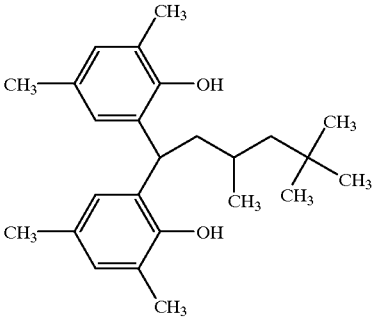

Surface Protective Layer

A solution of the following composition was coated on he photosensitive layer to a wet thickness of 100 $\mu$m.

| | |
|---|---|
| Acetone | 175 ml |
| Methanol | 15 ml |
| Cellulose acetate | 8.0 g |
| 4-methylphthalic acid | 0.72 g |
| Tetrachlorophthalic acid | 0.22 g |
| Tetrachlorophthalic anhydride | 0.5 g |

Sensitometry

The photothermographic material sample was exposed to xenon flash light for a light emission time of $10^{-3}$ second through an interference filter having a peak at 670 nm and heat developed on a heating drum at 115° C. for 15 seconds.

The image was examined for sensitivity and gradient ($\gamma$). The sensitivity is evaluated in terms of an inversion of an exposure dose providing a density of 3.0 and expressed by a relative value. Note that $\gamma$ is the gradient of a straight line connecting points of density 0.1 and 1.5 on a characteristic curve, indicating the contrast of toe gradation. The dyestuff in the back layer was extinguished by operating a halide lamp for 15 seconds after the heat development.

Thermal Dimensional Change

A support was kept in close contact with the hot plate at 115° C. (used in the heat development) for 30 seconds. The length of the support after heating was measured and a percent shrinkage relative to the initial support was calculated.

Adhesion

Using a razor, the photosensitive material on the surface was scribed with 6 lines in each of longitudinal and transverse directions to define 25 sections. The razor scissions reached the support surface. Mylar® tape (Nitto Denko K.K.) was attached to the sectioned area and quickly peeled off at an angle of 90°. The sample was rated in accordance with number of peeled sections.

| Rating | Number of peeled sections |
|---|---|
| A | 0 |
| B | 1–3 |
| C | 4–10 |
| D | 11–25 |

Samples rated A and B are acceptable.

TABLE 16

| | Dimensional change (%) @ 115° C./30 sec. | | | | |
|---|---|---|---|---|---|
| Support | MD | TD | Adhesion | $\gamma$ | Sensitivity |
| PEN * | 0.04 | 0.04 | B | 15 | 10 |
| PC | 0.02 | 0.02 | A | 15 | 10 |
| PES | 0.04 | 0.03 | B | 15 | 10 |
| PAr | 0.02 | 0.02 | A | 15 | 10 |
| PEEK | 0.03 | 0.03 | B | 15 | 10 |
| polyether PC | 0.04 | 0.02 | B | 15 | 10 |
| PSO | 0.02 | 0.03 | B | 15 | 10 |
| SPS | 0.04 | 0.04 | B | 15 | 10 |
| PEN (heat treated) | 0.02 | 0.02 | A | 15 | 10 |
| PC (heat treated) | 0.01 | 0.01 | A | 15 | 10 |
| PES (heat treated) | 0.02 | 0.02 | A | 15 | 10 |
| PAr (heat treated) | 0.01 | 0.01 | A | 15 | 10 |

TABLE 16-continued

| Support | Dimensional change (%) @ 115° C./30 sec. MD | TD | Adhession | γ | Sensitivity |
|---|---|---|---|---|---|
| PEEK (heat treated) | 0.02 | 0.02 | A | 15 | 10 |
| polyether PC (heat treated) | 0.02 | 0.02 | A | 15 | 10 |
| PSF (heat treated) | 0.01 | 0.01 | A | 15 | 10 |
| SPS (heat treated) | 0.02 | 0.02 | A | 15 | 10 |
| PET * untreated | 0.10 | 0.08 | D | 15 | 10 |
| PET heat treated, tension 15 kg/cm$^2$ | 0.04 | 0.04 | B | 15 | 10 |
| PET heat treated, tension 10 kg/cm$^2$ | 0.03 | 0.03 | B | 15 | 10 |
| PET heat treated, tension 4 kg/cm$^2$ | 0.02 | 0.02 | A | 15 | 10 |

* comparison

As is evident from Table 16, photothermographic material samples within the preferred scope of the invention wherein the dimensional change of a support is limited are improved in adhesion. Quite unexpectedly, better results are obtained when the feed tension of the support during heat treatment is lowered. Owing to high contrast of toe gradation and a minimal thermal dimensional change, photothermographic material samples within the scope of the invention are suited for high precision printing and color printing.

Example 12

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing $1.2\times10^{-5}$ mol/liter of dipotassium hexachloroiridate, an amount (corresponding to $1\times10^{-5}$ mol per mol of silver halide completed) of tetrapotassium iron hexacyanide, and 1 mol/liter of potassium bromide were added over 30 minutes by a controlled double jet method while maintaining the solution at pAg 7.7. The pH of the solution was lowered to cause flocculation and sedimentation for desalting. Phenoxyethanol, 0.1 gram, was added to the solution, which was adjusted to pH 5.9 and pAg 8.2. There were obtained silver iodobromide grains in the form of cubic grains having an iodine content of 8 mol % in the core and 2 mol % on the average, a mean grain size of 0.05 μm, a coefficient of variation of projected area of 8%, and a (100) plane ratio of 88%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound (1-a) shown below, $4.0\times10^{-6}$ mol of chloroauric acid, and $3.0\times10^{-4}$ mol of thiocyanic acid were added per mol of silver. The solution was ripened for 120 minutes and quenched to 30° C., obtaining a silver halide emulsion.

tellurium compound (1-a)

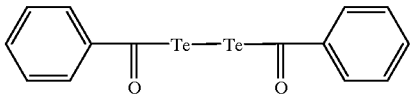

Preparation of Organic Acid Silver Salt Emulsion F

A mixture of 1.3 grams of stearic acid, 0.5 gram of arachidonic acid, 8.5 grams of behenic acid, and 300 ml of distilled water was stirred at 90° C. for 15 minutes. With vigorous stirring, 31.1 ml of 1N NaOH aqueous solution was added over 15 minutes to the solution, which was cooled to 30° C. 7 ml of 1N phosphoric acid aqueous solution was added to the solution, and with more vigorous stirring, 0.012 gram of N-bromosuccinimide was added to the solution and the above-prepared silver halide emulsion was added in such an amount as to give 2.5 mmol of silver halide. Further, 25 ml of 1N silver nitrate aqueous solution was added over 2 minutes and stirring was continued for 90 minutes. The solids were separated by suction filtration and washed with water until the water filtrate reached a conductivity of 30 μS/cm. To the solids, 37 grams of a butyl acetate solution containing 1.2% by weight of polyvinyl acetate was added and agitated. Agitation was stopped whereupon an oil layer separated from an aqueous layer. The aqueous layer was removed together with salts contained therein. To the oil layer, 20 grams of a 2-butanone solution containing 2.5% by weight of polyvinyl butyral (Denka Butyral #3000-K by Denki Kagaku Kogyo K.K.) was added and agitated. Further, 0.1 mmol of pyridinium perbromide and $1.8\times10^{-4}$ mol of calcium bromide dihydrate were added together with 0.7 gram of methanol. 40 grams of 2-butanone and 7.8 grams of polyvinyl butyral (PVB B-76 by Monsanto Co.) were added to the mixture, which was dispersed by a homogenizer. There was obtained an organic acid silver salt emulsion of needle grains having a mean particle size of 0.04 μm, a mean major diameter of 1 μm, and a coefficient of variation of 30%.

Preparation of Organic Acid Silver Salt Emulsion G

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept stirred at 35° C., 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K by Denki Kagaku Kogyo K.K.). The dispersion was further dispersed in 600 grams of polyvinyl butyral (Denka Butyral #4000-2 by Denki Kagaku Kogyo K.K.) and 300 grams of isopropyl alcohol, obtaining an organic acid silver salt emulsion of needle grains having a mean minor diameter of 0.05 μm, a mean major diameter of 1.2 μm, and a coefficient of variation of 25%. Silver bromide grains formed by the addition of potassium bromide had a mean particle size of 0.06 μm.

Preparation of Emulsion Layer coating Solution

Various chemicals were added to the above-prepared organic acid silver salt emulsions F and G as follows. It is noted that the amounts of chemicals added are expressed per mol of silver. With stirring at 25° C., 10 mg of sodium phenylthiosulfonate, 70 mg of dye (a), 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, 8 grams of 5-tribromomethylsulfonyl-2-methylthiadiazole, 6 grams of 2-tribromomethylsulfonylbenzothiazole, 5.2 grams of 4,6-ditrichloromethyl-2-phenyltriazine, 2 grams of disulfide compound (a), 0.45 mol of developing agent (shown in Table 17), 5 grams of tetrachlorophthalic acid, 1.1 grams of Megafax F-176P (fluorinated surfactant by Dai-Nihon Ink Chemical Industry K.K.), 590 grams of 2-butanone and 10 grams of methyl isobutyl ketone were then added.

Emulsion Surface Protecting Layer Coating Solution

A coating solution was prepared by dissolving 75 grams of CAB 171-15S (cellulose acetate butyrate by Eastman Chemical K.K.), 5.7 grams of 4-methylphthalic acid, 1.5 grams of tetrachlorophthalic anhydride, 15 grams of phthalazine, 0.3 grams of Megafax F-176P, 2 grams of Sildex H31 (spherical silica by Dokai Chemical K.K., mean particle size 3 μm), and 7.5 grams of Sumidur N3500 (polyisocyanate by Sumitomo-Bayern Urethane K.K.) in 3,070 grams of 2-butanone and 30 grams of ethyl acetate.

Preparation of Back-Coated Support

Onto a polyethylene terephthalate film (of 100 μm thick) having a moisture-proof undercoat of vinylidene chloride polymer on either surface, a solution of the composition shown below was applied and dried at 50° C. for 10 minutes to form a back layer having a dry thickness of 15 μm.

Preparation of Back Layer Coating Solution

A coating solution was prepared by dissolving 60 grams of a 10% isopropyl alcohol solution of polyvinyl butyral (Denka Butyral #4000-2 by Denki Kagaku Kogyo K.K.), 10 grams of isopropyl alcohol, 8 grams of a 8% ethyl acetate solution of 3-isocyanatomethyl-3, 5,5-trimethylcyclohexyl isocyanate (Wako Junyaku K.K.), and 0.2 gram of a dyestuff (D-1) in 10 grams of methanol and 20 grams of acetone so as to provide an absorbance of 0.8 at the exposure wavelength.

An emulsion layer coating solution was applied onto the surface of the support opposite to the back layer so as to provide a coverage of 1.8 g/m$^2$ of silver. A protective layer coating solution was then applied onto the emulsion layer to form a protective layer having a dry thickness of 2 μm.

Dye (a), disulfide compound (a), and dyestuff (D-1) are shown below.

Dye (a)

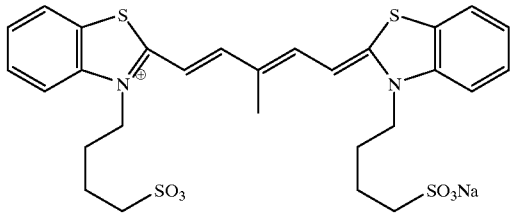

Disulfide compound (a)

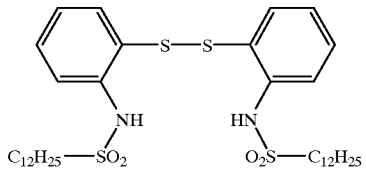

Dyestuff (D-1)

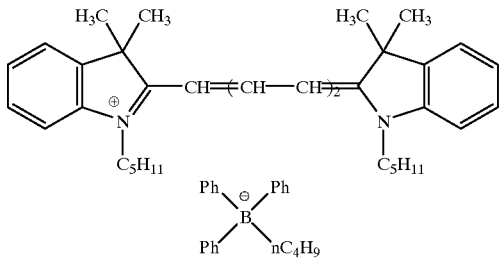

Exposure and Development (1) A sample as prepared above was exposed to xenon flash light for a light emission time of $10^{-6}$ second through an interference filter having a peak at 633 nm and a step wedge. (2) Another sample was similarly exposed to light through an interference filter having a peak at 633 nm, a step wedge, and a 50% screen tint. Thereafter the samples were heated for development at 110° C. for 20 seconds, 30 seconds and 40 seconds.

Photographic Tests

The thus obtained image was measured for density and percent dot area.

Sample (1) was measured for gamma (G0313 and G0330) upon 30-second development. Note that G0313 is the gradient of a straight line connecting points of density 0.3 and 1.3 on a characteristic curve and G0330 is the gradient of a straight line connecting points of density 0.3 and 3.0.

Sample (2) was evaluated for image enlargement (ΔD50). Note that ΔD50 is the difference in percent dot area between 20-second development and 40-second development of the step which gave a percent dot area of 50% upon 20-second development. Larger values indicate greater image enlargement.

The results are shown in Table 17.

TABLE 17

| Sample No. | Organic acid silver salt | Reducing Agent | Hydrazine derivative Type | Amount to (mol) | Formula (A-1) (A-4) | Photographic properties G0313 | G0330 | Image enlargement ΔD50 |
|---|---|---|---|---|---|---|---|---|
| 1701 (comp) | A | R-I-5 | — | — | — | 2.5 | — | 6 |
| 1702 (comp) | A | R-I-5 | I-58 | 0.002 | — | 3.2 | — | 7 |
| 1703 (comp) | A | R-I-5 | I-58 | 0.008 | — | 8.5 | 10 | 21 |
| 1704 (comp) | A | R-I-5 | I-58 | 0.016 | — | 13 | 16 | 28 |
| 1705 | A | R-I-5 | I-58 | 0.002 | *A-1 | 10 | 12 | 8 |
| 1706 | A | R-I-5 | I-58 | 0.004 | *A-1 | 14 | 17 | 12 |
| 1707 | A | R-I-5 | I-58 | 0.002 | A-9 | 11 | 13 | 9 |
| 1708 | A | R-I-5 | I-58 | 0.002 | A-12 | 11 | 14 | 13 |
| 1709 | A | R-I-5 | I-58 | 0.002 | A-21 | 12 | 14 | 12 |
| 1710 | A | R-I-5 | I-58 | 0.002 | B-1 | 10 | 12 | 10 |
| 1711 | A | R-I-5 | I-58 | 0.002 | B-11 | 11 | 13 | 10 |
| 1712 | A | R-I-5 | I-58 | 0.002 | B-14 | 12 | 16 | 13 |
| 1713 | A | R-I-5 | I-58 | 0.002 | B-19 | 10 | 14 | 10 |
| 1714 | A | R-I-5 | I-58 | 0.002 | *C-1 | 10 | 13 | 14 |
| 1715 | A | R-I-5 | I-58 | 0.002 | *C-8 | 10 | 12 | 13 |
| 1716 | A | R-I-28 | I-58 | 0.002 | A-12 | 13 | 15 | 10 |
| 1717 | A | R-I-28 | I-58 | 0.002 | B-14 | 12 | 15 | 10 |
| 1718 | A | R-I-35 | I-58 | 0.002 | A-12 | 13 | 16 | 11 |
| 1719 | A | R-I-35 | I-58 | 0.002 | B-14 | 13 | 17 | 11 |
| 1720 | A | R-II-9 | I-58 | 0.002 | A-12 | 14 | 16 | 10 |
| 1721 | A | R-II-9 | I-58 | 0.002 | B-14 | 13 | 16 | 11 |
| 1722 | A | R-III-1 | I-58 | 0.002 | B-14 | 12 | 14 | 12 |
| 1723 (comp) | B | R-I-5 | I-58 | 0.016 | — | 11 | 16 | 26 |
| 1724 | B | R-I-5 | I-58 | 0.002 | *A-1 | 10 | 14 | 10 |
| 1725 | B | R-I-5 | I-58 | 0.002 | A-12 | 12 | 15 | 12 |
| 1726 | B | R-I-5 | I-58 | 0.002 | B-12 | 13 | 15 | 14 |
| 1727 | B | R-I-5 | I-58 | 0.002 | B-14 | 11 | 15 | 10 |

Note:
(comp) means comparison.
The amount of R-II-9 added was 0.18 mol.
Mark * indicates that the amount of the relevant compound of formula (A-1) to (A-4) added was a twice molar amount.

It is evident from Table 17 that in comparative sample Nos. 1701 to 1704 and 1723, as the amount of hydrazine derivative added increases, contrast becomes high, and as contrast becomes high, image enlargement becomes greater. In contrast, samples within the preferred scope of the invention show high contrast as evidenced by a gamma of at least 10 and minimal image enlargement.

Example 13

Samples were prepared as in Example 12 except that hydrazine derivatives I-1, I-14, I-16, I-26, I-27, I-32, I-46, I-54, I-78, and I-65 were used in combination with the compound of formula (A-1) to (A-4) instead of I-58 added to the emulsion layer of Example 12 and the amount of the hydrazine derivative added was properly adjusted. The samples were examined as in Example 12. The results were equivalent to Example 12.

Example 14

Samples prepared in Example 12 were exposed to xenon flash light for a light emission time of $10^{-6}$ second through an interference filter having a peak at 633 nm, a step wedge, and a 80% or 20% screen tint. Thereafter the samples were heated for development at 110° C. for 20 seconds, 30 seconds and 40 seconds. The samples were measured for percent dot area and examined for ΔD20 and ΔD80, finding that samples within the preferred scope of the invention show improved photographic properties including minimal image enlargement.

Samples prepared in Example 12 were exposed by means of a 633-nm He—Ne laser sensitometer so as to provide a percent dot area of 20%, 50% and 80% upon 20-second development. The samples were examined for ΔD20, ΔD50 and ΔD80 as in Example 12. The results were as good as in Example 12.

Example 15

Samples were prepared as in Example 12 except that hydrazine derivatives I-16, I-19, I-21, I-22, I-26, I-27, I-34, I-48, I-57, and I-80 were used instead of I-58. The results were equivalent to Example 12.

It is thus evident that using a specific nucleation promoter, the invention provides a fully dry basis photothermographic material capable of forming stable ultrahigh contrast images having a minimized change of image enlargement with a variation of developing time and thus suitable for the manufacture of printing plates.

Example 16

Samples were similarly prepared as in Example 11 by coating a photosensitive emulsion and coating the same protective layer. The photosensitive emulsions used were the same as photosensitive emulsion A except that the hydrazine derivative used in emulsion A was replaced by the hydrazine derivatives shown below. The samples were similarly examined.

The supports used were PEN and PC supports and heat treated PEN and PC supports which were heated treated at 180° C. for 4 minutes. Also a PET support and heat treated PET supports were used. The PET supports were heat treated while feeding under a varying tension of 15 kg/cm$^2$, 10 kg/cm$^2$, and 4 kg/cm$^2$.

H-2

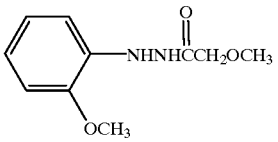

H-3

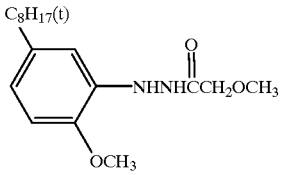

H-4

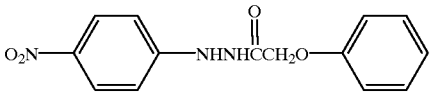

H-5

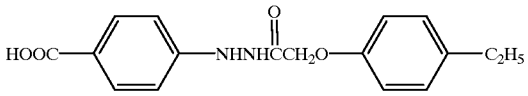

H-6

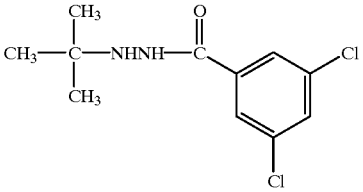

Comparison H-1

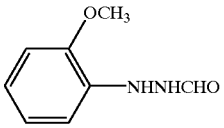

TABLE 18

| Support | Hydrazine | Dimensional change (%) @ 115° C./30 sec. MD | TD | Adhesion | γ | Sensitivity |
|---|---|---|---|---|---|---|
| PC | H-1 | 0.02 | 0.02 | A | 15 | 10 |
| SPS | H-1 | 0.04 | 0.04 | B | 15 | 10 |
| PEN heat treated | H-1 | 0.02 | 0.02 | A | 15 | 10 |
| PC | H-2 | 0.02 | 0.02 | A | 18 | 14 |
| SPS | H-3 | 0.04 | 0.04 | A | 18 | 15 |
| PEN heat treated | H-4 | 0.02 | 0.02 | A | 18 | 16 |
| PET untreated * | H-1 | 0.10 | 0.08 | D | 15 | 10 |
| PET untreated * | H-2 | 0.10 | 0.08 | D | 18 | 14 |
| PET heat treated, tension 15 kg/cm$^2$ | H-1 | 0.04 | 0.04 | B | 18 | 14 |
| PET heat treated, tension 15 kg/cm$^2$ | H-2 | 0.04 | 0.04 | A | 18 | 14 |
| PET heat treated, tension 10 kg/cm$^2$ | H-3 | 0.03 | 0.03 | A | 18 | 16 |
| PET heat treated, tension 10 kg/cm$^2$ | H-4 | 0.03 | 0.03 | A | 18 | 16 |
| PET heat treated, tension 4 kg/cm$^2$ | H-5 | 0.02 | 0.02 | A | 18 | 16 |

TABLE 18-continued

| Support | Hydrazine | Dimensional change (%) @ 115° C./30 sec. MD | TD | Adhesion | γ | Sensitivity |
|---|---|---|---|---|---|---|
| PET heat treated, tension 4 kg/cm$^2$ | H-6 | 0.02 | 0.02 | A | 18 | 16 |

* comparison

As is evident from Table 18, photothermographic material samples within the preferred scope of the invention are improved in adhesion. Quite unexpectedly, better results are obtained when the feed tension of the support during heat treatment is lowered. When hydrazine derivatives within the preferred scope of the invention are used, photothermographic material samples are further improved in sensitivity and γ and become more suited for high precision and color printing applications.

What is claimed is:

1. A photothermographic material comprising a support in the form of a plastic film having a glass transition temperature of at least 90° C., said support having a first and a second surface, and said support having been heat treated at a temperature in the range of 80° to 200° C., and a photosensitive layer disposed on either the first or the second surface of the support and containing an organic silver salt, a photosensitive silver halide, a reducing agent, and an ultrahigh contrast promoting agent;

wherein said photothermographic material further comprises a polymer layer disposed on at least the first or the second surface of the support, containing at least one of a conductive metal oxide and a conductive high molecular weight compound selected from the group consisting of polyvinyl benzenesulfonates, polyvinyl benzyltrimethylammonium chloride, quaternary salt polymers, polymer latexes, CP-1, CP-2 and CP-4 to CP-7:

CP-1

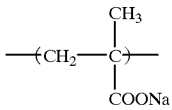

CP-2

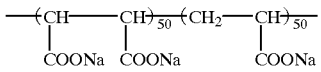

CP-4

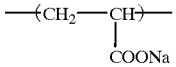

CP-5

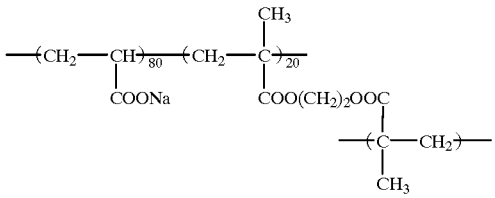

-continued

CP-6

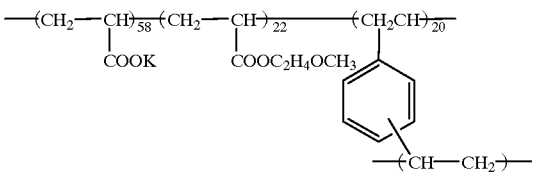

CP-7

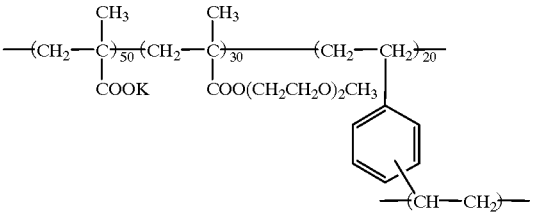

2. The photothermographic material of claim 1 wherein said polymer layer is disposed on the same surface of the support as the photosensitive layer.

3. The photothermographic material of claim 1 wherein when the photosensitive layer is on the first surface of the support, the polymer layer is on the second surface of the support, and when the photosensitive layer is on the second surface of the support, said polymer layer is disposed on the first surface of the support.

4. The photothermographic material of claim 1 wherein said polymer layer is an outermost layer on at least the first or the second surface of the support.

5. The photothermographic material of claim 1 further comprising an outermost layer on either the first or the second surface of the support, at least one of said outermost layer(s) having a Bekk smoothness of up to 4,000 seconds.

6. The photothermographic material of claim 5 further comprising a back layer disposed on the second surface of the support when said photosensitive layer is disposed on the first surface of the support, or the back layer is disposed on the first surface of the support when said photosensitive layer is disposed on the second surface of the support, and said back layer has an outer surface having a Bekk smoothness of up to 4,000 seconds.

7. The photothermographic material of claim 1 wherein the support experiences a dimensional change of less than 0.04% when heated at 115° C. for 30 seconds.

8. The photothermographic material of claim 7 wherein heat treatment is done while the support is fed under a tension of up to 13 kg/cm$^2$.

9. The photothermographic material of claim 8 wherein heat treatment is done while the support is fed under a tension of up to 10 kg/cm$^2$.

10. The photothermographic material of claim 8 wherein heat treatment is done while the support is fed under a tension of up to 4 kg/cm$^2$.

11. The photothermographic material of claim 1 wherein said ultrahigh contrast promoting agent is a compound of the formula (I):

(I)

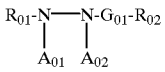

wherein $R_{01}$ is an aliphatic, aromatic or heterocyclic group; $R_{02}$ is a hydrogen atom, alkyl, aryl, heterocyclic, alkoxy, aryloxy, amino or hydrazino group; $G_{01}$ is a group represented by: —CO—, —$SO_2$—, —SO—, —P(=O)(—$R_{03}$)— or —CO—CO—, a thiocarbonyl or iminomethylene group; $A_{01}$ and $A_{02}$ are both hydrogen atoms, or one of $A_{01}$ and $A_{02}$ is a hydrogen atom and the other is a substituted or unsubstituted alkylsulfonyl, arylsulfonyl or acyl group; and $R_{03}$ is a hydrogen atom, alkyl, aryl, heterocyclic, alkoxy, aryloxy, amino or hydrazino group.

12. The photothermographic material of claim 1 wherein said ultrahigh contrast promoting agent is a compound of the formula (III):

(III)

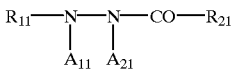

wherein $R_{11}$ is an aromatic group or heterocyclic group; $R_{21}$ is an alkyl group having at least one electron attractive substituent, an aryl group having at least one electron attractive substituent, or a heterocyclic, amino, alkylamino, arylamino, heterocyclic amino, hydrazino, alkoxy or aryloxy group; and $A_{11}$ and $A_{21}$ are both hydrogen atoms, or one of $A_{11}$ and $A_{21}$ is a hydrogen atom and the other is a substituted or unsubstituted alkylsulfonyl, arylsulfonyl or acyl group.

13. The photothermographic material of claim 1 wherein the photosensitive layer has been coated directly on the support.

14. The photothermographic material of claim 1 further comprising a nucleation promoter.

15. The photothermographic material of claim 14 wherein said nucleation promoter is of the following formula (A-1), (A-2), (A-3) or (A-4):

(A-1)

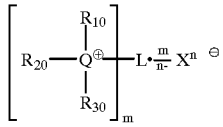

wherein $R_{10}$, $R_{20}$ and $R_{30}$ are independently selected from the group consisting of an alkyl, cycloalkyl, aralkyl, aryl, alkenyl, cycloalkenyl, alkynyl, and heterocyclic group, Q is a nitrogen or phosphorus atom, L is a m-valent organic group attaching to $Q^+$ at its carbon atom, m is an integer of 1 to 4, $X^{n-}$ is a n-valent counter anion, and n is an integer of 1 to 3, with the proviso that $X^{n-}$ does not exist where $R_{10}$, $R_{20}$, $R_{30}$ or L has an anionic group as a substituent to form an intramolecular salt with $Q^+$;

(A-2)

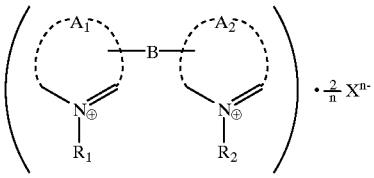

(A-3)

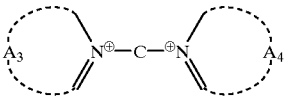

wherein each of $A_1$, $A_2$, $A_3$, and $A_4$ is an organic residue to complete a substituted or unsubstituted, unsaturated heterocyclic ring with the quaternized nitrogen atom, each of B and C is a divalent linking group selected from the group consisting of alkylene, arylene, alkenylene, alkynylene, —$SO_2$—, —SO—, —O—, —S—, —N(RN)—, —C═O—, and —P═O— alone or a combination thereof wherein RN is hydrogen, alkyl, aryl or aralkyl, $R_1$ and $R_2$ each are alkyl or aralkyl, $X^{n-}$ is a n-valent counter anion, and letter n is an integer of 1 to 3, with the proviso that $X^{n-}$ does not exist where an intramolecular salt is formed, (A-4)

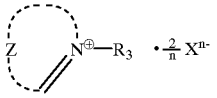

wherein Z is an organic residue to complete a substituted or unsubstituted, unsaturated heterocyclic ring with the quaternized nitrogen atom, $R_3$ is alkyl or aralkyl, $X^{n-}$ is a n-valent counter anion, and letter n is an integer of 1 to 3, with the proviso that $X^{n-}$ does not exist where an intramolecular salt is formed.

16. The photothermographic material of claim 1, wherein said ultrahigh contrast promoting agent is present in an amount of from $1\times10^{-5}$ mol to $5\times10^{-2}$ mol of total silver halide available from the combination of said organic silver salt and said photosensitive silver halide.

17. The photothermographic material of claim 1, wherein said at least one of a conductive metal oxide and a conductive high molecular weight compound is present in an amount of 5 to 95% of the said polymer layer disposed on at least the first or the second surface of the support.

18. The photothermographic material of claim 1, wherein said at least one of a conductive metal oxide and a conductive high molecular weight compound is present in an amount of 0.1 to 10 grams per square meter of the photosensitive material.

19. The photothermographic material of claim 1, wherein said polymer layer disposed on at least the first or the second surface of the support has a resistively of $10^4$ to $10^{11}$ Ω as measured at 25° C. and 25% RH.

20. The photothermographic material of claim 1, which further comprises at least one protective layer.

21. A photothermographic material comprising a support in the form of a plastic film having a glass transition temperature of at least 90° C., said support having a first and a second surface, said support having been heat treated at a temperature in the range of 80° to 200° C., and said support experiences a dimensional change of less than 0.04% when heated at 115° C. for 30 seconds, and a photosensitive layer disposed on either the first or the second surface of the support and containing an organic silver salt, a photosensitive silver halide, a reducing agent, and an ultrahigh contrast promoting agent;

wherein said photothermographic material further comprises a polymer layer disposed on at least the first or the second surface of the support, containing at least one of a conductive metal oxide and a conductive high molecular weight compound selected from the group consisting of polyvinyl benzenesulfonates, polyvinyl benzyltrimethylammonium chloride, quaternary salt polymers, polymer latexes, CP-1, CP-2 and CP-4 to CP-7:

CP-1

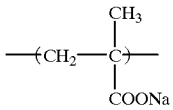

CP-2

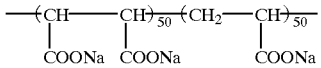

CP-4

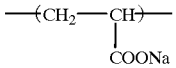

CP-5

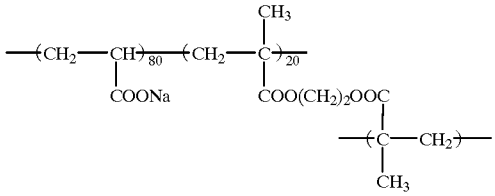

CP-6

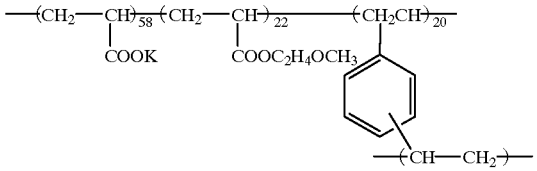

CP-7

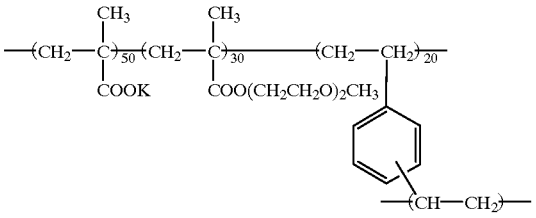

22. A photothermographic material comprising a support in the form of a plastic film having a glass transition temperature of at least 90° C., said support having a first and a second surface, and said support having been heat treated at a temperature in the range of 80° to 200° C., and a photosensitive layer disposed on either the first or the second surface of the support and containing an organic silver salt, a photosensitive silver halide, a reducing agent, and an ultrahigh contrast promoting agent;

wherein said photothermographic material further comprises a polymer layer disposed on at least the first or the second surface of the support, containing at least one of a conductive metal oxide and a conductive high molecular weight compound selected from the group consisting of polyvinyl benzenesulfonates, polyvinyl benzyltrimethylammonium chloride, quaternary salt polymers, polymer latexes, CP-1, CP-2 and CP-4 to CP-7:

CP-1

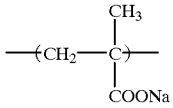

-continued

CP-2

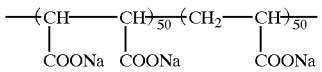

CP-4

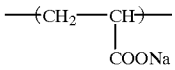

CP-5

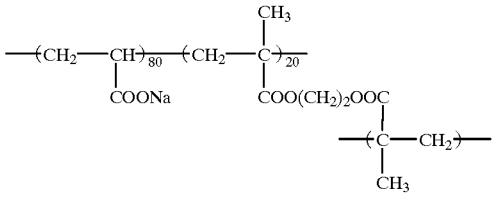

CP-6

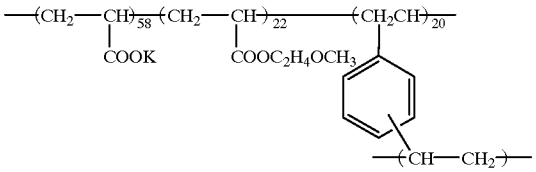

CP-7

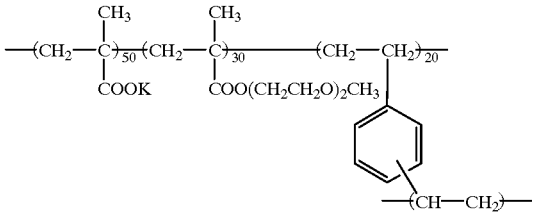

and the photothermographic material further comprising an outermost layer on either the first or the second surface of the support, at least one of said outermost layer(s) having a Bekk smoothness of up to 4,000 seconds, wherein the support experiences a dimensional change of less than 0.04% when heated at 115° C. for 30 seconds, wherein heat treatment is done while the support is fed under a tension of up to 13 kg/cm$^2$, and wherein the photothermographic material further comprising a nucleation promoter.

23. The photothermographic material of claim 22, which further comprises at least one protective layer.

24. A photothermographic material comprising a support in the form of a plastic film having a glass transition temperature of at least 90° C., said support having a first and a second surface, and said support having been heat treated at a temperature in the range of 80° to 200° C., and a photosensitive layer disposed on the first surface of the support and containing an organic silver salt, a photosensitive silver halide, a reducing agent, and an ultra-high contrast promoting agent;

wherein said photothermographic material further comprises a polymer layer disposed on the second surface of the support, containing at least one of a conductive metal oxide and a conductive high molecular weight compound selected from the group consisting of polyvinyl benzenesulfonates, polyvinyl benzyltrimethylammonium chloride, quaternary salt polymers, polymer latexes, CP-1, CP-2 and CP-4 to CP-7:

CP-1

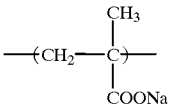

CP-2

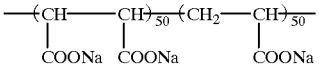

CP-4

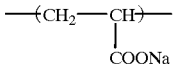

CP-5

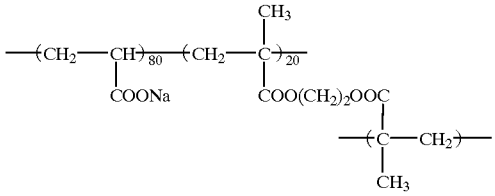

CP-6

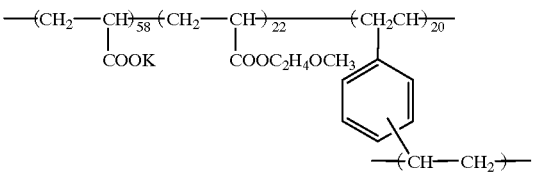

CP-7

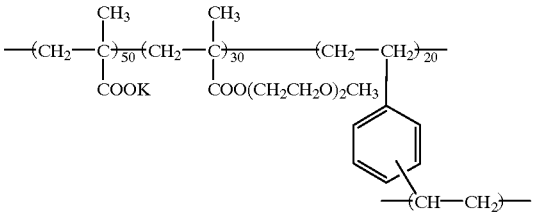

25. The photothermographic material of claim 24, which further comprises at least one protective layer.

26. A photothermographic material comprising a support in the form of a plastic film having a glass transition temperature of at least 90° C., said support having a first and a second surface, said support having been heat treated at a temperature in the range of 80° to 200° C., and said support experiences a dimensional change of less than 0.04% when heated at 115° C. for 30 seconds, and a photosensitive layer disposed on the first surface of the support and containing an organic silver salt, a photosensitive silver halide, a reducing agent, and an ultra-high contrast promoting agent;

wherein said photothermographic material further comprises a polymer layer disposed on the second surface of the support, containing at least one of a conductive metal oxide and a conductive high molecular weight compound selected from the group consisting of polyvinyl benzenesulfonates, polyvinyl benzyltrimethylammonium chloride, quaternary salt polymers, polymer latexes, CP-1, CP-2 and CP-4 to CP-7:

CP-1
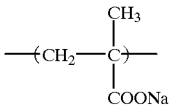
CP-2
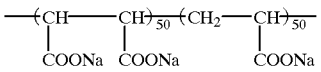
CP-4
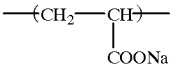
CP-5
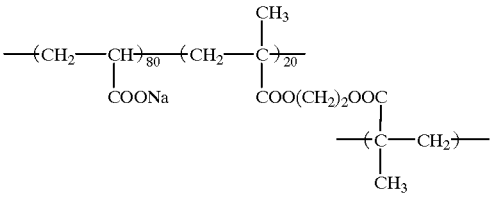
-continued
CP-6
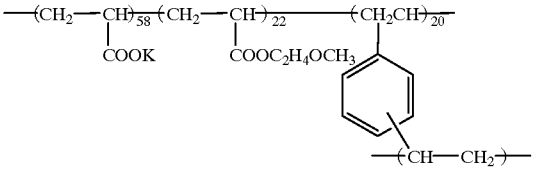
CP-7
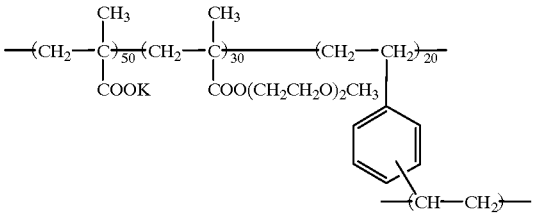
27. The photothermographic material of claim 26, which further comprises at least one protective layer.
* * * * *

UNITED STATES PATENT AND TRADEMARK OFFICE

CERTIFICATE OF CORRECTION

PATENT NO. : 6,203,972 B1 
DATED : March 20, 2001
INVENTOR(S) : Kazunobu Katoh et al.

It is certified that error appears in the above-identified patent and that said Letters Patent is hereby corrected as shown below:

Column 116,
Between lines 60 and 65, please correct formula (A-3) as follows:

-- 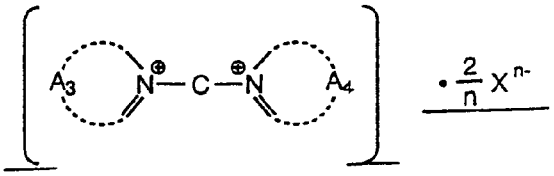 --

Signed and Sealed this

Thirtieth Day of July, 2002

*Attest:*

*Attesting Officer*

JAMES E. ROGAN
*Director of the United States Patent and Trademark Office*